US005155286A

United States Patent [19]

Saito et al.

[11] Patent Number: 5,155,286

[45] Date of Patent: Oct. 13, 1992

[54] MOTIF PERFORMING APPARATUS

[75] Inventors: Toshihide Saito, Hamamatsu; Tsutomu Saito, Iwata; Toshio Mishima, Kuki; Makoto Sekizuka, Iwata, all of Japan

[73] Assignee: Kawai Musical Inst. Mfg. Co., Ltd., Syuoka, Japan

[21] Appl. No.: 596,213

[22] Filed: Oct. 11, 1990

[30] Foreign Application Priority Data

Oct. 12, 1989 [JP] Japan ..... 1-265880

[51] Int. Cl.[5] ..... G10H 1/38; G10H 1/40; G10H 7/00

[52] U.S. Cl. ..... 84/611; 84/613; 84/DIG. 12; 84/DIG. 22

[58] Field of Search ..... 84/609-614, 84/634-638, DIG. 12, DIG. 22

[56] References Cited

U.S. PATENT DOCUMENTS 4,926,737 5/1990 Minamitaka ..... 84/611
4,982,643 1/1991 Minamitaka ..... 84/613

*Primary Examiner*—Stanley J. Witkowski

[57] ABSTRACT

A motif performing apparatus for use in an electronic musical instrument, which effects an automatic performance of a motif only while sounds are being radiated. The motif performing apparatus is able to store information representing motifs to be played, and to read and output information representing each of the motifs, separately, while instruction units for instructing a radiation of musical sounds are operated. Accordingly, even if the operation of an instruction unit is unchanged, the performance is varied according to a pattern of the information. Further, as long as the instruction unit is operated, a plurality of musical sounds are generated automatically and sequentially according to the pattern of the information, and thus a performance can be easily effected. Furthermore, the motif performing apparatus can effect the automatic performance only while the instruction unit is operated, and therefore, the automatic performance can be stopped at any time by stopping the operation of the instruction unit, and thus the player can play the electronic musical instrument while effecting an automatic performance by operating the instruction unit.

32 Claims, 37 Drawing Sheets

FIG. 1A

AD-LIB MOTIF PATTERN AREA
(16BEAT.AD-LIB MOTIF 1st MELODY)
DATA ITEM 42 (47)

| ADDRESS | | |
|---|---|---|
| 000H | AD-LIB MOTIF START ADDRESS LIST | 42a (47a) |
| 020H | AD-LIB MOTIF ASSIGNMENT LIST | 42b (47b) |
| 060H | AD-LIB MOTIF PATTERN 0 | |
| 092H | AD-LIB MOTIF PATTERN 1 | |
| 0AEH | AD-LIB MOTIF PATTERN 2 | |
| 0EEH | AD-LIB MOTIF PATTERN 3 | |
| 108H | AD-LIB MOTIF PATTERN 4 | |
| 132H | AD-LIB MOTIF PATTERN 5 | |
| 164H | ..... | |
| 3A8H | AD-LIB MOTIF PATTERN 15 | |
| 3C6H | | |
| 3FFH | | |

FIG. 1B

AD-LIB MOTIF START ADDRESS LIST
(16BEAT.AD-LIB MOTIF 1st MELODY)

| AD-LID MOTIF PATTERN NO. |
|---|
| 0 |
| 1 |
| 2 |
| 3 |
| 4 |
| 5 |
| ..... |
| 15 |

42a (47a)

| ADDRESS | AD-LIB MOTIF START ADDRESS | |
|---|---|---|
| | HIGH BYTE | LOW BYTE |
| 000H | 00H | 60H |
| 002H | 00H | 92H |
| 004H | 00H | AEH |
| 006H | 00H | EEH |
| 008H | 01H | 08H |
| 00AH | 01H | 32H |
| ..... | ..... | ..... |
| 01EH | 03H | A8H |

FIG. 1C

AD-LIB MOTIF ASSIGNMENT LIST (16BEAT.AD-LIB MOTIF 1st MELODY)

42b (47b)

| ITEM | ADDRESS | AD-LIB MOTIF PATTERN NO. | |
|---|---|---|---|
| MEASURE CLOCK NO. | 020H | 192 | METER DATA |
| | 021H | | |
| AUTOMATIC ARPEGGIO | 022H | 3 | AUTOMATIC MOTIF PATTERN |
| AUTOMATIC BASS | 023H | 8 | |
| 1st AUTOMATIC RHY. | 024H | 4 | |
| 2nd AUTOMATIC RHY. | 025H | 2 | |
| RHYTHM DELAY | 026H | 12 | |
| | 027H | | |
| KEY NO. 24 | 028H | 0 | LOWER PART FIXED |
| KEY NO. 25 | 029H | 1 | |
| KEY NO. 26 | 02AH | 2 | |
| KEY NO. 27 | 02BH | 3 | |
| ⋮ | ⋮ | ⋮ | |
| KEY NO. 39 | 037H | 15 | |
| KEY NO. 40 | 038H | 7 | LOWER PART ASSIGNABLE |
| KEY NO. 41 | 039H | 9 | |
| KEY NO. 42 | 03AH | 3 | |
| KEY NO. 43 | 03BH | 11 | |
| KEY NO. 44 | 03CH | 0 | UPPER PART FIXED |
| KEY NO. 45 | 03DH | 1 | |
| KEY NO. 46 | 03EH | 2 | |
| KEY NO. 47 | 03FH | 3 | |
| KEY NO. 48 | 040H | 4 | |
| ⋮ | ⋮ | ⋮ | |
| KEY NO. 59 | 04BH | 15 | |
| KEY NO. 60 | 04CH | 2 | UPPER PART ASSIGNABLE |
| KEY NO. 61 | 04DH | 4 | |
| KEY NO. 62 | 04EH | 7 | |
| KEY NO. 63 | 04FH | 3 | |
| ⋮ | ⋮ | ⋮ | |
| KEY NO. 69 | 055H | 3 | |
| KEY NO. 70 | 056H | 0 | |
| KEY NO. 71 | 057H | 14 | |
| KEY NO. 72 | 058H | 11 | |
| ⋮ | ⋮ | ⋮ | |
| | 05FH | | |

RHY.:RHYTHM

FIG. 2A

MELODY

| ADDRESS | DATA ITEM 7 | 6 | 5 | 4 | 3 | 2 | 1 | 0 | |
|---|---|---|---|---|---|---|---|---|---|
| *00 | 1 | MELODIC TIMBRE NO. (0~31) | | | | | | | TIMBRE |
| *01 | 0 | 0 | 0 | 0 | 0 | 0 | 0 | 0 | |
| *02 | 0 | KEY NO. (0~120) | | | | | | | NOTE |
| *03 | GATING TIME (0~255) | | | | | | | | |
| *04 | 0 | VELOCITY (0~127) | | | | | | | |
| *05 | STEP TIME (0~255) | | | | | | | | |
| *06 | 0 | KEY NO. (0~120) | | | | | | | NOTE |
| *07 | GATING TIME (0~255) | | | | | | | | |
| *08 | 0 | VELOCITY (0~127) | | | | | | | |
| *09 | STEP TIME (0~255) | | | | | | | | |
| *0A | 0 | KEY NO. (0~120) | | | | | | | NOTE |
| *0B | GATING TIME (0~255) | | | | | | | | |
| *0C | 0 | VELOCITY (0~127) | | | | | | | |
| *0D | STEP TIME (0~255) | | | | | | | | |
| *0E | | | | | | | | | |
| ⋮ | ⋮ | | | | | | | | |
| 2K+0 | 1 | MELODIC TIMBRE NO. (0~31) | | | | | | | TIMBRE |
| 2K+1 | STEP TIME (0~255) | | | | | | | | |
| 2K+2 | 0 | KEY NO. (0~120) | | | | | | | NOTE |
| 2K+3 | GATING TIME (0~255) | | | | | | | | |
| 2K+4 | 0 | VELOCITY (0~127) | | | | | | | |
| 2K+5 | STEP TIME (0~255) | | | | | | | | |
| 2K+6 | | | | | | | | | |
| ⋮ | ⋮ | | | | | | | | |
| 2L+0 | 1 | 1 | 1 | 1 | 1 | 1 | 1 | 1 | REPEAT |
| 2L+1 | STEP TIME (0~255) | | | | | | | | |

FIG. 2B

RHYTHM

| ADDRESS | DATA ITEM 7 | 6 | 5 | 4 | 3 | 2 | 1 | 0 | |
|---|---|---|---|---|---|---|---|---|---|
| *00 | 1 | KEY NO. OF LOWER PART (24~43) | | | | | | | TIMBRE |
| *01 | 0 | 0 | 0 | 0 | 0 | 0 | 0 | 0 | |
| *02 | 0 | VELOCITY (0~127) | | | | | | | BEAT |
| *03 | STEP TIME (0~255) | | | | | | | | |
| *04 | 0 | VELOCITY (0~127) | | | | | | | BEAT |
| *05 | STEP TIME (0~255) | | | | | | | | |
| *06 | 0 | VELOCITY (0~127) | | | | | | | BEAT |
| *07 | STEP TIME (0~255) | | | | | | | | |
| *08 | 0 | KEY NO. OF LOWER PART (24~43) | | | | | | | TIMBRE |
| *09 | STEP TIME (0~255) | | | | | | | | |
| *0A | 0 | VELOCITY (0~127) | | | | | | | BEAT |
| *0B | STEP TIME (0~255) | | | | | | | | |
| *0C | 0 | VELOCITY (0~127) | | | | | | | BEAT |
| *0D | STEP TIME (0~255) | | | | | | | | |
| *0E ⋮ | ⋮ | | | | | | | | |
| 2M+0 | 1 | 1 | 1 | 1 | 1 | 1 | 1 | 1 | REPEAT |
| 2M+1 | STEP TIME (0~255) | | | | | | | | |

FIG. 2C

CHORD

| ADDRESS | DATA ITEM 7 | 6 | 5 | 4 | 3 | 2 | 1 | 0 | |
|---|---|---|---|---|---|---|---|---|---|
| *00 | 1 | CHORD (0~6) | | | ROOT (0~11) | | | | CHORD |
| *01 | 0 | 0 | 0 | 0 | 0 | 0 | 0 | 0 | |
| *02 | 0 | CHORD (0~6) | | | ROOT (0~11) | | | | CHORD |
| *03 | STEP TIME (0~255) | | | | | | | | |
| *04 | 0 | CHORD (0~6) | | | ROOT (0~11) | | | | CHORD |
| *05 | STEP TIME (0~255) | | | | | | | | |
| *06 ⋮ | ⋮ | | | | | | | | |
| 2N+0 | 1 | 1 | 1 | 1 | 1 | 1 | 1 | 1 | REPEAT |
| 2N+1 | STEP TIME (0~255) | | | | | | | | |

FIG. 3

41

| RHYTHM NO. REG. | MOTIF / RHYTHM | AD-LIB MOTIF 1st MELODY | AD-LIB MOTIF 2nd MELODY | AD-LIB MOTIF BASS | AD-LIB MOTIF RHYTHM | AD-LIB MOTIF CHORD |
|---|---|---|---|---|---|---|
| 0 | 16BEAT | 0000H ~ 03FFH | 0400H ~ 07FFH | 0800H ~ 0BFFH | 0C00H ~ 0DFFH | 0E00H ~ 0FFFH |
| 1 | DISCO | 1000H ~ 13FFH | 1400H ~ 17FFH | 1800H ~ 1BFFH | 1C00H ~ 1DFFH | 1E00H ~ 1FFFH |
| 2 | BOSSANOVA | 2000H ~ 23FFH | 2400H ~ 27FFH | 2800H ~ 2BFFH | 2C00H ~ 2DFFH | 2E00H ~ 2FFFH |
| ⋮ | ⋮ | ⋮ | ⋮ | ⋮ | ⋮ | ⋮ |
| 15 | WALTZ | F000H ~ F300H | F400H ~ F7FFH | F800H ~ FBFFH | FC00H ~ FDFFH | FE00H ~ FFFFH |

REG.:REGISTER

1024BYTE 512BYTE

FIG. 6

| TONE NO. | MELODIC TIMBRE NO. | MELODIC TIMBRE NAME(INCL.BASS) |
|---|---|---|
| 00H | 00H | STRINGS 1 |
| 01H | 00H | STRINGS 2 |
| 02H | 00H | STRINGS 3 |
| 03H | 00H | STRINGS 4 |
| 04H | 04H | BRASS 1 |
| 05H | 04H | BRASS 2 |
| 06H | 04H | BRASS 3 |
| 07H | 04H | BRASS 4 |
| 08H | 08H | REEDS 1 |
| 09H | 08H | REEDS 2 |
| 0AH | 08H | REEDS 3 |
| 0BH | 08H | REEDS 4 |
| 0CH | 0CH | VOCAL 1 |
| 0DH | 0CH | VOCAL 2 |
| 0EH | 0CH | VOCAL 3 |
| 0FH | 0CH | VOCAL 4 |
| 10H | 10H | HARMONICA 1 |
| 11H | 10H | HARMONICA 2 |
| 12H | 10H | HARMONICA 3 |
| 13H | 10H | HARMONICA 4 |
| 14H | 14H | ORGAN 1 |
| 15H | 14H | ORGAN 2 |
| 16H | 14H | ORGAN 3 |
| 17H | 14H | ORGAN 4 |
| ⋮ | ⋮ | ⋮ |
| 7CH | 7CH | FUNK BASS 1 |
| 7DH | 7CH | FUNK BASS 2 |
| 7EH | 7CH | FUNK BASS 3 |
| 7FH | 7CH | FUNK BASS 4 |

INCL.: INCLUDE

| TONE NO. | RHYTHMIC TIMBRE NO. | RHYTHMIC TIMBRE NAME | |
|---|---|---|---|
| 80H | 00H | BASS DRUM 1 | DRUM TYPE |
| 81H | 00H | BASS DRUM 2 | |
| 82H | 00H | BASS DRUM 3 | |
| 83H | 00H | BASS DRUM 4 | |
| 84H | 04H | SNARE DRUM 1 | |
| 85H | 04H | SNARE DRUM 2 | |
| 86H | 04H | SNARE DRUM 3 | |
| 87H | 04H | SNARE DRUM 4 | |
| 88H | 08H | LOW TOM 1 | |
| 89H | 08H | LOW TOM 2 | |
| 8AH | 08H | LOW TOM 3 | |
| 8BH | 08H | LOW TOM 4 | |
| 8CH | 0CH | MID TOM 1 | |
| 8DH | 0CH | MID TOM 2 | |
| 8EH | 0CH | MID TOM 3 | |
| 8FH | 0CH | MID TOM 4 | |
| ⋮ | ⋮ | ⋮ | |
| C0H | 40H | HIGH HAT 1 | CYMBAL TYPE |
| C1H | 40H | HIGH HAT 2 | |
| C2H | 40H | HIGH HAT 3 | |
| C3H | 40H | HIGH HAT 4 | |
| C4H | 44H | CRASH 1 | |
| C5H | 44H | CRASH 2 | |
| C6H | 44H | CRASH 3 | |
| C7H | 44H | CRASH 4 | |
| ⋮ | ⋮ | ⋮ | |
| DCH | 5CH | CLICK 1 | |
| DDH | 5CH | CLICK 2 | |
| DEH | 5CH | CLICK 3 | |
| DFH | 5CH | CLICK 4 | |
| ⋮ | ⋮ | ⋮ | |

FIG. 7

| NO. OF CLOCK PULSES / METER | MEASURE CLOCK | BEAT CLOCK |
|---|---|---|
| 1/2 | 96 | 96 |
| 2/2 | 192 | 96 |
| 1/4 | 48 | 48 |
| 2/4 | 96 | 48 |
| 3/4 | 144 | 48 |
| 4/4 | 192 | 48 |
| 5/4 | 240 | 48 |
| 1/8 | 24 | 24 |
| 2/8 | 48 | 24 |
| 3/8 | 72 | 24 |
| 4/8 | 96 | 24 |
| 5/8 | 120 | 24 |
| 6/8 | 144 | 24 |
| 7/8 | 168 | 24 |
| 8/8 | 192 | 24 |
| 9/8 | 216 | 24 |
| 10/8 | 240 | 24 |

FIG. 8

44

| KEY |
|---|
| WHITE |
| BLACK |
| WHITE |
| BLACK |
| WHITE |
| WHITE |
| BLACK |
| WHITE |
| BLACK |
| WHITE |
| ⋮ |
| WHITE |
| BLACK |
| WHITE |

| KEY NO. OF LOWER PART | PERCUSSION TIMBRE NO. | SOUNDING KEY NO. |
|---|---|---|
| 24 | 00(DRUM) | 121 |
| 25 | 40(CYMBALS) | 121 |
| 26 | 04(DRUM) | 122 |
| 27 | 44(CYMBALS) | 121 |
| 28 | 08(DRUM) | 121 |
| 29 | 0C(DRUM) | 123 |
| 30 | 48(CYMBALS) | 121 |
| 31 | 10(DRUM) | 124 |
| 32 | 4C(CYMBALS) | 121 |
| 33 | 14(DRUM) | 125 |
| ⋮ | ⋮ | ⋮ |
| 41 | 28(DRUM) | 121 |
| 42 | 5C(CYMBALS) | 121 |
| 43 | 2C(DRUM) | 127 |

FIG. 9

45

| KEY NO. | BIT PATTERN 7 | 6 | 5 | 4 | 3 | 2 | 1 | 0 | |
|---|---|---|---|---|---|---|---|---|---|
| 24 | 0 | 0 | 0 | 0 | 0 | 1 | 0 | 0 | LOWER PART OF KEYBOARD |
| 25 | 0 | 0 | 0 | 0 | 1 | 0 | 0 | 0 | |
| 26 | 0 | 0 | 0 | 0 | 0 | 1 | 0 | 0 | |
| 27 | 0 | 0 | 0 | 0 | 1 | 0 | 0 | 0 | |
| 28 | 0 | 0 | 0 | 0 | 0 | 1 | 0 | 0 | |
| 29 | 0 | 0 | 0 | 0 | 0 | 1 | 0 | 0 | |
| 30 | 0 | 0 | 0 | 0 | 1 | 0 | 0 | 0 | |
| 31 | 0 | 0 | 0 | 0 | 0 | 1 | 0 | 0 | |
| 32 | 0 | 0 | 0 | 0 | 1 | 0 | 0 | 0 | |
| ⋮ ⋮ | | | | ⋮ ⋮ | | | | | |
| 41 | 0 | 0 | 0 | 0 | 0 | 1 | 0 | 0 | |
| 42 | 0 | 0 | 0 | 0 | 1 | 0 | 0 | 0 | |
| 43 | 0 | 0 | 0 | 0 | 0 | 1 | 0 | 0 | |
| 44 | 0 | 0 | 0 | 0 | 0 | 0 | 1 | 0 | UPPER PART OF KEYBOARD |
| 45 | 0 | 0 | 0 | 0 | 0 | 0 | 0 | 1 | |
| 46 | 0 | 0 | 0 | 0 | 0 | 0 | 1 | 0 | |
| 47 | 0 | 0 | 0 | 0 | 0 | 0 | 0 | 1 | |
| 48 | 0 | 0 | 0 | 0 | 0 | 0 | 0 | 1 | |
| 49 | 0 | 0 | 0 | 0 | 0 | 0 | 1 | 0 | |
| ⋮ ⋮ | | | | ⋮ ⋮ | | | | | |
| 69 | 0 | 0 | 0 | 0 | 0 | 0 | 0 | 1 | |
| 70 | 0 | 0 | 0 | 0 | 0 | 0 | 1 | 0 | |
| 71 | 0 | 0 | 0 | 0 | 0 | 0 | 0 | 1 | |
| 72 | 0 | 0 | 0 | 0 | 0 | 0 | 0 | 1 | |

FIG. 10

48 (49)

| | | | | |
|---|---|---|---|---|
| 000 | ON/OFF | KEY NO. | | NOTE |
| 001 | | GATING TIME | | |
| 002 | | VELOCITY | | |
| 003 | | TIMBRE NO. | | |
| 004 | ON/OFF | KEY NO. | | NOTE |
| 005 | | GATING TIME | | |
| 006 | | VELOCITY | | |
| 007 | | TIMBRE NO. | | |
| 008 | ON/OFF | KEY NO. | | NOTE |
| 009 | | GATING TIME | | |
| 00A | | VELOCITY | | |
| 00B | | TIMBRE NO. | | |
| 00C | ON/OFF | KEY NO. | | NOTE |
| 00D | | GATING TIME | | |
| 00E | | VELOCITY | | |
| 00F | | TIMBRE NO | | |
| 010 | | ⋮ | | |
| ⋮ | | | | |
| 3FB | | | | |
| 3FC | ON/OFF | KEY NO. | | NOTE |
| 3FD | | GATING TIME | | |
| 3FE | | VELOCITY | | |
| 3FF | | TIMBRE NO. | | |

FIG. 11

| | 7 | 6 5 4 3 2 1 0 | | |
|---|---|---|---|---|
| 00 | ON/OFF | KEY NO. | (0~120) | CH0 |
| 01 | | GATING TIME/ENVELOPE | (0~255) | |
| 02 | | VELOCITY | (0~127) | |
| 03 | | TONE NO. | (0~255) | |
| 04 | ON/OFF | KEY NO. | (0~120) | CH1 |
| 05 | | GATING TIME/ENVELOPE | (0~255) | |
| 06 | | VELOCITY | (0~127) | |
| 07 | | TONE NO. | (0~255) | |
| 08 | ON/OFF | KEY NO. | (0~120) | CH2 |
| 09 | | GATING TIME/ENVELOPE | (0~255) | |
| 0A | | VELOCITY | (0~127) | |
| 0B | | TONE NO. | (0~255) | |
| 0C | ON/OFF | KEY NO. | (0~120) | CH3 |
| 0D | | GATING TIME/ENVELOPE | (0~255) | |
| 0E | | VELOCITY | (0~127) | |
| 0F | | TONE NO. | (0~255) | |
| 10 | | | | |
| ⋮ | | ⋮ | | |
| 3B | | | | |
| 3C | ON/OFF | KEY NO. | (0~120) | CH15 |
| 3D | | GATING TIME/ENVELOPE | (0~255) | |
| 3E | | VELOCITY | (0~127) | |
| 3F | | TONE NO. | (0~255) | |

CH : CHANNEL

FIG. 12A

| OFA | MODE | KEY BOARD | | AUTOMATIC MOTIVE | | |
|---|---|---|---|---|---|---|
| | | UPPER PART | LOWER PART | AUTOMATIC ARPEGGIO | AUTOMATIC BASS | AUTOMATIC RHYTHM |
| OFF | (a) NORMAL | MANUAL PERFORMANCE OF MELODIC MOTIF | MANUAL PERFORMANCE OF MELODIC MOTIF | | | PEFORMANCE |
| | (b) BASS/ RHYTHM | MANUAL PERFORMANCE OF BASS MOTIF | MANUAL PERFORMANCE OF RHYTHMIC MOTIF | | | PEFORMANCE |
| | (c) AUTO-MATIC | MANUAL PERFORMANCE OF MELODIC MOTIF | (MANUAL DETECTOIN OF CHORD) NOT SOUNDED | PEFORMANCE (*1) | PEFORMANCE (*1) | PEFORMANCE |
| ON | (d) NORMAL | AD-LIB MELODY MOTIF AD-LIB MELODY MOTIF (*1) | MANUAL PERFORMANCE OF MELODIC MOTIF (MANUAL DETECTOIN OF CHORD) | | | PEFORMANCE |
| | (e) BASS/ RHYTHM | AD-LIB BASS MOTIF (*1) | AD-LIB RHYTHMIC MOTIF AD-LIB RHYTHMIC MOTIF | | | PEFORMANCE EXCEPTING PART CORRES. TO AD-LIB MOTIF |
| | (f) AUTO-MATIC | 1st MELODIC AD-LIB MOTIF 2nd MELODIC AD-LIB MOTIF (*1) | (DETECTION OF AD-LIB CHORD MOTIF) NOT SOUNDED | PEFORMANCE (*1) | PEFORMANCE (*1) | PEFORMANCE |
| OFA OFF & R/A ON | (g) NORMAL | RECORDING OF 1st AD-LIB MELODIC MOTIF ASSIGNMENT OF 1st AD-LIB MELODIC MOTIF | | | | |
| | (h) BASS/ RHYTHM | RECORDING OF AD-LIB BASS MOTIF ASSIGNMENT OF AD-LIB BASS MOTIF | RECORDING OF AD-LIB RHYTHMIC MOTIF ASSIGNMENT OF AD-LIB RHYTHMIC MOTIF | | | |
| | (i) AUTO-MATIC | RECORDING OF 2nd MELODIC AD-LIB MOTIF ASSIGNMENT OF AUTMATIC BASS MOTIF | RECORDING OF AD-LIB CHORD MOTIF ASSG. OF 1ST & 2nd RHY. AUTOMATIC MOTIF | | | |

ASSG.: ASSIGNMENT RHY.: RHYTHMIC (*1) : DETECTION OF CHORD & MODIFICATION

FIG. 12B

| OFA | MODE | CHORD SEQ. | MELODY2 SEQ. | MELODY1 SEQ. | ARPEGGIO SEQ. | BASS SEQ. | RHYTHM2 SEQ. | RHYTHM1 SEQ. |
|---|---|---|---|---|---|---|---|---|
| OFF | (a) NORMAL | | | | | | △ | △ |
| | (b) BASS/RHYTHM | | | | | | △ | △ |
| | (c) AUTO-MATIC | | | | △ | △ | △ | △ |
| ON | (d) NORMAL | | ○ | ○ | | | △ | △ |
| | (e) BASS/RHYTHM | | | | | △ ○ | △ ○ | △ ○ |
| | (f) AUTO-MATIC | ○ | ○ | ○ | △ | △ | △ | △ |

SEQ.: SEQUENCE

FIG. 13A

46

| | | |
|---|---|---|
| MEASURE CLOCK NO.REG. | 24~240 | 71 |
| TEMPO REG. | 40~240 | 72 |
| MODE REG. | – \| OFA \| R/A \| AUT \| B/R \| NOR \| S/S | 73 |
| MELODIC TIMBRE REG. | – \| 0 ~ 31 \| – | 74 |
| RHYTHM NO. REG. | – \| 0 ~ 15 | 75 |
| CHORD REG. | – \| 1~7 (CHORD) \| 0~11 (ROOT) | 76 |
| KEY STATUS REG. | G2 F# F E D# D C# C2<br>B2 A# A G#<br>G3 F# F E D# D C# C3 | 77 |

SEQ. REG. GROUP OF "RHYTHM 1" (DRUM TYPE) — 78

| | | |
|---|---|---|
| A | USE | KEY NO. & PATTERN NO. |
| B | | PERCUSSION TIMBRE NO. |
| C | | SOUNDING KEY NO. |
| D | | STEP TIME |
| HL | | LOADING ADDRESS (L)<br>LOADING ADDRESS (H) |
| M | M/A | MEASURE |

SEQ. REG. GROUP OF "RHYTHM 2" (CYMBSLS TYPE) — 79

| | | |
|---|---|---|
| A | USE | KEY NO. & PATTERN NO. |
| B | | PERCUSSION TIMBRE NO. |
| C | | SOUNDING KEY NO. |
| D | | STEP TIME |
| HL | | LOADING ADDRESS (L)<br>LOADING ADDRESS (H) |
| M | M/A | MEASURE |

SEQ. REG. GROUP OF "BASS" — 80

| | | |
|---|---|---|
| A | USE | KEY NO. & PATTERN NO. |
| B | | MELODIC TIMBRE NO. |
| D | | STEP TIME |
| HL | | LOADING ADDRESS (L)<br>LOADING ADDRESS (H) |

SEQ. REG. GROUP OF "ARPEGGIO" — 81

| | | |
|---|---|---|
| A | USE | KEY NO. & PATTERN NO. |
| B | | MELODIC TIMBRE NO. |
| D | | STEP TIME |
| HL | | LOADING ADDRESS (L)<br>LOADING ADDRESS (H) |

SEQ. REG. GROUP OF "MELODY 1" — 82

| | | |
|---|---|---|
| A | USE | OPERATED KEY NO. |
| B | | MELODIC TIMBRE NO. |
| D | | STEP TIME |
| HL | | LOADING ADDRESS (L)<br>LOADING ADDRESS (H) |

FIG. 13B

46

| | | | |
|---|---|---|---|
| SEQ. REG. GROU OF "MELODY 2" | 83 | A | USE / OPERATED KEY NO. |
| | | B | MELODIC TIMBRE NO. |
| | | D | STEP TIME |
| | | HL | LOADING ADDRESS (L) / LOADING ADDRESS (H) |
| SEQ. REG. GROU OF "CHORD" | 84 | A | USE / OPERATED KEY NO. |
| | | D | STEP TIME |
| | | HL | LOADING ADDRESS (L) / LOADING ADDRESS (H) |
| MEASURE CLOCK COUNTER | 85 | | +1 (L) / (H) |
| STEP TIME COUNTER | 86 | | +1 |
| RECORDING ADDRESS REG. | 87 | | 0~3FFH (L) / (H) |
| RHYTHM KEY NO. REG. | 88 | | 24~43 |
| EVENT ON/OFF REG. | 89 | | ON/OFF / – |
| EVENT KEY NO. REG. | 90 | | – / KEY NO. |
| EVENT VELOCITY REG. | 91 | | – / VELOCITY |
| RING TOP ADDRESS REG. | 92 | | 0~3FFH (L) / (H) |
| RING BOTTOM ADDRESS REG. | 93 | | 0~3FFH (L) / (H) |

VELO. MEMORY AREA (94)

| | | |
|---|---|---|
| 0 | – | VELO. CORRES TO KEY NO. 0 |
| 1 | – | VELO. CORRES TO KEY NO. 1 |
| 2 | – | VELO. CORRES TO KEY NO. 2 |
| 3 | – | VELO. CORRES TO KEY NO. 3 |
| 4 | – | VELO. CORRES TO KEY NO. 4 |
| 5 | – | VELO. CORRES TO KEY NO. 5 |
| 6 | – | VELO. CORRES TO KEY NO. 6 |
| 7 | – | VELO. CORRES TO KEY NO. 7 |
| 8 | – | VELO. CORRES TO KEY NO. 8 |
| 9 | – | VELO. CORRES TO KEY NO. 9 |
| ⋮ | | ⋮ |
| 126 | – | VELO. CORRES TO KEY NO. 126 |
| 127 | – | VELO. CORRES TO KEY NO. 127 |

VELO.: VELOCITY

FIG. 15B

ORIGINAL RECORD

47a

| AD-LIB MOTIF PATTERN NO. | ADDRESS | AD-LIB MOTIF START ADDRESS | |
|---|---|---|---|
| | | HIGH BYTE | LOW BYTE |
| 0 | 000H | 00H | 60H |
| 1 | 002H | 00H | 92H |
| 2 | 004H | 00H | AEH |
| 3 | 006H | 00H | EEH |
| 4 | 008H | 01H | 08H |
| 5 | 00AH | 01H | 32H |
| ⋮ | ⋮ | ⋮ | ⋮ |
| ⋮ | ⋮ | ⋮ | ⋮ |
| 15 | 01EH | 03H | A8H |

MODIFIED RECORD

47a

| AD-LIB MOTIF PATTERN NO. | ADDRESS | AD-LIB MOTIF START ADDRESS | |
|---|---|---|---|
| | | HIGH BYTE | LOW BYTE |
| 0 | 000H | 00H | 60H |
| 1 | 002H | 00H | 92H |
| 2 | 004H | 03H | 86H |
| 3 | 006H | 00H | AEH |
| 4 | 008H | 00H | C8H |
| 5 | 00AH | 00H | F2H |
| ⋮ | ⋮ | ⋮ | ⋮ |
| ⋮ | ⋮ | ⋮ | ⋮ |
| 15 | 01EH | 03H | 68H |

(OFA=OFF UPPER PART)

(OFA=OFF UPPER PART)

(OFA=OFF LOWER PART)

(OFA=ON NORMAL BASS/RHYTHM UPPER PART FIG.12A(d)(e) 12B(d)(e) )

(OFA=ON NORMAL AUTO LOWER PART FIG.12A(d)(e) 12B(d)(e))

(OFA=ON BASS/RHYTHM LOWER FIG.12A(e) 12B(e))

MOTIF PERFORMING APPARATUS

BACKGROUND OF THE INVENTION

1. Field of the Invention

This invention generally relates to an electronic musical instrument, and more particularly, to a motif performing apparatus for automatically performing motifs or motifs. Note, the term "motif" as used herein refers to a basic element which includes several pitches or rhythms, is repeatedly used during a performance of a piece of music, and includes a phrase or period or a plurality of phrases or periods.

2. Description of the Related Art

An electronic musical instrument having an automatic accompaniment function, i.e., automatically providing an accompaniment is widely known. Namely, when performing a piece of music, such an electronic musical instrument first provides an automatical rhythm backing function, then, when an accompaniment key is operated, a chord assigned to the accompaniment key is sounded; a root thereof being connected with the automatic rhythm backing. Note, a chord comprises three or more pitches sounded simultaneously, and a root thereof is a fundamental pitch of the pitches composing a chord. In some cases, chord composing pitches other than the root of a chord may be simultaneously sounded when playing the chord.

Further, there is known another electronic musical instrument in which the rhythm backing is provided by using a keyboard. In this case, each of the instrumental parts (e.g.. drum and cymbals parts) for playing the rhythm backing is assigned to a corresponding key on the keyboard, and in response to a "KEY ON" operation (i.e., an operation of pressing down one of the keys to play a note), the sound of the corresponding instrumental part is generated.

Furthermore, in still another well-known electronic musical instrument which automatically performs melodies, data of melodic patterns is prestored, and when performing a piece of music, the stored data is read out when a switch is pressed to start the automatic performance of the melody, and thereafter, musical tones corresponding to the read data are sequentially generated.

These conventional electronic musical instruments, however, have the drawbacks as described hereinbelow.

First, in the case of the above described electronic musical instrument having the automatic accompaniment function, a chord which includes a root and is assigned to an accompaniment key cannot be changed, and thus whenever the same accompaniment key is operated, only the chord or root assigned to the operated accompaniment key can be played.

In the case of the electronic musical instrument which produces a rhythm backing by using a keyboard, the "KEY ON" operation must be effected each time a sound is to be generated, and thus great skill is required when operating the keys to produce even a basic rhythm backing. Namely, it is not easy to provide the rhythm backing.

In the case of the electronic musical instrument which automatically performs a melody, the performance of the melody is automatically started when a start switch is operated, and thereafter, the player cannot change the preset performance of the melody until that performance is finished.

The present invention is intended to obviate the above described drawbacks of the prior art electronic musical instruments.

Accordingly, an object of the present invention is to provide a motif performing apparatus by which an accompaniment can be changed by only depressing an accompaniment key and a rhythm backing can be easily played, and further, an automatic accompaniment can be effected simultaneously with a player's performance of a piece of music.

SUMMARY OF THE INVENTION

To achieve the foregoing object and in accordance with a first aspect of the present invention, there is provided a motif performing apparatus which comprises a storage means for storing information representing a motif to be played, an instruction means for instructing a radiation of a sound, a reading means for reading the stored information from the storage means while the instruction means is operated, and an output means for outputting the information read by the reading means.

In accordance with a second aspect of the present invention, there is provided a motif performing apparatus which comprises a storage means for storing information representing a motif to be played, an instruction means for instructing a radiation of a sound, a reading means for reading the stored information from the storage means while the instruction means is operated, an output means for outputting the information read by the reading means, an automatic performance means for effecting an automatic performance, and a stop means for stopping the automatic performance if the instruction means is operated while the automatic performance is effected by the automatic performance means.

In accordance with a third aspect of the present invention, there is provided a motif performing apparatus which comprises a storage means for storing a series of pieces of information in which series each piece of information is classified on the basis of a specific concept representing a motif to be played, a plurality of instruction means, each of which instructs a radiation of a sound, a reading means for reading the each classified piece of information in the series of information from the storage means while the instruction means corresponding to each classified piece of information in the series of information is operated, an output means for outputting the information read by the reading means, an automatic performance means for effecting an automatic performance in accordance with the each piece of information in the series of piece of information classified on the basis of a specific concept and a stop means for stopping the automatic performance effected in accordance with each piece of information in the series of information if the instruction means corresponding to each piece of information in the series is operated while the automatic performance is effected in accordance with each piece of information in the series of information by the automatic performance means.

In accordance with a fourth aspect of the present invention, there is provided a motif performing apparatus which comprises a storage means for storing information representing a motif of an accompanimental chord to be played, an instruction means for instructing a radiation of a sound, a reading means for reading the stored information from the storage means while the instruction means is operated, and an output means for outputting the information read by the reading means.

As above described, the motif performing apparatus of the present invention stores the information representing a motif to be played and reads and outputs the information while the instruction means is operated for instructing radiation of a musical sound. Therefore, where the stored information relates to an accompaniment, the accompaniment (e.g., an accompanimental chord or root) changes according to a pattern of a motif represented by the output information, even if the operation of the instruction means is not changed. On the other hand, where the stored information relates to a rhythm to be played, a plurality of sounds automatically and sequentially playing a rhythm backing are generated according to a pattern of a motif as long as the instruction means is operated. Further, where the information relates to a motif used for playing a melody, the melody can be played only while the instruction means is operated. Namely, a player can stop the automatic performance of the melody at any time by stopping the instruction means. Moreover, the motif performing apparatus of the present invention is adapted to simultaneously effect the performances of motifs corresponding to respective instruction means, at their respective paces and independent of one another, and thus, the player's ability to synchronize the performances of the motifs can be improved. Furthermore, the motif performing apparatus of the present invention is able to stop the automatic performance by operating the instruction means during the automatic performance, and thus a simple performance of the motifs can be effected separately from the automatic performance. In addition, the motif performing apparatus of the present invention is able to store information representing motifs of accompanimental chords, and to read and output information representing each of the motifs while the instruction means is operated. Accordingly, if the operation of the instruction means is not changed, the performance of the chords is varied according to the pattern of the output stored information.

BRIEF DESCRIPTION OF THE DRAWINGS

Other features, objects and advantages of the present invention will become apparent from the following description of a preferred embodiment with reference to the drawings, in which like reference characters designate like or corresponding parts throughout several views, and in which FIGS. 1A–20 are diagrams for illustrating the preferred embodiment of the present invention, wherein:

FIGS. 1A–1C are diagrams illustrating ad-lib motif data to be stored according to this embodiment of the present invention;

FIGS. 2A–2C are diagrams illustrating data format of the ad-lib motif data shown in FIGS. 1A–1C;

FIG. 3 is a diagram illustrating the ad-lib motif area table 41;

FIG. 4 is a schematic block diagram showing the entire construction of this embodiment of the present invention;

FIG. 6 is a diagram showing the relationship between tone numbers and timbre numbers;

FIG. 7 is a diagram illustrating time data;

FIG. 8 is a diagram illustrating a rhythm timbre table;

FIG. 9 is a diagram illustrating a function of a key discrimination decoder 45 of this embodiment of the present invention;

FIG. 10 is a diagram illustrating the content of a record buffer 48 and of a ring buffer 49 of this embodiment of the present invention;

FIG. 11 is a diagram illustrating the content of an assignment memory 4 of this embodiment of the present invention;

FIG. 12A is a diagram illustrating modes of operations of this embodiment of the present invention;

FIG. 12B is a diagram illustrating an assignment of a sequence system to a motif used in this embodiment of the present invention;

FIGS. 13A and 13B is a diagram illustrating the content of a working random access memory (RAM) 46 of this embodiment of the present invention;

FIG. 15B is a diagram illustrating an example of an alteration of the content of an ad-lib motif start address list employed in this embodiment of the present invention;

FIG. 16 is a flowchart of a main routine of a processing program executed in this embodiment of the present invention;

FIG. 20 is a flowchart of a program to be executed for setting groups 78 and 79 of rhythm sequence registers.

DESCRIPTION OF THE PREFERRED EMBODIMENT

Figure 4:
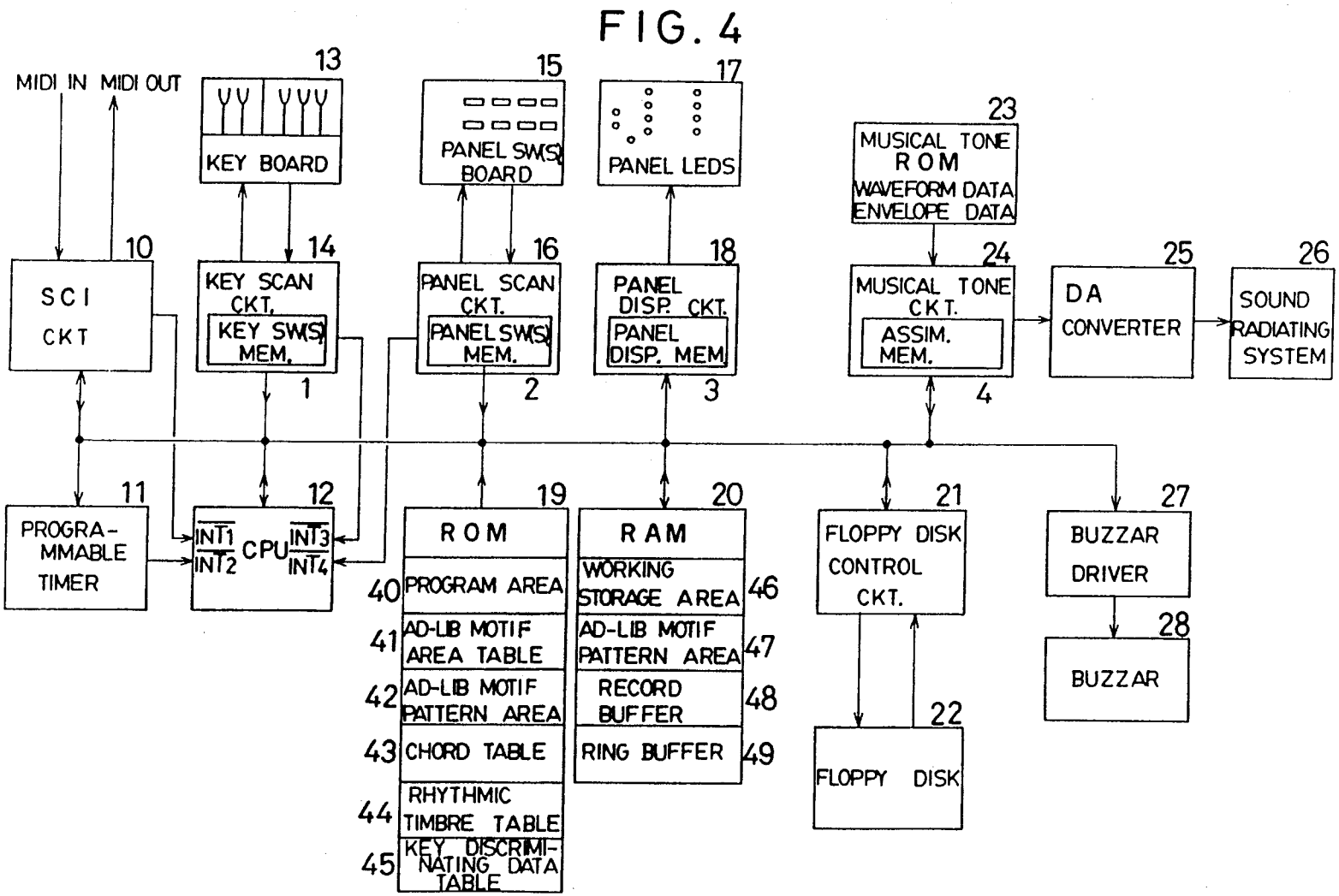

Hereinafter, the preferred embodiment of the present invention will be described in detail, with reference to the accompanying drawings.

Referring first to FIG. 1C, ad-lib motif patterns numbered from 1 to 16 (or from 0 to 15) are assigned to keys of a keyboard 13, respectively. These ad-lib motif patterns represent ad-lib motifs used to play melodies (hereunder referred to as ad-lib melody motifs) in a meter (i.e., a rhythmic pattern) having sixteen beats per measure (hereunder referred to as a "16-beat meter"). Further, this embodiment employs other kinds of ad-lib motifs used to play accompanimental chords and rhythms (hereunder referred to as ad-lib chord motifs and ad-lib rhythm motifs) in the 16-beat meter, and still other kinds of ad-lib motifs used to play such accompanimental melodies, chords and rhythms in other meters. FIGS. 2A, 2B, and 2C show examples of data formats of data representing ad-lib melody motifs, ad-lib rhythm motifs, and ad-lib chord motifs, respectively. As illustrated in FIGS. 17D, 17E, 17F, and 17H, each sequence processing (MACRO1–MACRO3) of motifs of a melody 1, melody 2, bass, rhythm 1 and rhythm 2 is performed in response to a KEY ON operation, independently of each other. Thereafter, this sequence processing is effected in response to periodic interruptions as long as the KEY ON operation is effected, as illustrated in FIGS. 18A–18D.

Accordingly as stated above, where the stored information relates to an accompaniment, the accompaniment (e.g., the accompanimental chord or root) changes according to a pattern of a motif represented by the stored information, even if the operation of the instruction means is not changed. Further, where the stored information relates to a rhythm to be played, a plurality of sounds used to automatically and sequentially play the rhythm are generated according to a pattern of a motif as long as the instruction means is operated. Furthermore, where the stored information relates to a motif used for playing a melody, the melody can be automatically played only while the instruction means is operated, and in addition, the player can stop the automatic performance of the melody at any time by stopping the instruction means. Moreover, the motif performing apparatus of the present invention is able to simultaneously effect the performances of motifs corresponding to respective instruction means at their respective paces, independently of each other, and consequently, a player's ability to synchronize the performances of the motifs can be improved.

Figure 17A:
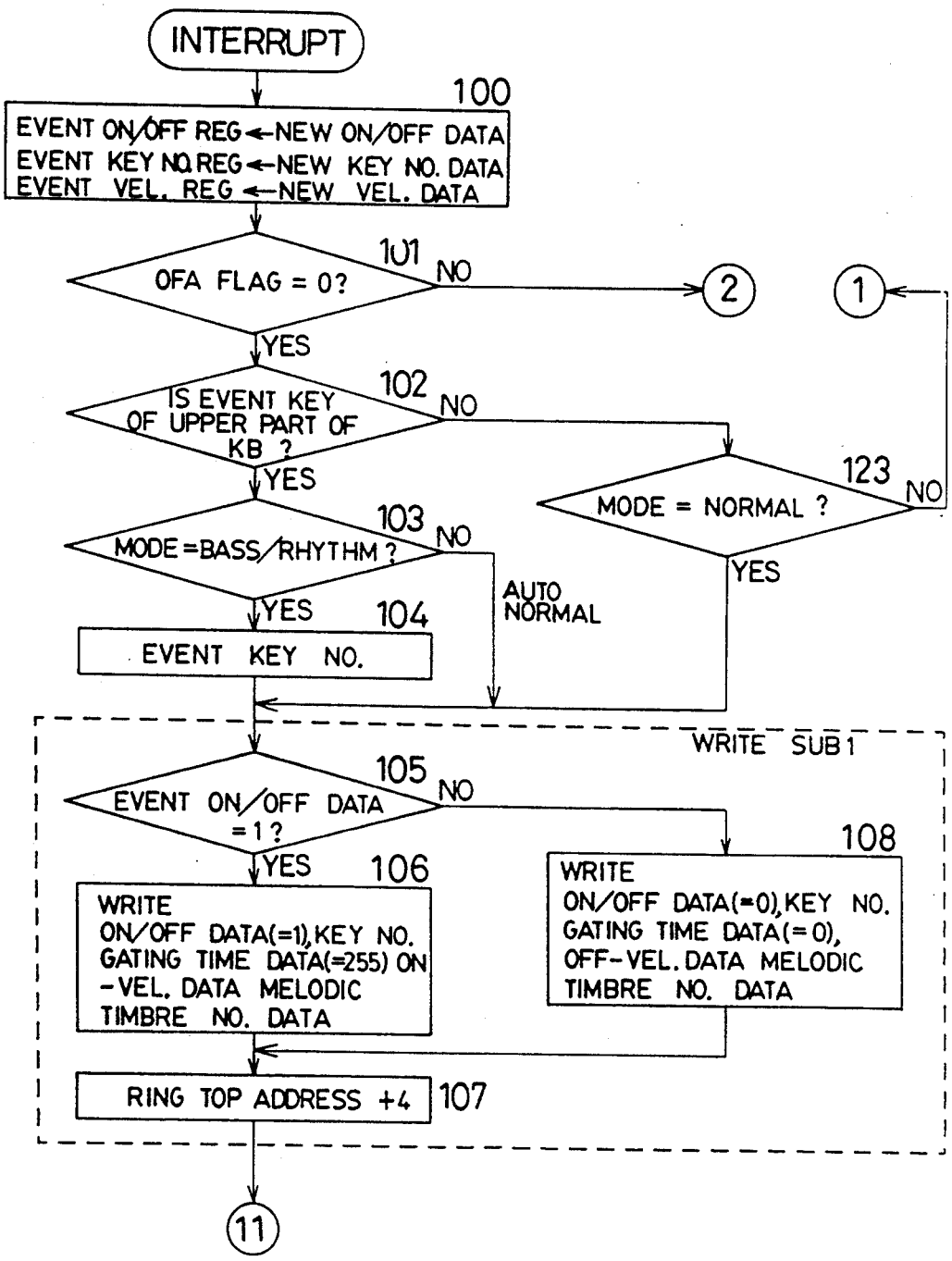
FIG. 17A–17H are flowcharts of processing programs executed when a "KEY EVENT" occurs, namely, when a KEY ON operation or a "KEY OFF" operation (i.e., an operation of releasing a key) is effected, in this embodiment of the present invention.
Figure 17B:
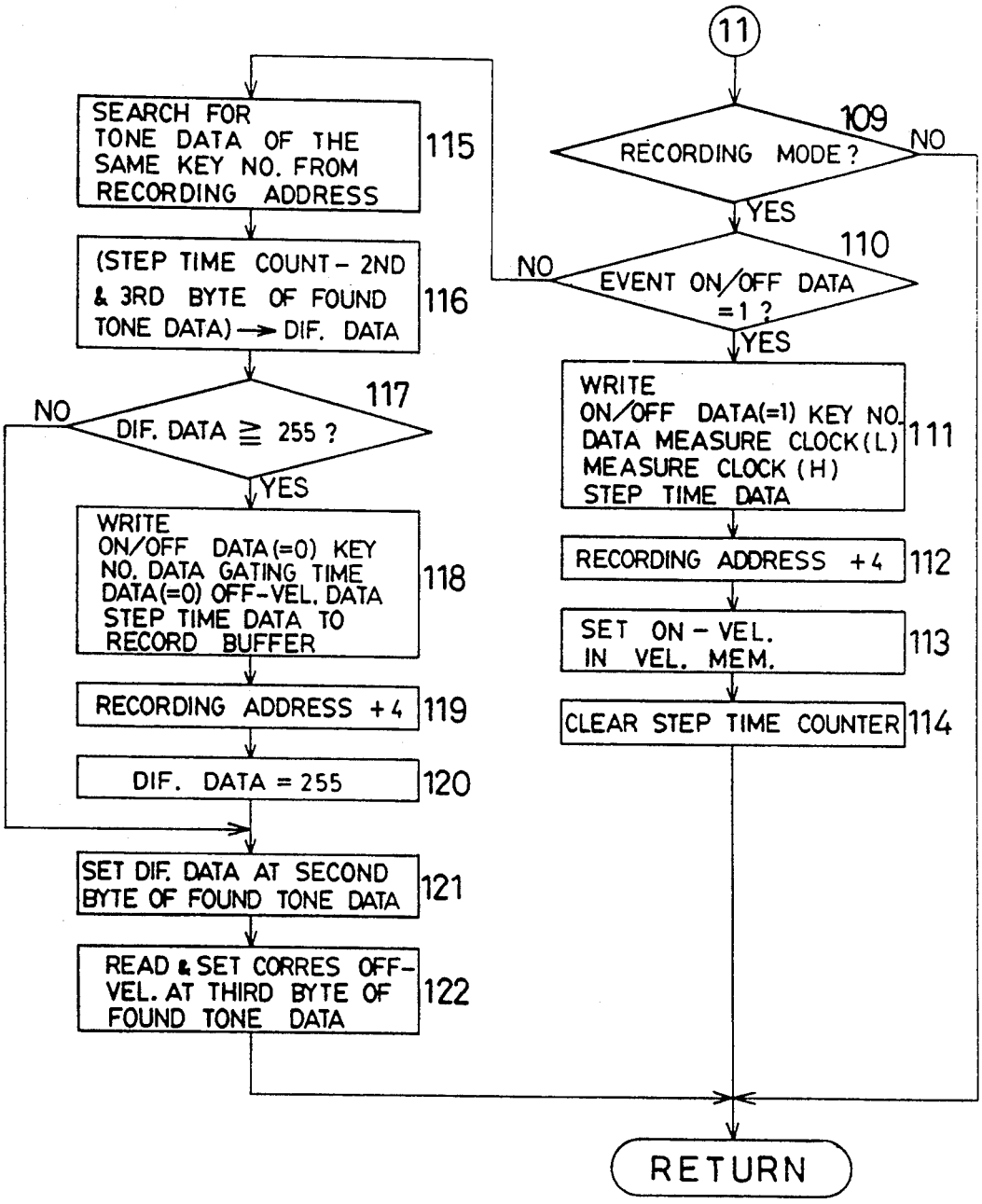
Figure 17C:
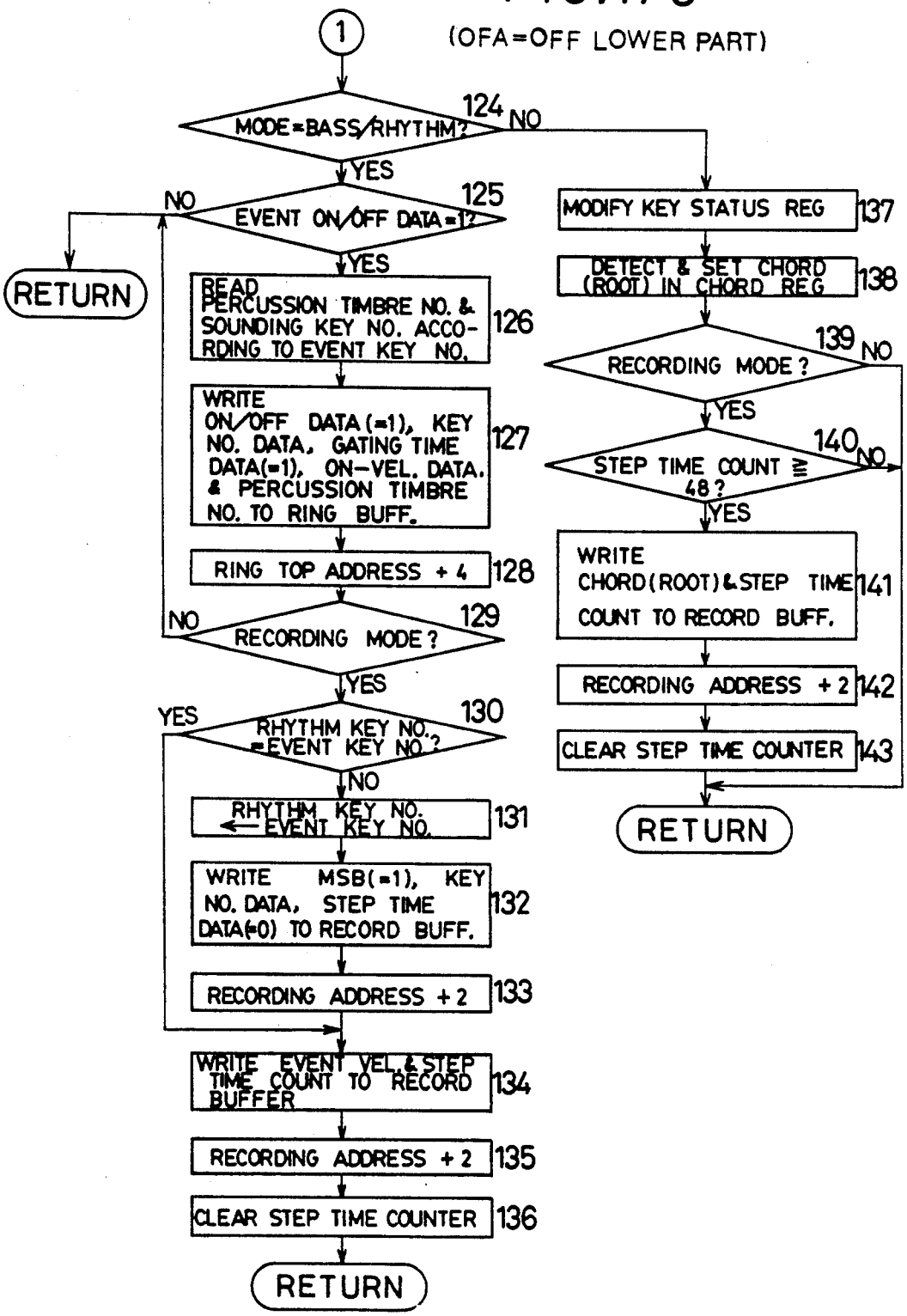
Figure 17D:
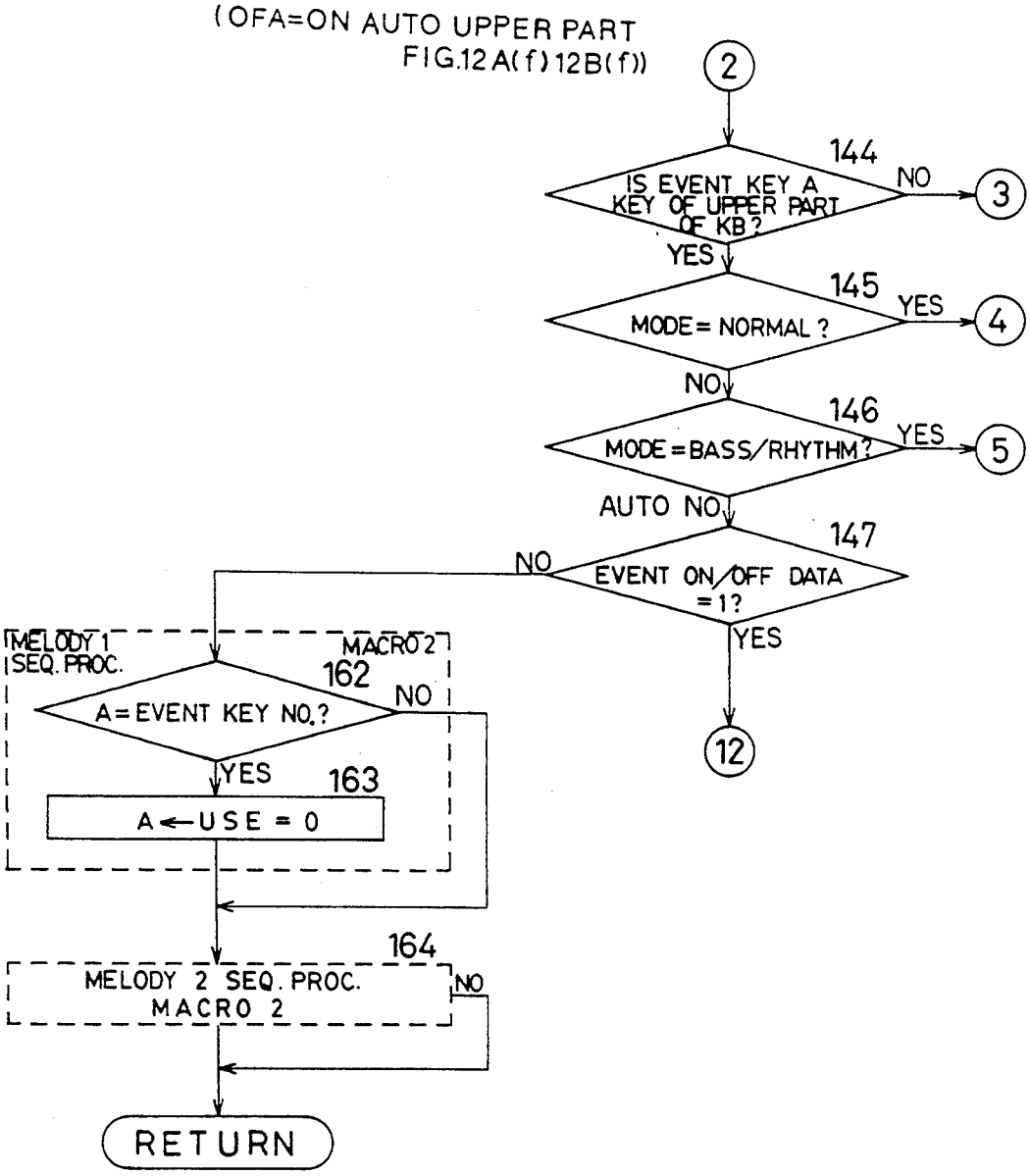
Figure 17E:
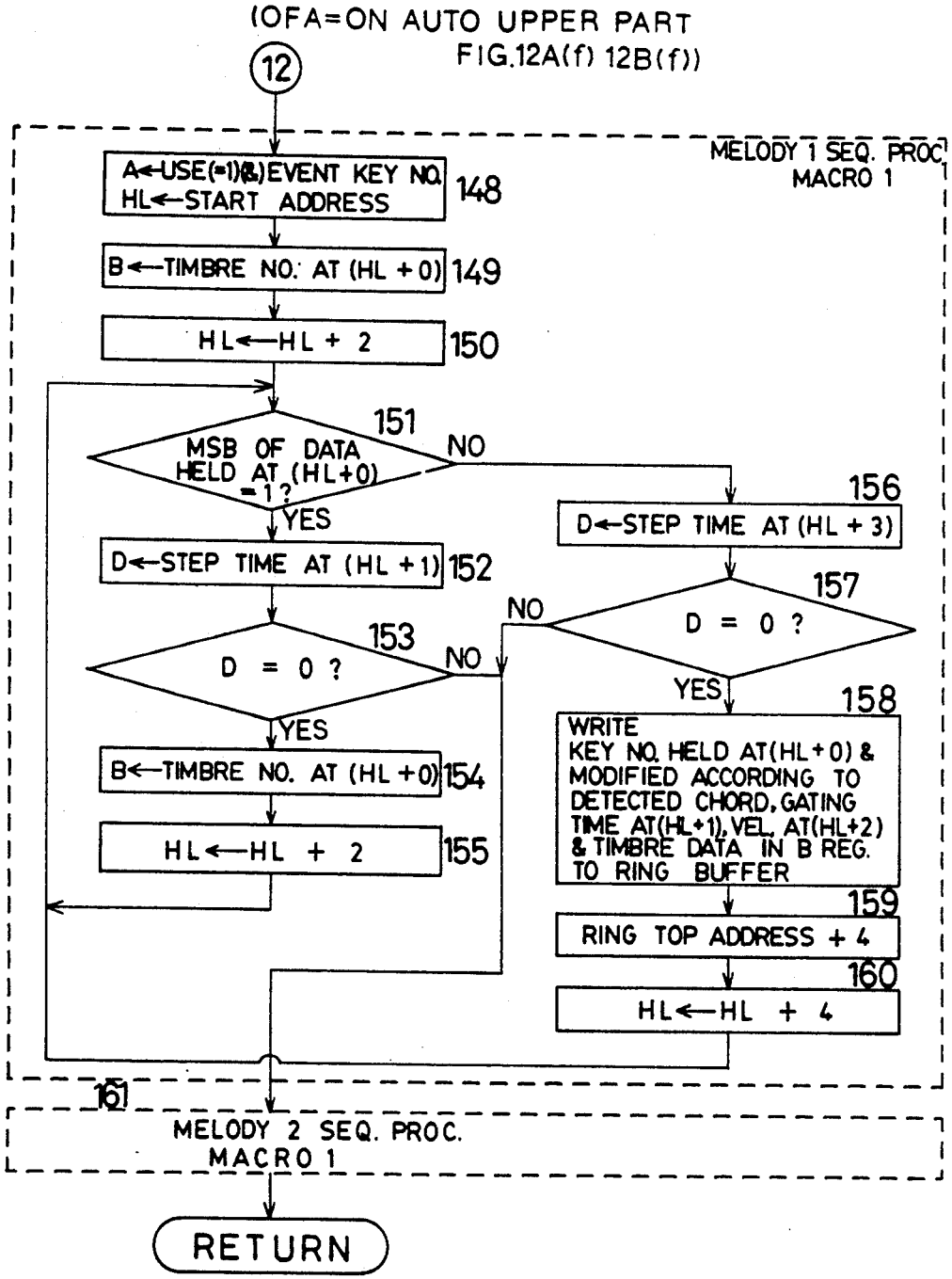
Figure 17F:
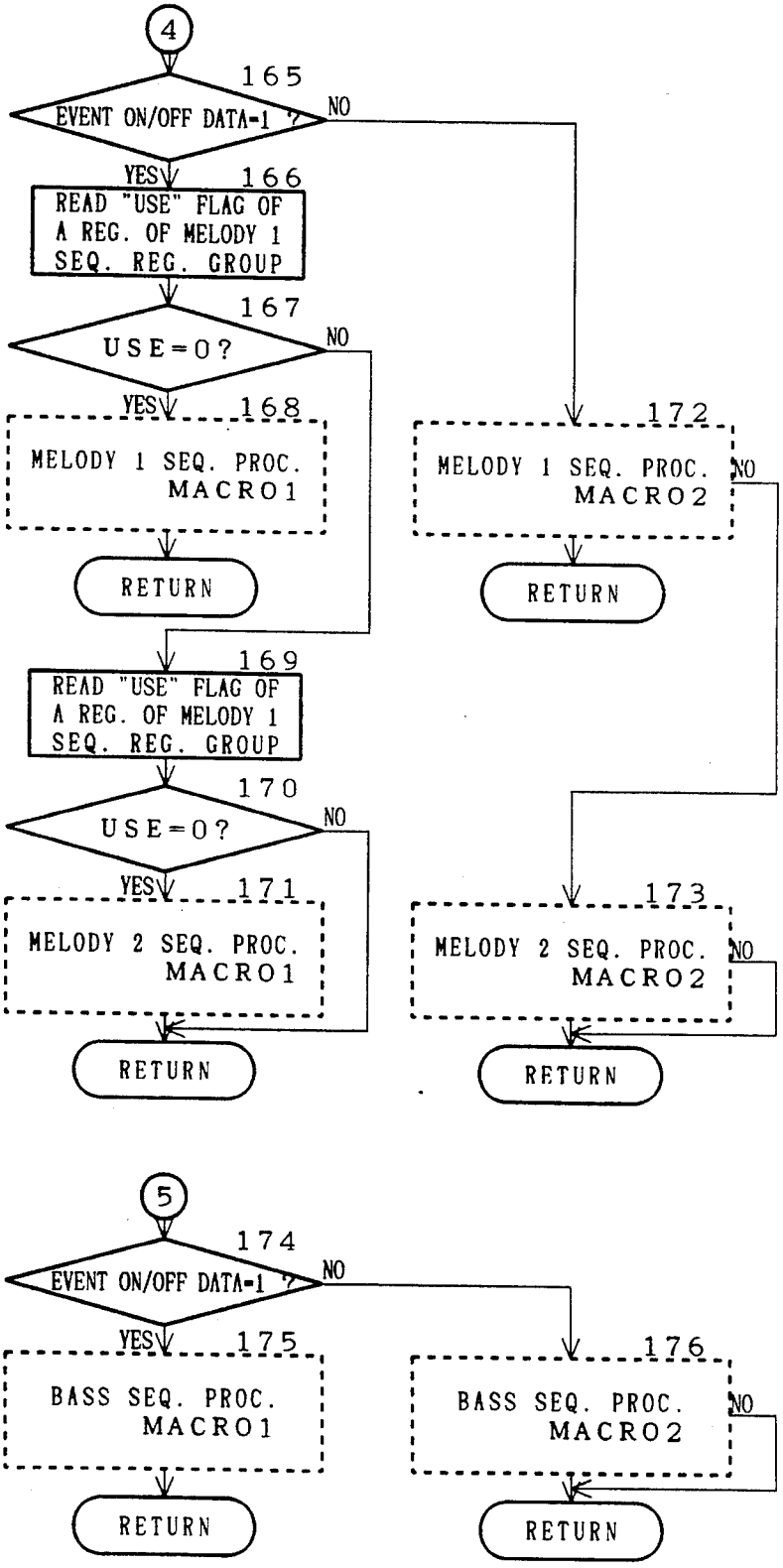
Figure 17G:
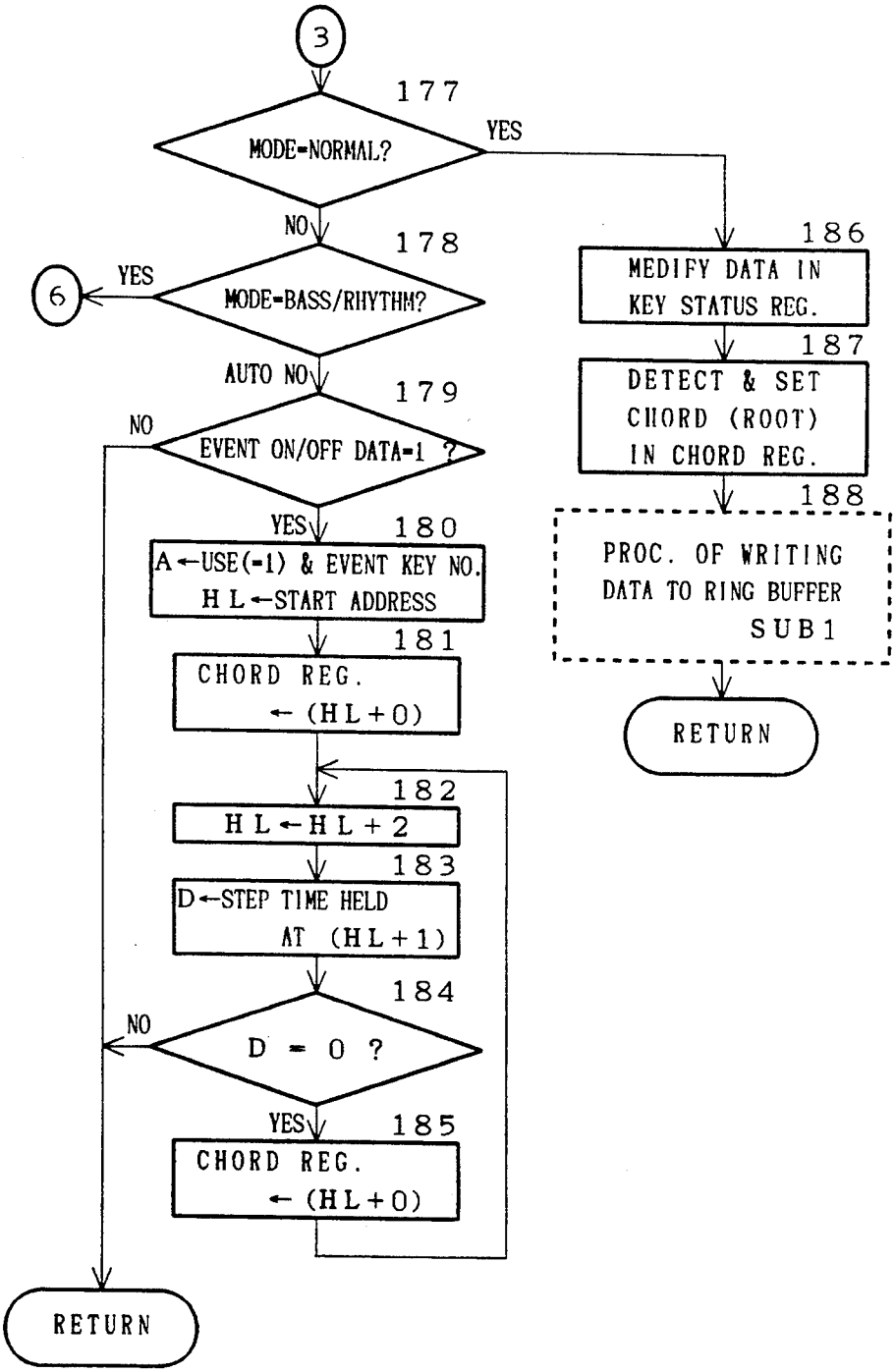
Figure 17H:
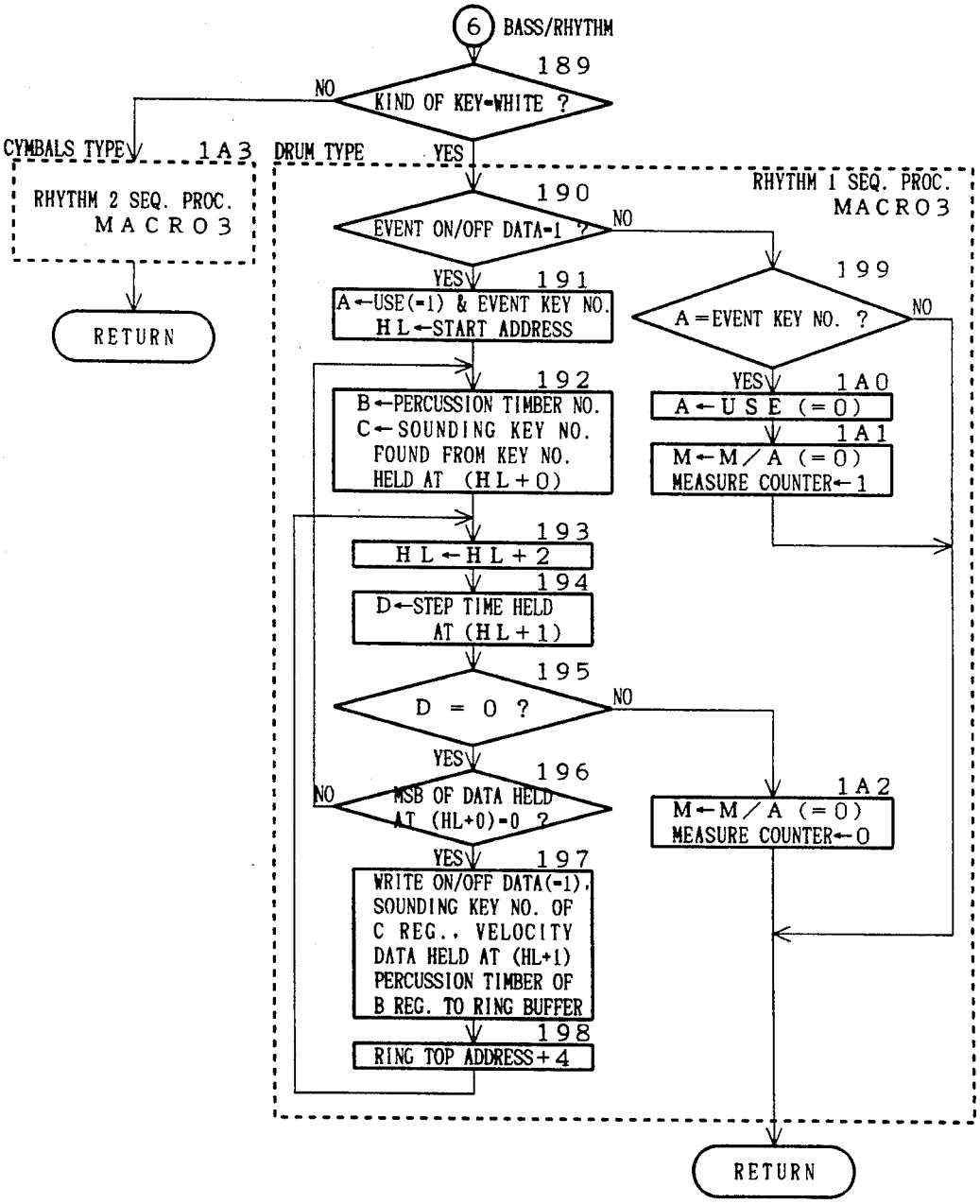

Further, as described above, the motif performing apparatus of the present invention is able to stop the automatic performance by operating the instruction means during the automatic performance. For example, as illustrated in FIG. 17H, the sequence of the performing of the motif of the rhythm 1 to be played on the drum or of the rhythm 2 to be played on the cymbals is commenced when a KEY ON operation is effected. At that time, groups 78 and 79 of sequence registers, which have been used for an automatic performance of a motif, are used for the sequence performing of the motif of the rhythm 1 or 2, and thus the automatic performance of the previous motif is stopped. If a KEY OFF operation is performed, the automatic performance of the previous motif is resumed at steps 246-250 (see FIGS. 18C and 18D) when a time corresponding to a measure or a bar has elapsed after the KEY OFF operation is effected. Therefore, where a player wishes to perform a motif at a certain time during an automatic performance of another motif, a simple performance of the former motif can be effected by suspending the automatic performance of the latter motif.

In addition, as above-mentioned, the motif performing apparatus of the present invention is able to store information representing motifs of accompanimental chords, and to read and output the information representing each of the motifs while the instruction means is operated. For example, as illustrated at step 179 of FIG. 17G, if a USE flag, which will be described later, is not cleared from a group of chord sequence registers 84, the motif performing apparatus continues to perform the sequence processing of an ad-lib motif chord by executing a subroutine MACRO6 of FIGS. 18C and 18D. Subsequently, as illustrated at steps 425 and 429 in FIG. 19B, the sequence processing of the ad-lib motif chord is stopped by changing a mode.

Thus, even if the operation of the instruction means is unchanged, the accompaniment (e.g., the accompanimental chord or root) is varied according to a pattern of the stored output information.

1. DATA FORMAT OF AD-LIB MOTIF DATA STORED IN AD-LIB MOTIF PATTERN AREA 42

FIG. 1A shows a data format of ad-lib motif data stored in an ad-lib motif pattern area 42 of a read-only memory (ROM) 19. The ad-lib motif data stored in this ad-lib motif pattern area 42 is transferred to and stored in an ad-lib motif pattern area 47 of a writable random access memory (RAM) 20. Here, an ad-lib motif represented by the ad-lib motif data corresponds to the motif of the rhythm 1 to be played in a 16-beat meter and is stored at addresses 000H–3FFH (hereunder, the character H added to a number indicates that the number is a hexadecimal number) of the ROM 19.

As shown in FIG. 1A, an area having addresses 000H–01FH and another area having addresses 020H–05FH of the ROM 19 are respectively used as an ad-lib motif start address area and an ad-lib motif assignment area, which will be described later. Further, ad-lib motif data (hereunder sometimes referred to as ad-lib motif pattern data) of a pattern 0 of an ad-lib motif is stored at addresses 060H–091H and ad-lib motif data of a pattern 1 is stored at addresses 092H–0ADH of the ROM 19. Similarly, ad-lib motif data of patterns 2, 3—are respectively stored at addresses 0AEH–0EDH, 0EEH–107H—of the ROM 19. Finally, ad-lib motif data of a pattern 15 is stored at addresses 3A8H–3C5H. Note, an area having addresses 3C6H–3FFH is empty. Namely, in this embodiment, the ad-lib motif data corresponding to the motif of the rhythm 1 to be played in a 16-beat meter is composed of 16 kinds of ad-lib motif pattern data.

2. AD-LIB MOTIF START ADDRESS LIST

The content of the data stored in the ad-lib motif start address area **42*a* (42*b*) having addresses 000H–01FH are shown in FIG. 1B. In this area are stored the above described leading addresses of the areas in which the ad-lib motif data of the patterns 0–15 are stored. Note, a storage region corresponding to two addresses in the ad-lib motif start address area 42*a*** is required to store each of the leading addresses.

3. AD-LIB MOTIF ASSIGNMENT LIST

The ad-lib motif assignment area **42*b* (47*b*) having addresses 020H–05FH is used to store pattern Nos. of ad-lib motifs assigned to keys of a keyboard 13. The content of data stored in the ad-lib motif assignment area are shown in FIG. 1C**.

Meter data is stored at a location named "MEASURE CLOCK NUMBER" and having an address 020H. Note, the term "measure clock number" means the number of clock pulses per measure. As illustrated in FIG. 7, the measure clock number corresponding to the meter $\frac{1}{4}$ (i.e., the number of clock pulses corresponding to a quarter note) is set as 48. Usually, the measure clock number is determined according to a meter in which a motif is played.

Further, at each of locations named "AUTOMATIC ARPEGGIO", "AUTOMATIC BASS", "FIRST AUTOMATIC RHYTHM" (to be played on the drum) and "SECOND AUTOMATIC RHYTHM" (to be played on the cymbals), automatic motif pattern data (hereunder sometimes referred to as automatic motif data) is stored. The performance of the ad-lib motif represented by each of these ad-lib motif pattern data is started when a start/stop switch 38 is turned on. Note, data stored at a location named "RHYTHM DELAY" indicates a delay time between a moment at which the performance of a motif represented by the ad-lib motif pattern data named "FIRST AUTOMATIC RHYTHM" is started, and another moment at which the performance of a motif represented by the ad-lib motif pattern data named "SECOND AUTOMATIC RHYTHM" is started. Note, data representing motifs of melodies and chords, and so on, may be also stored as automatic motif data.

Furthermore, pattern Nos. of ad-lib motifs assigned to the keys of the keyboard 13 are stored at locations "KEY No. 24" to "KEY No. 72". These pattern Nos. denote the kinds of the ad-lib motifs (i.e., the patterns 0–15) shown in FIG. 1A. Further, the KEY Nos. 24–72 indicate the keys of the keyboard 13 as illustrated in FIG. 5B. Particularly, keys indicated by KEY Nos. 24–43 compose a lower part 13*b* of the keyboard 13; and keys indicated by KEY Nos. 44–72 an upper part 13*a* of the keyboard 13. Note, the pattern Nos. of the ad-lib motifs assigned to keys of a fixed area of the keyboard 13 are fixed, and thus cannot be changed. In contrast, the pattern Nos. of the ad-lib motifs assigned to keys of an assignable area of the keyboard 13 are not fixed, and thus can be changed.

4. AD-LIB MOTIF AREA INDICATING TABLE 41

FIG. 3 shows the content of an ad-lib motif area indicating table 41, in which the start addresses of the storage areas storing the ad-lib motifs are stored. As illustrated in FIG. 3, this embodiment employs five kinds of ad-lib motifs, i.e., ad-lib motifs of a first melody, a second melody, a bass, a rhythm, and a chord. Further, ad-lib motif data representing each of these ad-lib motifs is generated for each of rhythm backing modes of playing these ad-lib motifs. As shown in FIG. 3, this embodiment employs sixteen rhythm backing modes, e.g., a 16 beat mode, a disco mode, a bossa nova mode,—, a waltz mode, and thus, 80 ($=5\times16$) kinds of ad-lib motif data are stored in the ad-lib motif area indicating table 41. Note, as illustrated in FIG. 1A, one kind of ad-lib motif data is composed of 16 kinds of ad-lib motif pattern data, and accordingly, 1280 ($80\times16$) kinds of ad-lib motif pattern data are stored in the ROM 19.

Furthermore, as illustrated in FIGS. 12A and 12B, one kind of ad-lib motif is selected from the five kinds of ad-lib motifs, by using an operating keyboard in each operating mode.

In addition, all of the 1280 kinds of ad-lib motif pattern data are transferred, together with the ad-lib motif start address list and the ad-lib motif assignment list of the writable RAM 20 when the power is turned on, and thus, it is possible to change the content of the ad-lib motif data and the pattern Nos. of the ad-lib motifs assigned to the keys of the assignable area of the keyboard 13.

5. PRACTICAL DATA FORMATS OF AD-LIB MOTIF DATA

FIGS. 2A, 2B and 2C show practical data formats of the ad-lib motif data. Namely, FIG. 2A show data formats of the ad-lib motif data representing the ad-lib motifs of the first melody (hereunder referred to as the first melody motif data), the data representing the ad-lib motifs of the second melody (hereunder referred to as the second melody motif data), and the data representing the ad-lib motifs of the bass (hereunder referred to as the bass motif data); FIG. 2B shows data format of the ad-lib motif data representing the ad-lib motif of the rhythm (hereunder referred to as the rhythm motif data); and FIG. 2C data format of the ad-lib motif data representing the ad-lib motif of the chord (hereunder referred to as the chord motif data).

Each of the first melody motif data, the second melody motif data, and the bass motif data of FIG. 2A is made up of a plurality of note data according to a pattern of a motif to be performed. As shown in FIG. 2A, at a leading address and at an address corresponding to a moment at which a timbre currently employed to play a melodic motif is changed, timbre data representing a timbre employed for playing the motif is stored. Further, the tone data includes key No. data, gating time data, velocity data, and step time data. The timbre data is composed of both data representing a timbre No. of a timbre employed for playing a melodic motif and data representing a step time.

The key No. data is used to indicate each key of the keyboard 13 and corresponds to a pitch of a sound generated by depressing the indicated key. Further, the gating time data represents a gating time, which is defined as a time between a moment at which a KEY ON operation is effected (i.e., a key is depressed) and another moment at which a KEY OFF operation is effected (i.e., the depressed key is released). The velocity data represents a speed of operating a key of the keyboard 13 or an operating pressure applied to the key. The step time data represents a step time, which is defined as a time between a moment at which a KEY ON operation of depressing a key corresponding to a note is effected (or at which a timbre is changed) and another moment at which a KEY ON operation of a key corresponding to the next note to be played is effected.

The timbre No. data represents a timbre employed to play a melodic motif. Note, in this embodiment, 32 kinds of timbres are used. For example, if the timbre used to play the motiff is that of a string type instrument, the timbre data is OOH, and if the timbre of a brass type instrument is used, the timbre date is 04H. As illustrated in FIG. 2A, the step time data stored at an address 01 corresponding to the timbre data stored at the leading address is 00000000, and thus the timbre represented by the timbre data stored at the leading address is set immediately after the performance of an ad-lib motif is commenced. Further, the step time data stored at an address corresponding to a moment, at which a timbre is changed, designates a time between a moment when a KEY ON operation of depressing a key corresponding to a note to be played just prior to the note, which is played in the changed tone color, is effected (or a moment when the timbre data is changed) and the moment at which the timbre is changed.

As shown in FIG. 2A, repeat data is stored in an end portion of the storage area in which the first or second melody motif data or the bass motif data is stored. The repeat data indicates a command that the processing of the data stored at the leading address should be performed again. Therefore, when the repeat data is read, the patterns of the ad-lib motifs represented by the ad-lib motif data shown in FIG. 2A are repeatedly performed as long as a KEY ON operation i.e., depressing keys, is effected. Further, as illustrated in FIG. 2A, the repeat data is made up of command data 111111 and step time data. This step time data represents a step time, i.e., a time between a moment when a KEY ON operation of depressing a key corresponding to a note to be played immediately prior to a first note of a first motif represented by the motif data stored in the area of FIG. 2A is effected (or a moment when the timbre data is changed) and the moment at which the repetition of the motif is commenced. Usually, this step time is a time corresponding to measures or bars of which the number is a positive integer.

The rhythmic motif data of FIG. 2B is made up of a plurality of beat data according to a rhythm motif or pattern. As shown in this figure, timbre daily representing a timbre employed for playing the rhythmic motif is stored at a leading address and at an address corresponding to a moment at which a timbre currently employed to play a melodic motif is changed. Each beat data is comprised of both velocity data and step time data, and the timbre data consists of both lower key No. data and step time data.

The lower key No. data represents the key Nos. 24–43, as illustrated in FIG. 5B, and thus the lower key No. data does not directly indicate percussion timbre Nos. representing timbres (hereunder sometimes referred to as percussion timbres) of percussion instruments (e.g., a bass drum and "hi-hat" cymbals). The lower key No. data, however, is decoded or translated into data representing the percussion timbre Nos. by using a percussion timbre table 44 stored in the ROM 19 shown in FIG. 8, and at that time, sounding key No. data is also decoded.

As shown in FIG. 6, the timbres of drum type percussion instruments are represented by the percussion timbre No. data 00H–3CH and on the other hand, those of cymbal type percussion instruments are represented by the percussion timbre No. data greater than 40H. Further, the timbres of drum type percussion instruments are assigned to lower keys (i.e., "white" keys) of the keyboard 13, and those of cymbal type percussion instruments are assigned to upper keys (i.e., "black" keys) of the keyboard 13, and thus the timbres of the percussion instruments can be changed according to the colors (i.e., white and black) of the keys. Note, the timbres of the percussion instruments may be assigned to the keys in another suitable manner.

The sounding key No. data is used to change a pitch (i.e., a sounding frequency) employed to play a rhythm motif. Further, key Nos. 121–127 are used as the sounding key No. data, and these key Nos. exceed the key Nos. of the lower and upper parts of the keyboard 13 of FIG. 5B. All of seven kinds of the sounding frequencies corresponding to the key Nos. 121–127, however, are entirely different from and independent of a frequency extrapolated from frequencies corresponding to the keys of the lower and upper parts of the keyboard 13. Accordingly, a quantity of information on the timber can be reduced by assigning the same percussion timbre No. to, for example, three tom-toms (i.e., a low frequency, intermediate frequency, and high freqeuncy tom-tom) but assigning different sounding Nos. to the three tom-toms. Note, different percussion timbre Nos. may be assigned to the three tom-toms, or example, three key Nos. of the lower part of the keyboard 13, which are represented by the lower key No. data of FIG. 2B, may be assigned to the tom-toms as the percussion timbre Nos..

The composing elements of the beat data (i.e., the velocity data and the step data) and the other composing element of the timbre data (i.e., the step data) are similar to the corresponding elements of the ad-lib motif data of FIG. 2A. FIG. 9 shows the content of a key discriminating data table 45 of the ROM 19. The discrimination between the white keys and the black keys, and between the keys of the lower part of the keyboard 13 and those of the upper part thereof, is effected on the basis of bit patterns of key discriminating data output from a storage area storing the table 45 of the ROM 19, corresponding to the key Nos. 24–72.

Figure 18A:
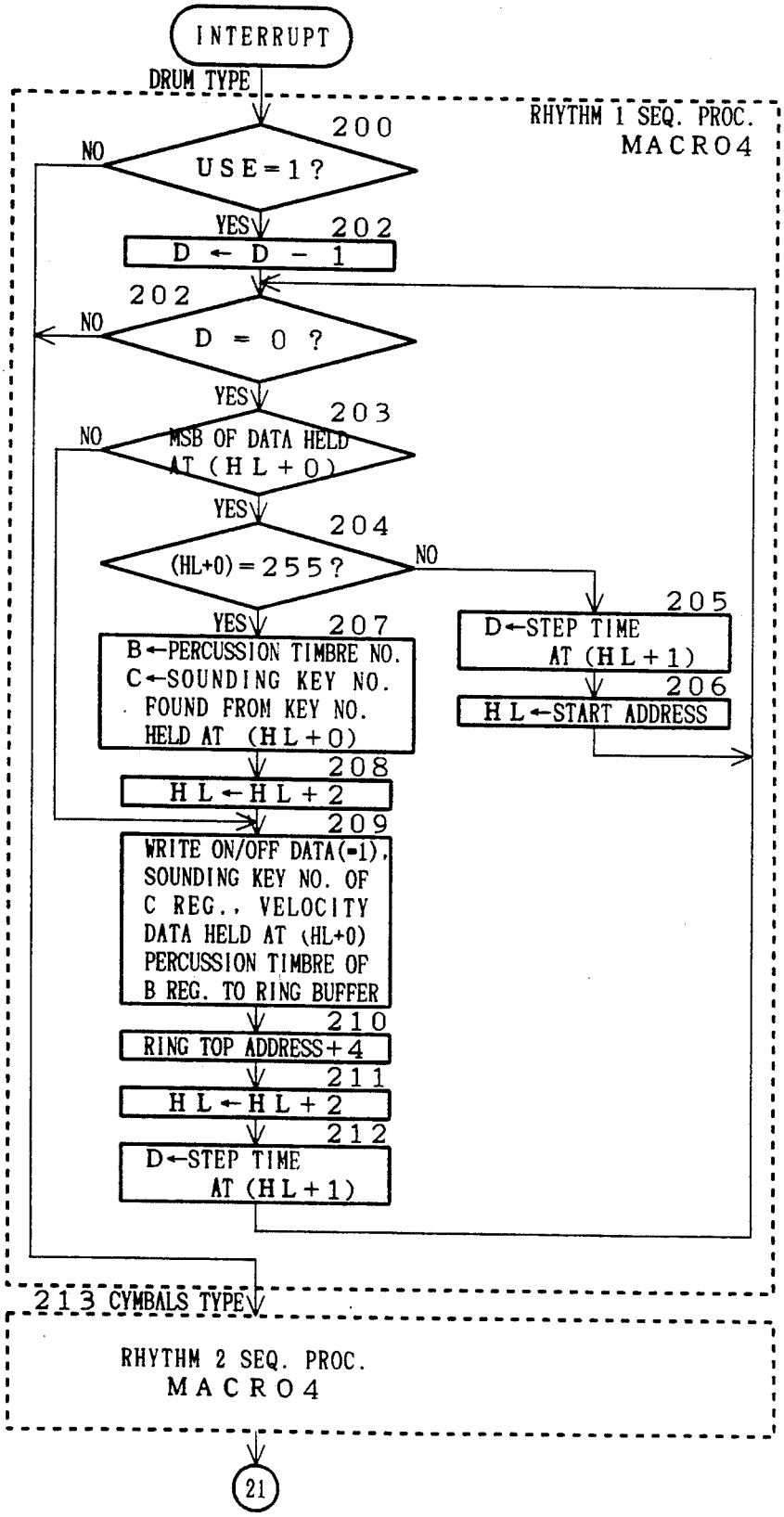
FIGS. 18A–18D are flowcharts of a processing program to be executed for performing an interrupt each time an interrupt signal INT2 is output in this embodiment of the present invention.
Figure 18B:
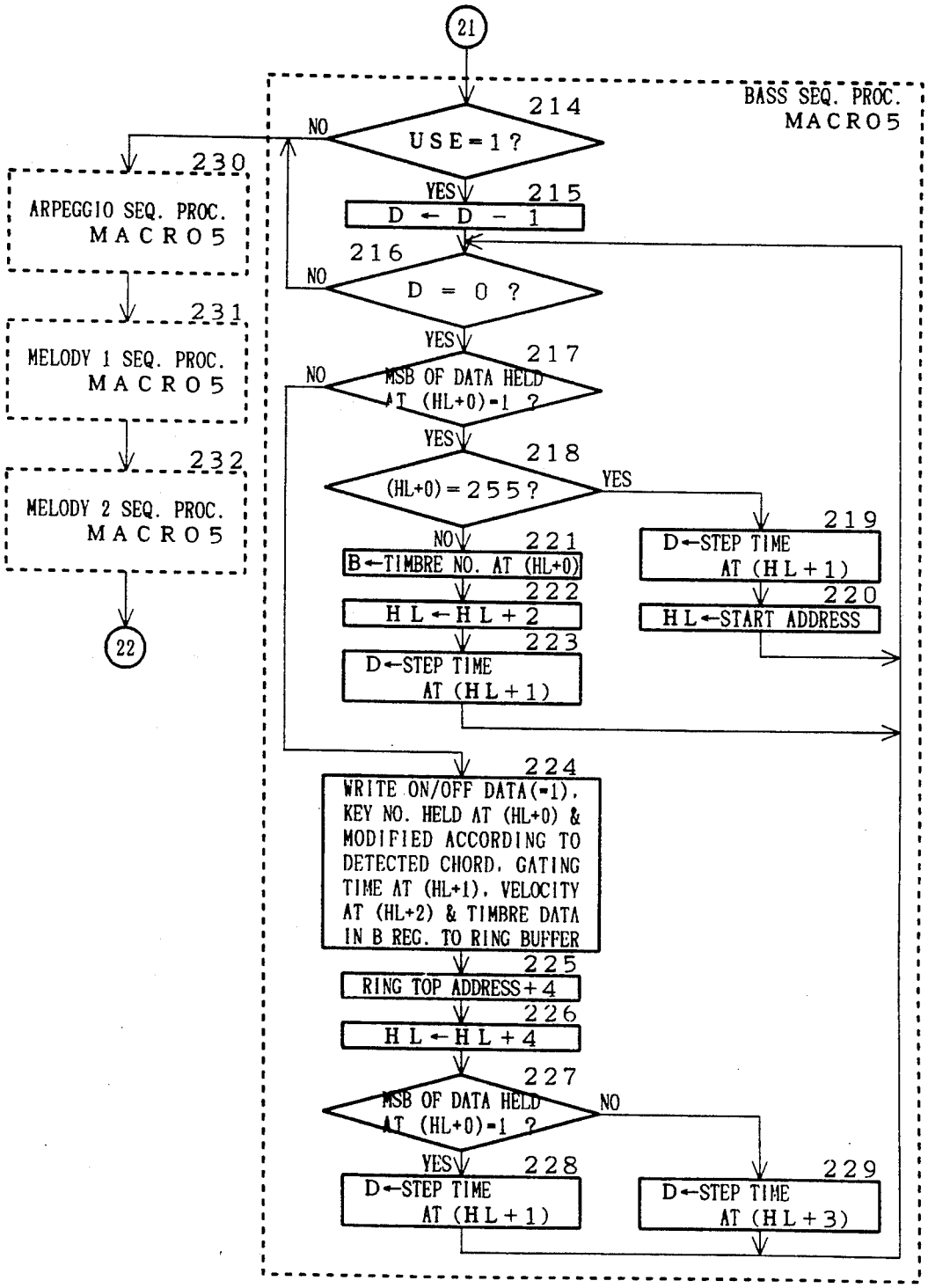
Figure 18C:
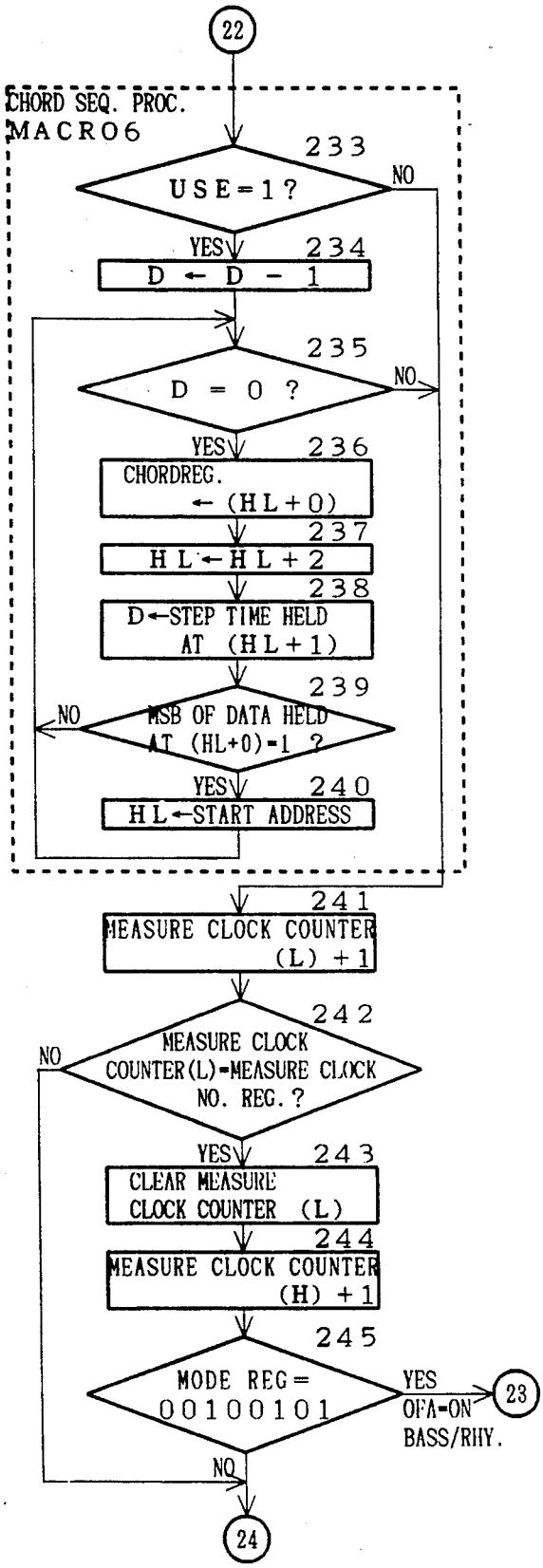
Figure 18D:
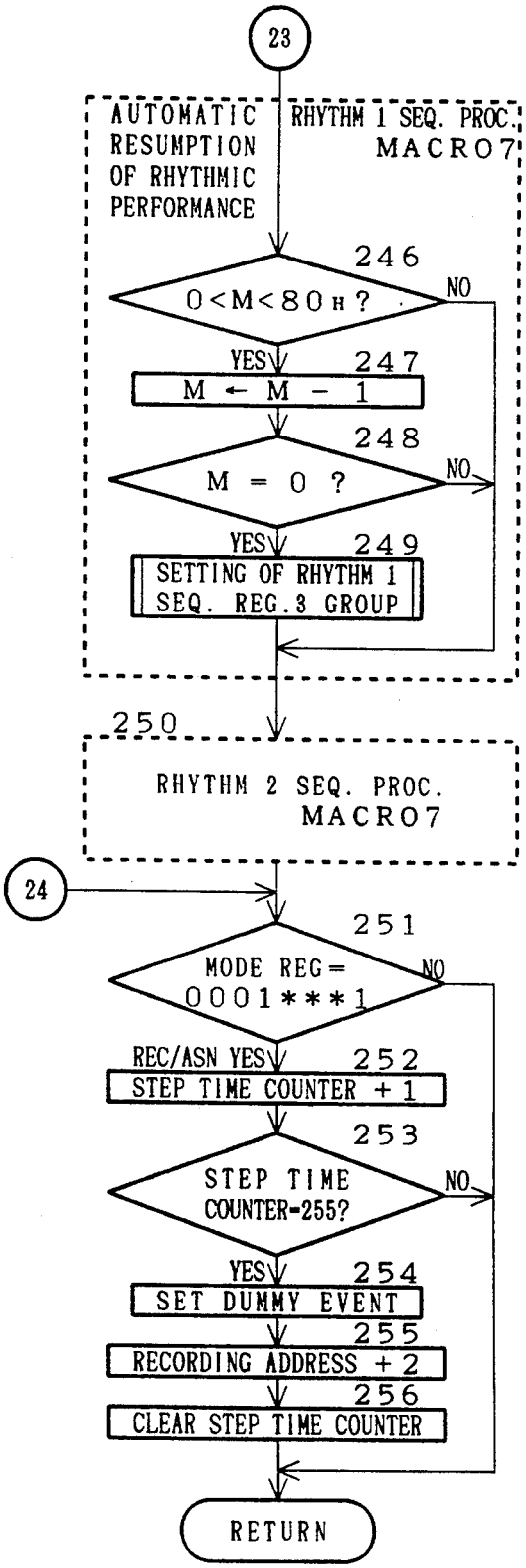

Note that gating time is not included in the thythm motif data, but in this embodiment, when gating time data is set in the buffer 49 at step 197 of FIG. 17H, step 209 of FIG. 18A or step 507 of FIG. 20 as will be described later, the gating time data is set equal to 1. In addition, a value other than 1 may be set as the gating time data.

The chord motif data of FIG. 2C comprises a plurality of chord data of chord patterns. Further, each chord data is composed of both data representing chord composing pitches, which include a root, or an accompanimental chord and step time data. Moreover, key Nos. corresponding to musical sounds to be actually radiated are output according to a chord table 43 stored in the ROM 19 of FIG. 4. Note, accompaniment chords corresponding to key Nos. of actually operated keys can be output by searching the chord table 43.

The step time data composing the chord motif data is similar to that of the ad-lib motif data of FIG. 2A.

The data formats of the ad-lib motif data are not limited to those of FIGS. 2A, 2B and 2C, and other kinds of musical tone data representing a volume of sounds and representing effects may be added to the above described content of the ad-lib motif data . Conversely, the velocity data of FIGS. 2A and 2B may be omitted, and instead, a velocity corresponding to a key currently depressed may be used. Further, the timbre data of FIGS. 2A and 2B may be omitted, and instead, timbre data selected by using timbre switches 33 . . . may be set in the assignment memory 4 when playing the motifs. Furthermore, tone No. data obtained by mixing the timbre data and the velocity data of FIGS. 2A and 2B may be stored. In addition, gating time data may be added to the ad-lib motif data of FIG. 2B, and moreover, timbre data, tone No. data, velocity data, and gating time data may be added to the chord motif data of FIG. 2C. Conversely, the data representing a root may be omitted from the chord motif data of FIG. 2C, and instead, the root may be determined on the basis of a pitch of an operated key of the upper part of the keyboard 13*a*. Further, the repeat data of FIG. 2A may be omitted.

6. ENTIRE CIRCUIT OF MOTIF PERFORMING APPARATUS

FIG. 4 shows the construction of the entire circuit of this embodiment of the present invention. The data set by operating the keys of the keyboard 13 is scanned by a key scanning circuit 14, and further, is stored in a key switch memory. Similarly, the data set by operating switches of the panel switchboard 15 is scanned by a panel scanning circuit 16 and is stored in a panel switch memory 2. The data stored in the panel switch memory 2 is transferred to a panel display memory 3 after processed by a central processing unit (CPU) 12, and then each light emitting diode (LED) lamp of a panel LED lamp group 17 is made on or off in accordance with the content of the transferred data. 6-1. USUAL PERFORMANCE MODE During a usual performance, a key No. of an operated key of the keyboard 13 is once written to the ring buffer 49 by the CPU 12, and thereafter, the key No. is written to an assignment memory 4 of a musical tone generating circuit 24, and thus an assignment of channel is effected. At that time, the velocity data representing an operationg speed or an operating pressure of operating a key of the keyboard 13, as well as the timbre data representing the timbres selected by operating the panel switchboard 15 to play a melodic motif or a rhythm motif, is written to the ring buffer 49. Furhter, tone Nos. are determined according to the velocity data and the timbre data and are written to the assignment memory 4.

More particularly, the tone Nos. are determined according to a tone No. list of FIG. 6. Namely, tone No. data representing the tone No. is obtained by adding two high order bits of the velocity data to the right side of a rightmost end of the timbre data, which is 6 bits in length, for playing a melodic or rhythmic motif as two low order bits of the tone No. data. Accordingly, if the timbre data is unchanged, the tone No. varies according to the velocity data, which has four levels 00, 01, 10 and 11.

Note, the tone No. data may be generated by adding two high order bits of the key No. data to the right side of a rightmost end of the timbre data as two low order bits of the tone No. data, to thereby implement a key splitting function. In addition, the tone No. data may be generated by adding two bits of 2bit data, which is obtained from the velocity data or the key No. data by using a transition ROM, to the right side of a rightmost end of the timbre data as two order bits of the tone No. data. FIG. 10 shows the content of the ring buffer 49. Namely, note data is written to the ring buffer 49 in the order of operated keys corresponding to the note data, as illustrated in this figure. This note data is made up of key No. data, gating time data, velocity data and timbre data, which are similar to corresponding data shown in FIGS. 2A and 6. In this case, however, the note data relating to a KEY ON operation is separated from that relating to a KEY OFF operation. If the gating time data is 11 . . . 1 (=positive 255 decimal), the gating time data represents a command that a KEY ON operation of a note should be effected, and if the gating time data is 00 . . . 0(=0), the gating time data represents a command that a KEY OFF operation of a note should be effected. In contrast, if the gating time data takes a value in the range of from 1 to 254 decimal, the gating time data represents the length of time between a moment at which a KEY ON operation of a note is performed and another moment at which a KEY OFF operation of the note is performed. A 1-bit ON/OFF data is added to the left side of a leftmost end of the key No. data, as illustrated in FIG. 10. When the ON/OFF data is 1 , the ON/OFF data indicates that the note data relates to a KEY ON operation, and when the ON/OFF data is 0, the ON/OFF data indicates that the note data relates to a KEY OFF operation.

A maximum of sixteen musical tones can be written to the assignment memory 4, as illustrated in FIG. 11, and thus a 16-channel musical tone generating system is constructed. Waveform data, as well as envelope data, is read from a ROM 23, and thereafter, is transferred via a digital-to-analog (DA) converter 25 to a sound radiating system 26, which radiates musical sounds represented by the transferred data. In this case, the waveform data is read from the ROM 23 at a speed determined by a corresponding key No.

The ON/OFF data, the key No. data, the gating time data, the envelope data, the velocity data, and the tone No. data are stored in each channel area of the assignment memory 4. Further, at addresses at which the gating time data and the envelope data are stored, the gating time data is stored from a moment at which a KEY ON operation of a musical note is effected to another moment at which a KEY OFF operation of the musical note is effected. In contrast, the data representing levels of the envelope is set thereat after the KEY OFF operation of the musical note is effected. Note, the ON/OFF data, the key No. data, the velocity data, and the tone No. data are similar to the corresponding data described above.

6-2. ONE FINGER AD-LIB (OFA) MODE

In an OFA mode, i.e., in a mode in which an automatic performance of an ad-lib motif assigned to each of the keys of the keyboard 13 by operating the keys is effected, data representing a key No. of an operated key of the keyboard 13 is written to the assignment memory 4 of the musical tone generating circuit 24 after the ad-lib motif data assigned to each of the keys is read by the CPU 12 from the ad-lib motif pattern area 47 of the RAM 20 and is once written to the ring buffer 49, and thereafter, the assignment of the channels is performed. This ad-lib motif data represents a relatively short performance pattern composed of a combination of a plurality of musical tone data corresponding to a sequence of pitches to be continuously and successively played. Further, the ad-lib motif includes one or more phrases (or periods).

At that time, the tone No. is determined on the basis of the velocity data and the timbre No. data (corresponding to the key Nos. of the lower part of the keyboard 13) of the ad-lib motif data written to the ring buffer 49, and then the determined tone No. is written to the assignment memory 4. The chord data representing the accompaniment chord (including a root thereof) is supplied to the chord table 43 of the ROM 19. Thereafter, key Nos. of keys corresponding to musical sounds to be actually radiated are read therefrom. Note, after being written once to the ring buffer 49, the key Nos. are written to the assignment memory 4.

6-3. AD-LIB MOTIF RECORDING MODE

In an ad-lib motif recording mode, a key No. corresponding to an operated key of the keyboard 13, a velocity, and a timbre No. of a timbre which is employed for playing a melodic motif and corresponds to a selected timbre switch 33 of the panel switchboard 15, are sequentially written by the CPU 12 to a record buffer 48 of the RAM 20. Thereafter, the key No., the velocity, and the timbre No. are further written to the ab-lib motif pattern area 47 of the RAM 20 as the ad-lib motif data assigned to an indicated key of the keyboard 13. The record buffer 48 has the same structure as the ring buffer 49 illustrated in FIG. 10.

At that time, for a chord accompaniment, a key No. corresponding to a key of the keyboard 13 which is operated to indicate an accompanimental chord is supplied to the chord table 43 of the ROM 19, and further, the chord data corresponding to the indicated accompanimental chord is read and recorded. Also, for a rhythmic accompaniment, a key No. of an operated key of the lower part of the keyboard 13 is recorded with nothing changed.

Similarly, as in the usual performance mode, the key No. data, the chord data, and so on are once written to the ring buffer 49 and then written to the assignment memory 4, and thereafter, corresponding musical sounds are generated and radiated in this ad-lib motif recording mode.

Furthermore, a serial communication interface (SCI) circuit 10 interfaces with an external electronic musical instrument and transfers tone data which conforms to the MIDI (Musical Instrument Digital Interface) specification to the external electronic musical instrument musical. The musical tone data input to this SCI circuit 10 can be used in any of the usual performance mode, the OFA mode, and the ad-lib motif recording mode.

Additionally, where new musical tone data is input to the SCI circuit 10, where new musical tone data is input from the keyboard 13 to a key-and-switch (KS) memory 1, and where new timbre No. data of a timbre employed to play a melodic motif, as well as new mode data, is input from the panel switch board 15 to a panel switch memory 2, interrupt signals INT1, INT3, and INT4 are input to the CPU 12, and thus a usual performance, an automatic performance of an ad-lib motif, and a recording of an ad-lib motif are effected according to the new musical tone data, the new timbre data, and the new mode data.

Further, an interrupt signal INT2 is input from a programmable timer 11 to the CPU 12. This programmable timer 11 stores data corresponding to a preset tempo. Further, the interrupt signals INT2 are input to the CPU at regular time intervals, and consequently, a performance of the ad-lib motif, as well as a clock-pulse counting operation corresponding to the gating time data and the step time data, are effected.

In addition to the ad-lib motif data, various data is stored in the RAM 20, and various processing programs to be executed by the CPU 12, as well as various data used to execute the programs, are stored in the ROM 19. More particularly, the ROM 19 is provided with the ad-lib motif area 41, the ad-lib motif pattern area 42, the chord table 43, the percussion timbre table 44, and the key discriminating data table 45, in addition to a program area 40. Further, the RAM 20 is provided with the ad-lib motif pattern area 47, the record buffer 48, and the ring buffer 49, in addition to a working storage area 46.

Note, the data stored in the RAM 20, such as the ad-lib motif data, is saved in and loaded from a floppy-disk 22 via a floppy-disk control circuit 21. Further, a buzzer 28 is driven and sounded by the CPU 12 via a buzzer driver 27. This buzzer 28 performs the same function as a metronome, and is sounded at regular time intervals corresponding to the tempo.

7. PANEL SWITCHBOARD 15

Figure 5A:
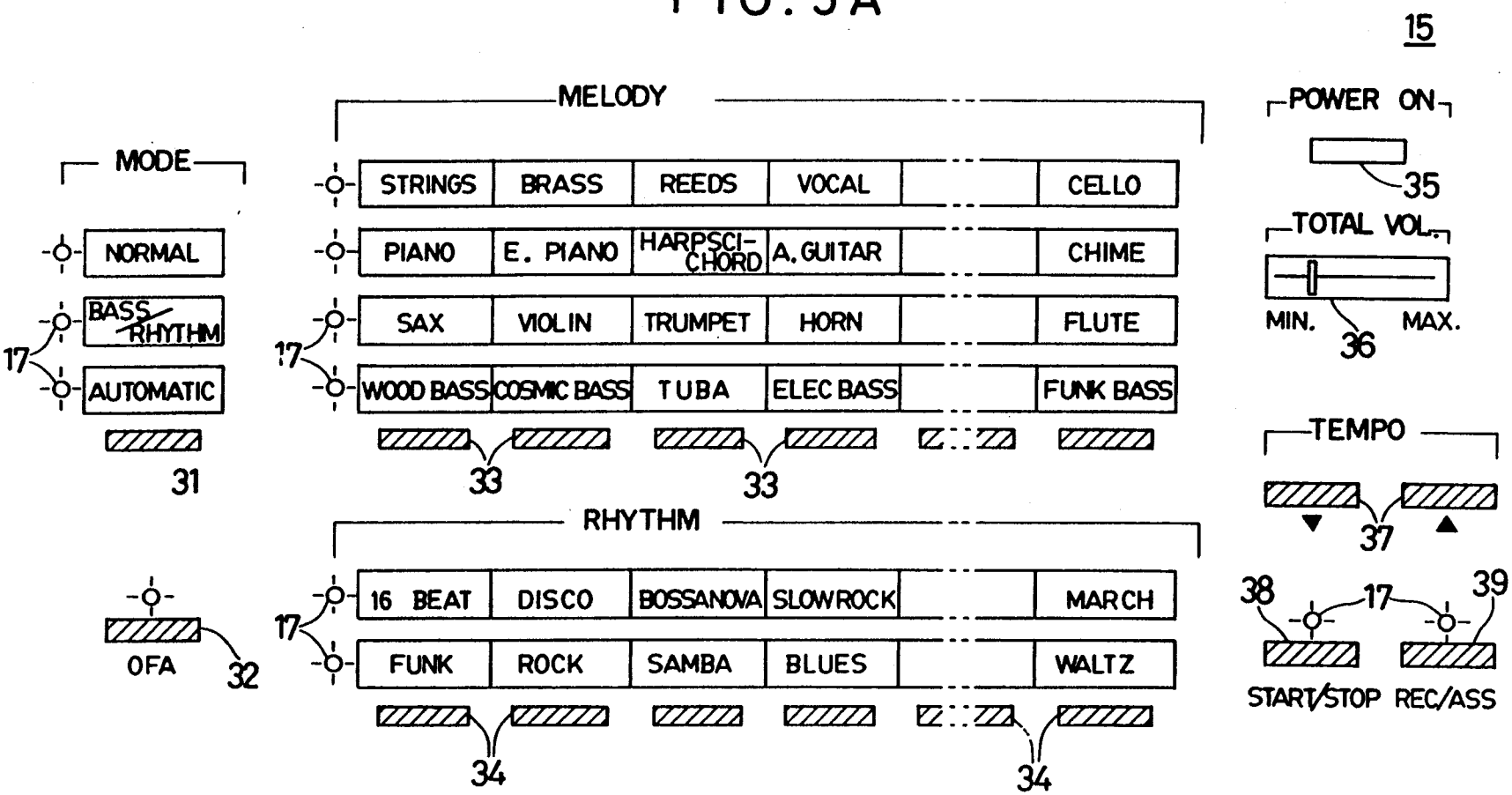
FIG. 5A is a diagram illustrating a panel switchboard 15 of this embodiment of the present invention.
Figure 5B:
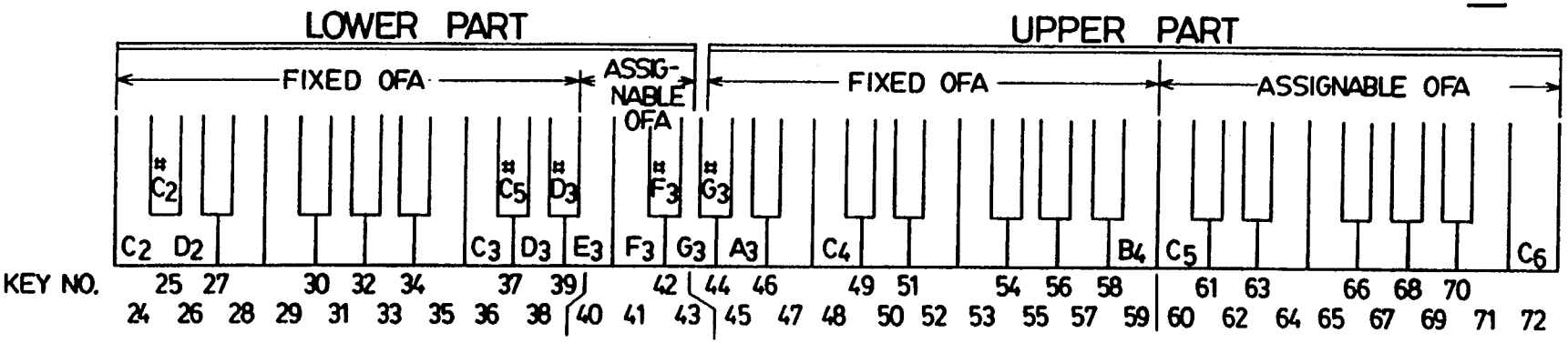
FIG. 5B is a diagram showing a keyboard 13 of this embodiment of the present invention.

FIG. 5A shows an arrangement of the switches of the panel switchboard 15. First, a mode switch 31 is used to switch a performance mode among a normal performance mode (NORMAL), a bass/rhythm performance mode (BASS/RHYTHM), and an automatic performance mode (AUTOMATIC) by a ring shift (i.e., a cyclic shift). In the normal performance mode (NORMAL), a melodic motif is played on the keyboard 13 as leftwardly and upwardly indicated in FIG. 12A. In the bass/rhythm performance mode (BASS/RHYTHM), a bass motif is performed by operating the keys of the upper part 13*a* of the keyboard 13 and a rhythm motif is played by operating the keys of the lower part 13*b* of the keyboard 13. In the automatic performance mode (AUTOMATIC), a melodic motif is performed by operating the keys of the upper part 13*a* of the keyboard 13; an accompaniment chord is detected by operating the keys of the lower part 13*b* of the keyboard 13 but the corresponding musical sounds are not radiated.

An OFA switch 32 is used to indicate the OFA mode in which ad-lib motifs assigned in the keys of the keyboard 13 are played by operating those keys.

When the mode switch 31 is set to NORMAL in this OFA mode, a melodic motif assigned to each key of the upper part 13*a* is automatically performed. On the other hand, the usual performance of a melody is effected by operating the keys of the lower part 13*b*, as indicated in FIG. 12A(*d*). In this case, two kinds of melodic motifs can be automatically performed in parallel with one another by simultaneously depressing two keys of the upper part 13*a*. Further, a chord which includes a root thereof and corresponds to an operated key of the lower part 13*b* is detected, to thereby modify a scale employed and play an ad-lib melodic motif using a known shifting technique.

When the mode switch 31 is set to BASS/RHYTHM in this OFA mode, an ad-lib bass motif assigned to each key of the upper part 13*a* is automatically performed. On the other hand, an ad-lib rhythmic motif assigned to each key of the lower part 13*b* is automatically performed, as indicated in FIG. 12A(*e*). Further, a rhythm motif to be played on a drum is played by operating white keys of the lower part 13*b*, and another rhythm motif to be played on cymbals is played by operating black keys thereof. In this case, a scale employed to play an ad-lib bass motif by operating the keys of the upper part 13 *a* is modified on the basis of the chord data stored in a chord register, before entering this OFA mode, using the known shifting technique.

When the mode switch 31 is set to AUTOMATIC in this OFA mode, a melodic motif assigned to each key of the upper part 13*a* is automatically performed. On the other hand, an ad-lib chord motif assigned to each key of the lower part 13*b* is automatically selected and corresponding musical tones are not radiated, as indicated in FIG. 12A(*f*). In this case, two kinds of ad-lib melodic motifs, i.e., first and second ad-lib melodic motifs, can be automatically performed in parallel with one another by depressing a key of the upper part 13*a*. Further, a scale employed to play an ad-lib melodic motif by operating the keys of the upper part 13*a* is modified on the basis of an ad-lib chord motif corresponding to a detected key of the lower part 13*b*, using the known shifting technique.

A recording/assignment (REC/ASS) switch 39 is used to set a recording/assignment mode. Namely, the REC/ASS switch 39 is used to record data relating to a performance effected by using the keyboard 13 and MIDI data as ad-lib motif pattern data and to assign ad-lib motifs of various patterns to the keys of the assignable area of the keyboard 13, or to locations such as "AUTOMATIC ARPEGGIO" for storing automatic motif data of FIG. 1C. Musical tone data is to be stored as ad-lib motif pattern data is first melodic motif data in the case of the normal performance mode (g), bass motif and a rhythm motif data in the case of the bass/rhythm performance mode (h) and second melodic motif data and chord motif data in the case of the automatic performance mode, as leftwardly and downwardly illustrated in FIG. 12A.

Figure 15A:
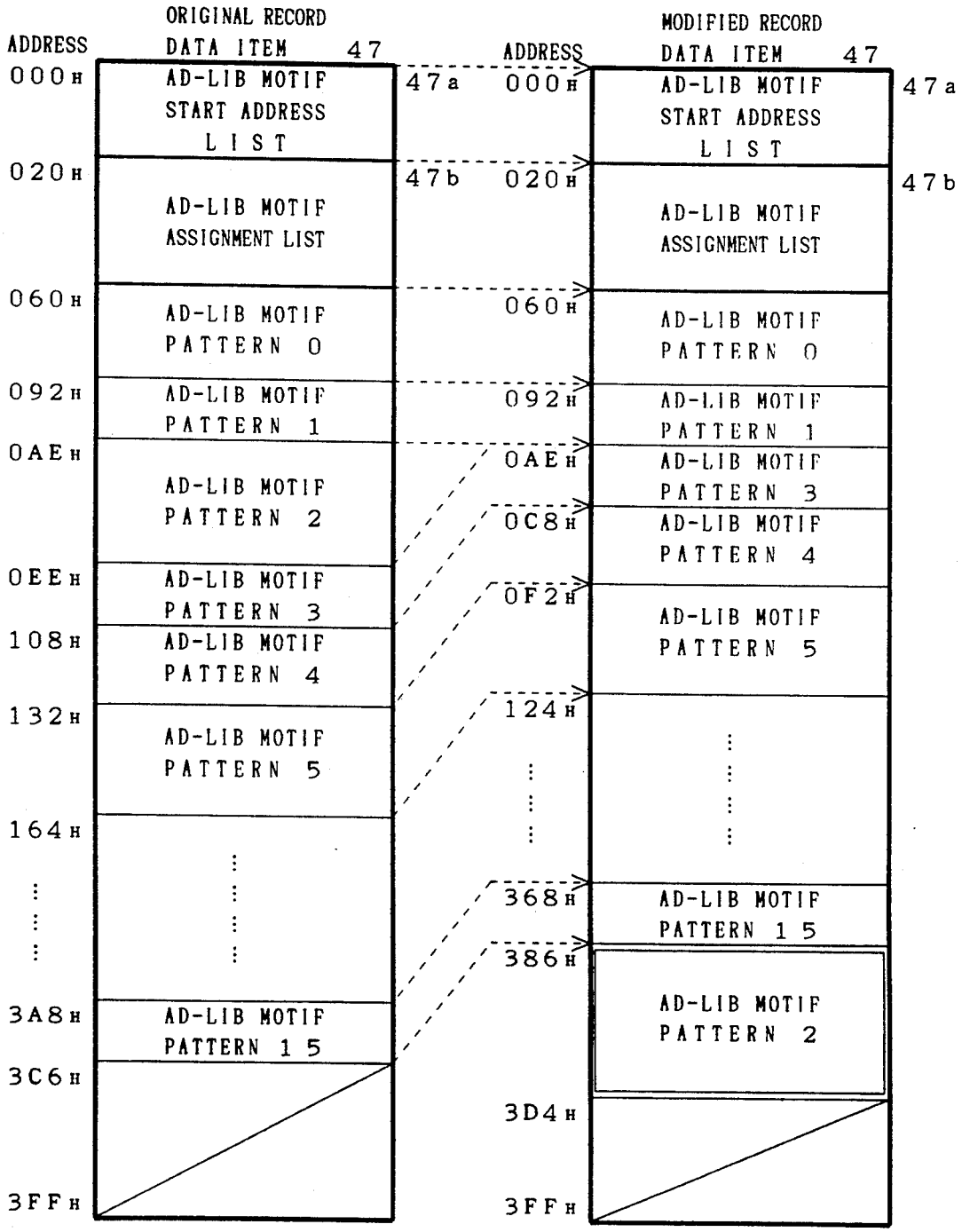
FIG. 15A is a diagram illustrating an example of an alteration of the content of an ad-lib motif pattern area employed in this embodiment of the present invention.

FIGS. 15A and 15B illustrate an operation of recording new ad-lib motif pattern data on the ad-lib motif pattern data, i.e., modifying the content of the ad-lib motif pattern area and the content of the ad-lib motif start address list. When new ad-lib motif pattern data is written to the ad-lib motif pattern area as data indicating an ad-lib motif of a pattern 2, old data indicating an ad-lib motif of a pattern 2 is first deleted, and then data indicating ad-lib motifs of a pattern 3, . . . and data indicating ad-lib motifs of a pattern 15 are shifted upwardly in the ad-lib motif pattern area, as shown in FIG. 15A. Finally, new data indicating an ad-lib motif of a pattern 2 is written at locations immediately succeeding to a storage region in which the data indicating ad-lib motifs of the pattern 15 is stored, and accordingly, the data stored in the ad-lib motif start address area is changed as illustrated in FIG. 15B.

Further, a START/STOP switch 38 is used to start and stop the processing of the automatic motif data stored at the locations "AUTOMATIC ARPEGGIO", "AUTOMATIC BASS", "FIRST AUTOMATIC RHYTHM" and "SECOND AUTOMATIC RHYTHM" shown in FIG. 1C. Note, regarding the automatic motif data stored at the locations "AUTOMATIC ARPEGGIO" and "AUTOMATIC BASS", only a read operation of reading the stored data is effected but a radiation of musical sounds is "masked" or inhibited when the START/STOP switch 38 is turned on, and musical tones corresponding to the read data are not sounded until a key of the lower part 13*b* of the keyboard is operated. The inhibition of the radiation of musical sounds is effected by a sound radiating system 26.

As illustrated in FIG. 12A(*c*) and (*f*), the operations of processing the automatic motif data stored at the locations "AUTOMATIC ARPEGGIO" and "AUTOMATIC BASS" are effected only in the automatic performance mode. In contrast, the operations of processing the automatic motif data stored at the locations "First AUTOMATIC RHYTHM" and "SECOND AUTOMATIC RHYTHM" are effected in all of the performance modes except the recording/assignment mode. Namely, in the recording/assignment mode, the operations of processing the automatic motif data stored at these locations are not effected. Note, when the OFA mode and the bass/rhythm performance mode are on (see FIG. 12A(*e*)), musical sounds corresponding to rhythm motifs of the same group to which a rhythm motif to be played on the keys of the lower part 13*b* of the keyboard 13 belongs are not sounded.

Moreover, a timbre (MELODY) switch 33 is used to change a timbre (hereunder sometimes referred to as a melodic timbre) employed to perform a melodic motif. Each timbre switch 33 can select a timbre form four kinds of timbres, by using the ring shift technique.

Rhythm (RHYTHM) switches 34 are used to change a kind of rhythm employed to perform a rhythmic motif, and each rhythm switch 34 can alternatively select one rhythm form two kinds of rhythm.

A power (POWER ON) switch 35 is used to turn the power on or off for the entire system.

A volume (TOTAL VOL) switch 36 is a sliding-type switch and is used to change the volume of an output sound of an entire musical instrument.

In addition, a tempo (TEMPO) switch 37 comprises a switch for increasing a preset tempo and another switch for decreasing the

8. KEYBOARD 13

FIG. 5B is a plan view of the keyboard 13 provided with 49 keys C2 (key No.: 24)–C6 (72). Further, the lower part 13*b* thereof is provided with keys C2 (24)–G3 (43), and the upper part 13*a* thereof is provided with keys C3# (44)–C6(72). Note, ad-lib motifs of various patterns assigned to the keys C2 (24)–D3# (39) of the lower part 13*b* and the keys G3# (44)–B4 of the upper part 13*a* are fixed, and thus cannot be changed. In contrast, ad-lib motifs of various patterns assigned to the other keys of the keyboard 13 can be changed.

9. WORKING STORAGE AREA 46

FIGS. 13A and 13B shows the content of the working storage area 46 provided in the RAM 20.

Meter data, as illustrated in FIG. 7, corresponding to the rhythm selected by one of the rhythm switches 34 is set in a measure clock No. register 71. Further, the tempo data is set in a tempo register 72 by operating the tempo switch 37.

Moreover, data representing the established modes is stored in a mode register 73, and if the least significant bit (LSB) "SS" of the stored data is 1, the LSB "SS" indicates that the start/stop switch 38 is turned on. In contrast, if the LSB "SS" of the stored data is 0, the LSB "SS" indicates that the start/stop switch 38 is turned off. Three higher order bits "NOR", "B/R" and "AUT" shown in FIGS. 13A and 13B indicate the modes set by operating the mode switch 31. Moreover, if a further higher order bit or a flag "R/A" is 1, the bit "R/A" indicates that the recording/assignment switch 39 is turned on. In contrast, if the bit "R/A" is 0, the bit "R/A" indicates that the recording/assignment switch 39 is turned off. Furthermore, if a bit "OFA" is 1, the bit "OFA" indicates that the OFA switch 32 is turned on, and if the bit "OFA" is 0, the bit "OFA" indicates that the OFA switch 32 is turned off.

In a melodic timbre register 74, data representing numbers 0–31 corresponding to the melodic timbres selected by operating the timbre switch 33 is shifted to the left by 2 bits, as shown in FIGS. 13A and 13B.

Further, data representing Nos. 0–15, which correspond to a kind of rhythm selected by the rhythm switch 34, is stored in a rhythm No. register 75.

Furthermore, data indicating a kind of an accompanimental chord, as well as data indicating a root of the accompanimental chord, is set in a chord register 76. The accompanimental chord and the root thereof are detected from operated keys of the lower part 13*b* of the keyboard 13, or stored as the chord data when an ad-lib motif is played.

In addition, data which represents a state of each key of the lower part 13*b* of the keyboard 13 and is used to detect kinds of chords and roots of the chords is set in a key status register 77, and when a key of the lower part 13*b* is on, the corresponding data is 1, and when the key is off, the corresponding data is 0.

9-1. GROUPS OF SEQUENCE REGISTERS

Groups 78, 79, 80, 81, 82, 83, and 84 of a rhythm 1, rhythm 2, bass, arpeggio, melody 1, melody 2 and chord sequence registers are used to play the automatic motifs of the "AUTOMATIC ARPEGGIO", "AUTOMATIC BASS", "FIRST AUTOMATIC RHYTHM"

and "SECOND AUTOMATIC RHYTHM", and to play the ad-lib motifs assigned to the keys of the keyboard 13. Accordingly, seven kinds of sequence systems having these groups of the sequence registers and using programs, flowcharts of which will be described later, are provided for playing the ad-lib motifs, i.e., the automatic motifs of the "AUTOMATIC ARPEGGIO", "AUTOMATIC BASS", "FIRST AUTOMATIC RHYTHM" and "SECOND AUTOMATIC RHYTHM". Further, two groups of the sequence registers are provided for each case of playing a rhythmic motif and a melodic motif. Therefore, two kinds of the ad-lib rhythmic motifs can be played in parallel with one another, and similarly, two kinds of the ad-lib melodic motifs can be played in parallel with one another. Furthermore, as is obvious, the number of ad-lib motifs which can be simultaneously played can be increased by increasing the number of sequence registers. Note, an ad-lib motif to be played on a drum is performed by using a sequence system having rhythm 1 sequence registers, and another ad-lib motif to be played on cymbals is performed by using another sequence system having rhythm 2 sequence registers.

These sequence systems having the groups of the sequence registers as described above are assigned to various modes, as illustrated in FIG. 12B in which a white circle indicates that a sequence system is assigned to an ad-lib motif in response to a KEY ON operation of a key of the keyboard 13, and a white triangle indicates that a sequence system is assigned to an automatic motif in response to an operation of turning the start/stop switch 38 on. Namely, a performance of an ad-lib motif is started when a KEY ON operation of a key of the keyboard 13 is effected, and a performance of an automatic motif is started when the start-stop switch 38 is turned on. Note, for the automatic motifs of the "AUTOMATIC ARPEGGIO" and "AUTOMATIC BASS", the radiation of the corresponding musical notes is "masked" or inhibited during a time from the turning-on of the start/stop switch 38 to the KEY ON of a key of the keyboard 13, as previously described.

Each of these sequence registers is made up of registers A, B, C, D, HL, and M, as described hereunder.

First, the pattern Nos. of the automatic motifs and the ad-lib motifs of FIG. 1C, which are played by using the groups of the registers, are set in the A register, and when the most significant bit (MSB) "USE"of the data set in the A register is 1, the bit USE indicates that a group of the registers is being used, and, when the bit USE is 0, the bit USE indicates that a group of the registers is not used.

Further, data indicating timbres currently employed for playing an ad-lib motif and an automatic motif is set in the B register.

The sounding key No. used to determine the sounding frequency of a musical note having a percussion timbre is set in the C register. The sounding key Nos. are shown in FIG. 8 and are used only when playing a rhythmic ad-lib motif or automatic motif.

Furthermore, the step time data is set in the D register, whereby, when reading ad-lib motif data or automatic motif data, a waiting time reguired to read out the next tone data, beat data and chord data is measured.

Storage address data, representing addresses at which an ad-lib motif or an automatic motif currently being read is stored, is set in the HL register of the RAM 20. In this case, each storage address data is two byte long and is made up of a low order byte (L) and a high order byte (H).

In addition, data indicating a standby time is set in the M register, and is represented in terms of the number of measures between a moment at which a depressed key of the keybaord 13 is released and a performance of a rhythmic ad-lib motif or automatic motif is once stopped, and another moment at which the performance of a rhythmic ad-lib motif or automatic motif is resumed. If the MSB "M/A" of the data stored in the M register is "A", the bit M/A indicates that the performances of the rhythmic ad-lib motif data or automatic motif data is started by operating the start/stop switch 38. In contrast, if the MSB "M/A" of the data stored in the M register is "M", the bit M/A indicates that the performance of the rhythmic ad-lib motif data or automatic motif data is started by effecting a KEY ON operation of a key of the keyboard 13*b*.

Further, the content of a Low-Byte (i.e., a lower order byte) L are incremented by 1 in a measure clock counter 85 each time the interrupt signal INT2 is input thereto from the programmable timer 11. When the content of the byte L become equal to a value indicated by the measure clock No. register, the content of a High-Byte (i.e., higher order byte) H are incremented by 1 and that of the byte L is cleared. Namely, a count of the clock pulses is made according to the tempo and the meter. Note, the byte H represents the number of the measures or bars played from the start of a performance.

Event on/off data, event key No. data, and event velocity data corresponding to a key at which an event occurs are respectively and temporarily held in an event on/off register 89, an event key No. register 90 and an event velocity register 91, when the interrupt signals INT1 and INT3 are input thereto.

Further, ring top address data indicating a top address, to which data is written, is set in a ring top address register 92 in the ring buffer 49 of the RAM 20, and on the other hand, ring bottom address data indicating a bottom address, from which data is read, is set in a ring bottom address register 93 in the ring buffer 49. When the interrupt signals INT1–INT4 are input to the register 92, the ring top address data is updated. In contrast, the ring bottom address data is updated when the content of the ring buffer 49 are processed by excuting a main routine of a processing program to be described later.

A step time counter 86 is used to count the number of clock pulses corresponding to a time between a moment at which a KEY ON event occurs and another moment at which the next KEY ON event occurs. This counting operation is effected eact time the interrupt signal INT2 is input thereto from the programmable timer 11.

Further, address data indicating an address at which data is written is set in a recording address register 87 in the record buffer 48.

Key Nos. of the latest key of which a KEY ON operation is effected of the lower part of the keyboard are set in a rhythm key No. register 88, and following the setting of key No., the velocity data and the step time data are set therein.

A velocity memory area 94 is used to temporarily save the velocity data at the time of effecting a KEY ON operation of each key of the keyboard 13, to write a value indicated by the measure clock counter 85 at addresses at which a gating time and a velocity are written, to later evaluate the gating time at step 111 of FIG. 17, as described later, when a KEY ON operation and a KEY OFF operation are effected. The velocity memory area 94 has addresses corresponding to the key Nos. 120–127 of the keys of the lower part of the keyboard.

10. ASSIGNMENT MEMORY 4

FIG. 11 shows the content of the assignment memory 4 of the musical tone generating circuit 24. A maximum of 16 musical tone data can be set in this assignment memory 4, and each musical tone data is 4 bytes long.

As shown in FIG. 11, a key No. is set in a first byte, and the ON/OFF data stored at the MSB of the first byte indicates whether a key corresponding to the key No. is in a KEY ON state or a KEY OFF state.

Next, a gating time is set in a second byte. This gating time is decremented each time the interrupt signal INT2 is input from the programmable timer 11 to the memory 4, and when the content of the second byte become 0, the ON/OFF data stored at the first byte is cleared. Thereafter, data indicating the levels of an envelope is set instead of the gating time data.

Further, velocity data is set in a third byte. The velocity data indicating an "on velocity" is usually set therein at the time of effecting a KEY ON operation of a key, and the velocity data indicating an "off velocity" is usually set therein at the time of effecting a KEY OFF operation of a key.

In addition, a tone No. is set in a fourth byte. This tone No. is determined on the basis of both data indicating the timbre employed for playing a melodic or rhythm motif and the velocity data, or on the basis of both the timbre No. and the key No.

11. MUSICAL TONE GENERATING CIRCUIT 24

Figure 14A:
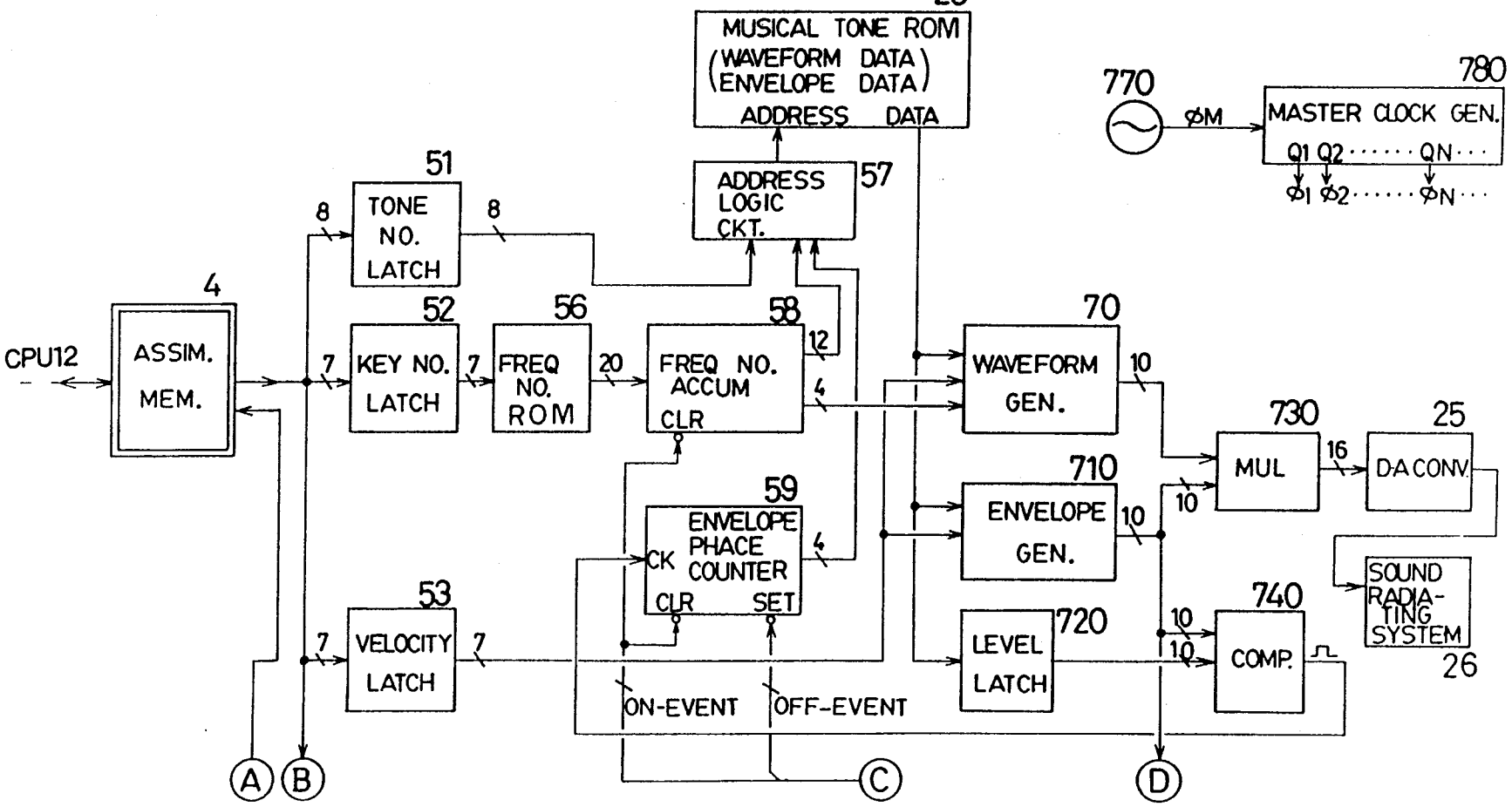
FIGS. 14A and 14B is a schematic block diagram illustrating the construction of a musical tone generating circuit of this embodiment of the present invention.
Figure 14B:
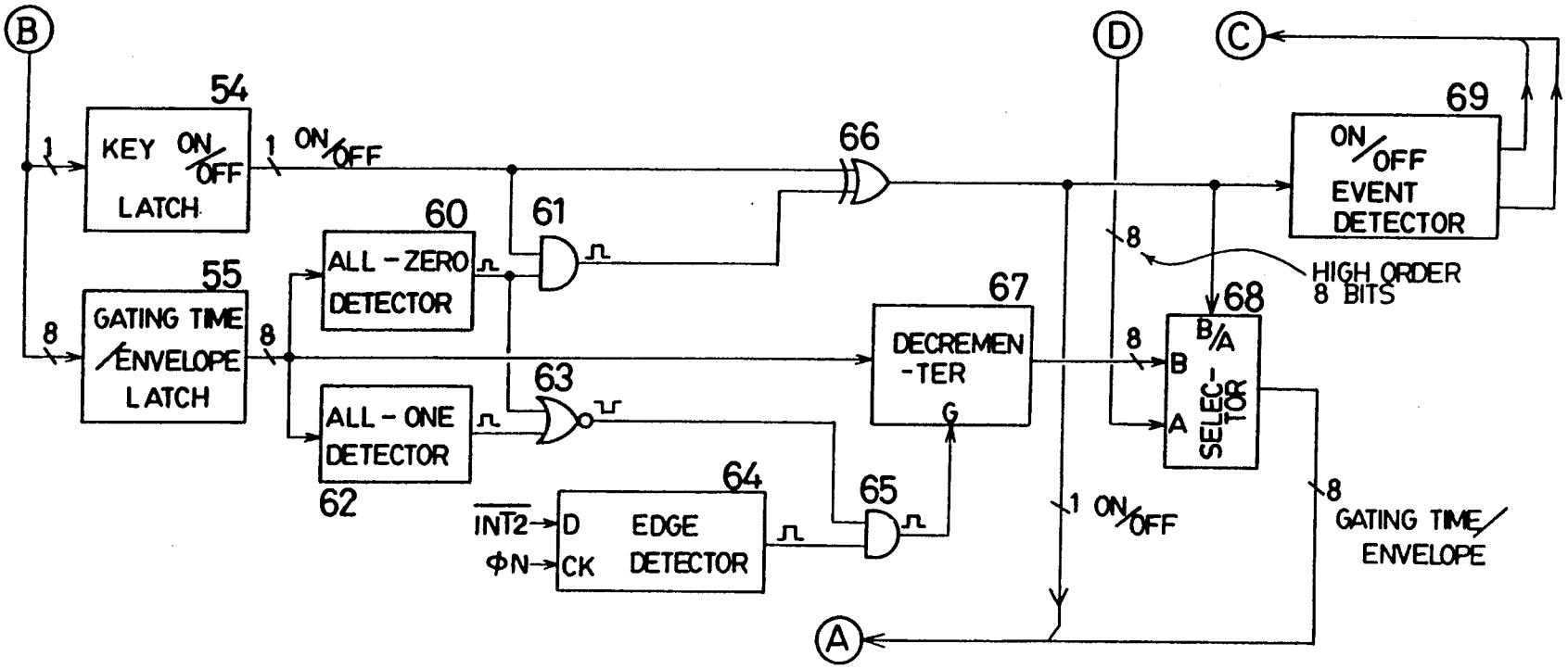

FIGS. 14A and 14B shows a practical configuration of the musical tone generating circuit 24. In this figure, small numerals written beside connecting lines indicate the number of bits required to represent data transferred on the connecting lines.

Each musical tone data stored in the assignment memory 4 is read therefrom in a time sharing manner. Namely tone No. data thereof is supplied to the ROM 23 via an address logic circuit 57 after being latched by a tone No. latch 51, and key No. data is supplied to a frequency number ROM 56 after being latched by a key No. latch 52. Then, corresponding frequency number data is read out of the ROM 56, and further, the thus read frequency number data corresponding to the same channel is accummulated by a frequency number accumulator 58. Thereafter, 12 high order bits of this accumulated frequency number data are fed to the ROM 23 together with the tone No. data, via the address logic circuit 57, and thus waveform data corresponding to the tone No. data is read out of the ROM 23 at a speed corresponding to the key No. data.

This waveform data read from the ROM 23 is further input to a waveform generator 70, wherein a waveform is generated according to both 4 low order bits of the accumulated frequency number data input from the accumulator 58 and velocity data input from a velocity latch 53, as described later, and waveform data representing the generated waveform is then output therefrom to a multiplier 730. The velocity data read from the assignment memory 4 is latched by the velocity latch 53.

On the other hand, an envelop phase counter 59 is used to count clock pulses to change one of phases (i.e., Attack, Decay, Sustain and Release phases) into another phase of the envelope. Envelope phase count data representing the results of counting clock pulses is output to the ROM 23 via the address logic circuit 57. A level and a rate of an envelope in a corresponding phase thereof are read in a time slot in which the envelope data is read. Further, data indicating the level and the rate of the envelope is input to the envelope generator 710, wherein envelope data indicating a level corresponding to the velocity data sent from the velocity latch 53 is generated. The generated envelope data is further output to the multiplier 730 wherein the waveform data is multiplied by the generated envelope data, and the result of the multiplication is output to the sound radiating system 26 via the DA converter 25, to thereby radiate musical sounds.

An attainment level of the envelope output from the ROM 23 is latched by a level latch 720 and then output to a comparator 740, wherein the attainment level is compared with the variable level represented by the envelope data output from the envelope generator 71. If the variable level is equal to the attainment level, a coincidence signal is output from the comparator 740, and this coincidence signal is input to the envelope phase counter 59 as an increment signal, to advance a current phase of the envelope to the next phase thereof.

The on/off data output from the assignment memory 4 is latched by a KEY ON/OFF latch 54 and is further output therefrom to an EXCLUSIVE-OR gate 66 and an AND gate 61. Further, the gating time data and the envelope data are latched by a gating time/envelope latch 55 and are further output therefrom to an all-zero detector 60, an all-one detector 62, and a decrementer 67.

When the gating time data latched by the latch 55 becomes 00 . . . 0 (0) and a current KEY ON state is changed to a KEY OFF state, a detection signal is output from the all-zero detector 60, and thereafter, is input to the EXCLUSIVE-OR gate 66 via an AND gate 61. In this case, if the embodiment is in a KEY ON state and the on/off data is 1, the AND gate 61 is enabled. Further, an output of the EXCLUSIVE-OR gate 66 is changed from 1 to 0, and the output "0" of the gate 66 is written to the assignment memory 4 as new on/off data. In contrast, if the embodiment is in a KEY OFF state and the on/off data is 0, the AND gate 61 is enabled. At that time, an output of the AND gate 61 is 0, and thus when the on/off data becomes 1, the output of the EXCLUSIVE-OR gate 66 changed from 0 to 1. This output "1" of the gate 66 is written to the assignment memory 4 as new on/off data.

Furthermore, the on/off data is input to an on/off event detector 69, which detects a change of the on/off data from 0 to 1 when an on-event occurs (i.e., a KEY ON operation is effected), or a change of the on/off data from 1 to 0 when an off-event occurs (i.e., a KEY OFF operation is effected), and outputs an on-event signal or an off-event signal as a detection signal. The on-event signal is input to the accumulator 58 and the controller 59, so that an accumulated value held in the accumulator 58, as well as a count value held in the counter 59, is cleared. On the other hand, the off-event signal is input to the counter 59, the phase of the envelope is changed to a Release phase.

The gating time data output from the latch 55 is written to the same channel area of the assignment memory 4 via a selector 68 after decremented by the decrementer 67, but after a KEY OFF operation is effected, a value indicated by a selection signal output from the selector 68 is changed from 1 to 0, and accordingly, the envelope data output from the envelope generator is selected.

An edge detector 64 is composed of a D-type flip-flop, and a reverse signal of the interrupt signal INT2 is input from the programmable timer 11 to a D-terminal thereof, and a 16-channel operation cycle signal is input to a CK-terminal thereof. Accordingly, a signal obtained by delaying a trailing edge of the interrupt signal INT2 to a leading edge of the 16-channel operation cycle signal, and further reversing the delayed signal, is output from the detector 64 and is thereafter input to the decrementer 67 via the AND gate 65. Note, the gating time is decremented at every output of the interrupt signal INT2.

The detection signal output from the all-zero detector 60 and that output from the all-one detector 62 are reversed and supplied to the AND gate 65 via a NOR gate 65, so that the NOR gate 65 is disabled and the decrementing operation of the decrementer 67 is stopped. Therefore, if the gating time data is 00 . . . 0 (0) or 11 . . . 1 (255 decimal), the gating time is not decremented, and thus the KEY OFF state or the KEY ON state is maintained.

Note, a master clock signal output from an oscillator 770 is frequency-divided in a master clock generator 780, and further, control signals having various periods are output therefrom to control the entire circuit of the embodiment.

12. MAIN ROUTINE

Figure 16:
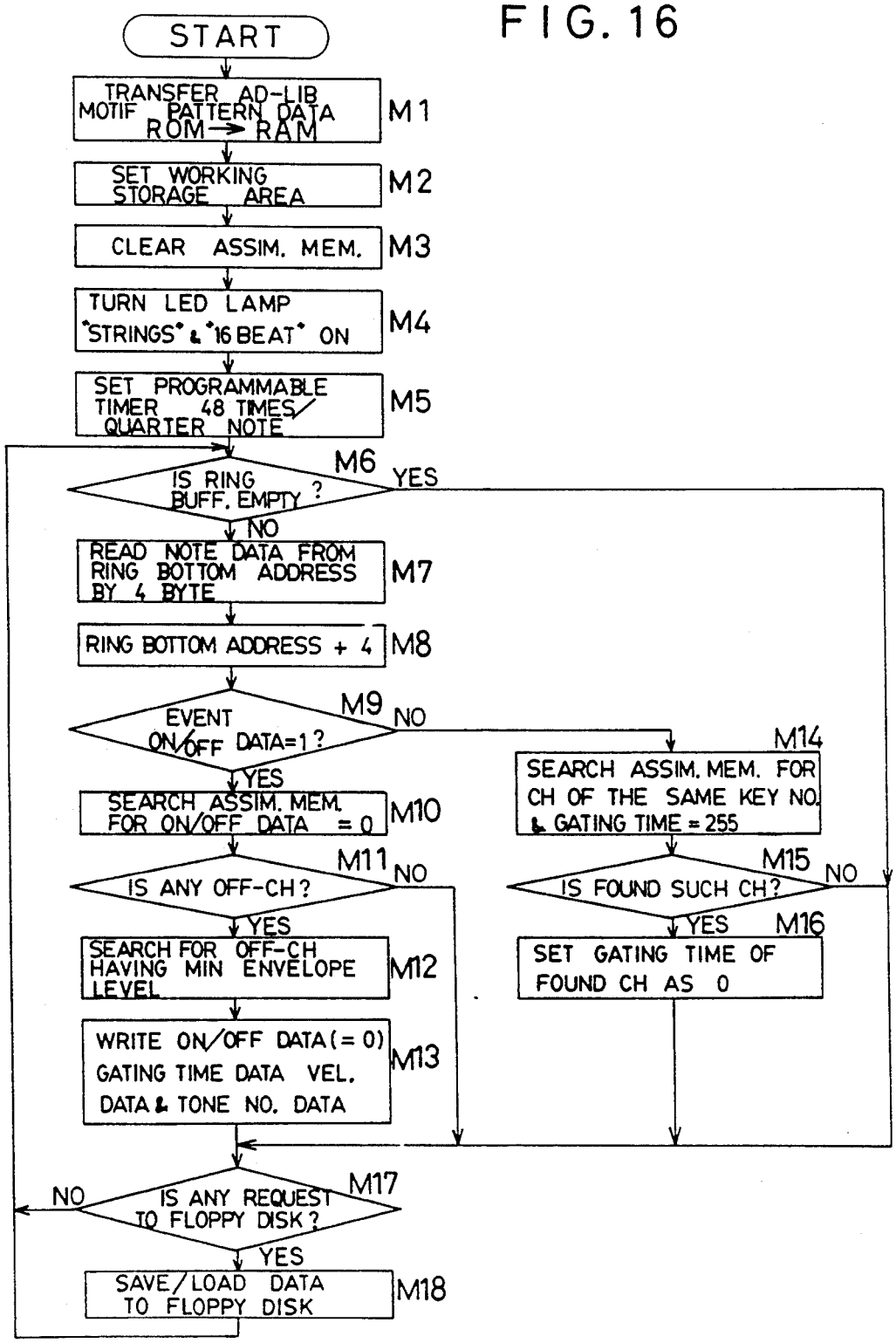

FIG. 16 is a flowchart of the main routine or program of the processing program to be executed by the CPU 12. This main program is executed after the power is turned on. Namely first an initialization, i.e., an assignment of initial values to variables, is effected. Note, this is not described in this figure for the sake of simplicity. The program then performs the following initial processing.

Namely, at step M1, all of the ad-lib motif data, which is preliminarily stored in the ad-lib motif pattern area 42 of the ROM 19, of 64 K. bytes is transferred to the RAM 20, and at step M2, the assignment 4 memory is cleared. Then data corresponding to operating conditions of the panel switch board 15 is set in each register of the working storage area of the RAM 20 at step M3, and information stored on the panel display memory 3 is displayed at step M4 by using the LED lamps. Namely, information on melodic timbres is displayed by the LED lamps "STRINGS" (see FIG. 5A), and information on the kinds of rhythm is displayed by the LED lamps "16 BEAT". Next, data indicating the above described number of clock pulses corresponding to a quarter note (i.e., 48) is set in the programmable timer 11 at step M5, and thus the initial processing is completed.

Next, it is determined at step M6 whether or not the necessary data has been written in the ring buffer 49 of the RAM 20. If already written therein, note data of 4 bytes is read from a reading address indicated by the ring bottom address register 93 of the working storage area 46 of the RAM 20 at step M7, and further, a value indicated by the ring bottom address register 93 is increased by 4 at step M8.

Subsequently, it is determined at step M9 whether on/off data included in the thus-read note data is 1 (i.e., the on/off data is in an on-state). If the on/off data is 1, a process of assigning data to new channels is performed at steps M10–M13. Namely first at step M10 the program searches the assignment memory 4 for channel areas in which the corresponding on/off data is in an off-state (i.e., the corresponding on/off data is 0). If such channel areas are found at step M11, a channel area having the smallest level of an envelope is selected at step M12. At that time, the on/off data of 1 and the note data read from the ring buffer 49 (i.e., key No. data, gating time data, velocity data, and tone No. data) are written to the selected channel area at M13.

Note that no channel area, in which the corresponding on/off data is in an off-state, is found at step M11, the program exits step M11 via the YES branch and thus the above described processing (hereunder referred to as the channel assignment processing) to be effected at steps M12 and 13 is not effected. Further, if no data is written to the ring buffer 49, the above described processing (hereunder referred to as an empty channel search processing) of searching for an empty channel corresponding to a channel area which is in an off-state, and the channel assignment processing, which are to be effected at steps M7 to M13, are not effected.

Thereafter, if an instruction to load and/or save data to the floppy disk 22 is issued at step M17, the instruction is executed at step M18.

Further, if the on/off data included in the note data read out of the ring buffer 49 is not 1 (i.e., the on/off data is not in an on-state) but 0 (i.e., the on/off data is in an off-state) at step M9, the program exits step M9 via the No. branch comprising steps M14 to M16, to perform the following KEY OFF processing.

First, at step M14, the program searches channels corresponding to channel areas of the assignment memory 4 for a channel in which the corresponding gating time data is 11111111 (=255 decimal) (i.e., a KEY ON operation is being effected) and to which the same key No. as represented by the key No. data included in the tone data read from the ring buffer 49 is assigned. If such a channel is found at step M15, the program sets the corresponding on/off data and the corresponding gating time data as 0 and 00000000 (0 decimal), respectively, at step M16 and a KEY OFF operation is started. Then, the program advances to steps M17 and M18 to load and/or save data to the floppy disk 22.

13. MUSICAL TONE SOUNDING PROCESS TO BE PERFORMED WHEN KEY EVENT OCCURS

FIGS. 17A–17H are flowcharts of a subprogram for performing a process of sounding musical tones when a KEY EVENT of a key occurs (i.e., a KEY ON operation of a KEY OFF operatopm of a key is effected) and an interrupt signal INT1 is output from the SCI circuit 10 to the CPU 12, or when a KEY EVENT occurs and an interrupt signal INT3 is output from the key scan circuit 14 to the CPU 12.

13-1. MUSICAL TONE SOUNDING PROCESS TO BE PERFORMED WHEN KEY EVENT OF KEY OF UPPER PART 13*a* OF KEYBOARD OCCURS IN OFA OFF MODE

First, on/off data, key No. data, and velocity data, which are temporarily stored in the SCI circuit 10 or the key switch memory 1, corresponding to a key for which a KEY EVENT occurs are written by the CPU 20 to the event on/off register 89, the event key No. register 90, and the vent velocity register 91 provided in the working storage area 46 of the RAM 20, respectively, at step 100. Next, it is determined at step 101 whether or not an OFA flag is set at the mode register of the working storage area 46. If the OFA flag is 0 (corresponding to an OFA off mode), it is determined from a key No. (hereunder referred to as an event key No.) of a new key (hereunder referred to as an event key), for which a KEY EVENT occurs, at step 102 whether the event key is of the upper part 13*a* or of the lower part 13*b* of the keyboard 13.

If the new key is of the upper 13*a*, the key No. (hereunder referred to as the key event No.) of the event key is decreased by 24 only in the case of the bass/rhythm performance mode at steps 103 and 104, to thereby lower a current tonic or employed to play a motif. In contrast, the current tonic is not lowered in the automatic and normal performance modes. Further, these performance modes are discriminated from one another on the basis of content of the mode register 73 of the working storage area 46. Note, the discrimination among the performance modes is similarly effected in steps 123 and 124 as will be described later. The reason for effecting the discrimination among the performance modes is that a condition for sounding a musical note changes according to the performance mode, as illustrated in FIG. 12A.

After effecting the processing at steps 103 and 104, the CPU 12 performs a data writing process to be effected by executing a subroutine SUB1 comprising steps 105-108. This subroutine SUB1 is executed in another process, as described later.

First, it is determined at step 105 whether or not on/off data corresponding to the event and stored at the event on/off register 89 is 1 (i.e., in an on-state). If the on/off data is 1, the subprogram enters step 106, and this on/off data, key No. data, gating time data of 11 . . . 1 (255 decimal), velocity data, and timbre data corresponding to the event key are written to writing addresses, which are determined on the basis of data held at the ring top address register 92, of the ring buffer 49.

Upon completion of the write operation at step 106, the data held at the ring top address register 92 is increased by 4 at step 107. This is because note data 4 addresses are required to store note data corresponding to one note.

In contrast, if it is found at step 105 that the on/off data is 0 (i.e., in an off-state), the subprogram enters step 108, and this on/off data, key No. data, gating time data of 00 . . . 0 (0), velocity data, and timbre data corresponding to the event key are written to the ring buffer 49.

Then, the CPU 12 determined, from the content of the record/assignment flag "R/A" of the mode register 73 of the working storage area 46, whether or not a current mode is a recording mode. If the current mode is the recording mode, it is further determined at step 110 whether the on/off data held at the event on/off register 89 of the working storage area 46 is 1 (i.e., in an on-state).

If the on/off data is 1, this off data, the content of the event key No. register 90, the measure clock counter 85, and the step time counter 86 are written to the record buffer 48 of the RAM 20 at step 111. Then, at step 112, the content of the recording address register 87 of the working storage area 46 is increased by 4. Subsequently, at step 113, on-velocity data at the time of effecting a KEY ON operation, i.e., the content of the measure clock counter 85 at the time of effecting a KEY ON operation, is written to addresses corresponding to the event key No. stored in the velocity memory area 94 of the working storage area 46. Thereafter, the step time counter 86 is cleared at step 114, and the then control returns to the main program.

In contrast, if it is found at step 110 that the event on/off data is 0 (i.e., in an off-state), at step 115, the subprogram searches the record buffer 48 for note data having the same key No. as that of a key corresponding to this event on/off data. Further, at step 116, the difference between the content of the measure clock counter 85 at the time of effecting a KEY ON operation stored at a second and third bytes of the found note data, and those of the measure clock counter 85 at this time of effecting a KEY OFF operation, are evaluated.

Further, if it is found at step 117 that difference data representing the evaluated difference is equal to or more than 11 . . . 1 (255 decimal), the on/off data (=1), the event key No., the gating time (=0), the velocity at the time of effecting a KEY OFF operation and the content of the step time counter are written to the record buffer 48 of the RAM 20 at step 118. Accordingly, note data for effecting a KEY OFF operation, which is separated from the note data used at the time of effecting a KEY ON operation and written to step 111, is written to the record buffer 48.

Next, the content of the recording address register 87 are increased by 4 by the CPU 12 at step 119, and at step 120, the difference data is made 11 . . . 1 (255 decimal). If it is found at step 117 that the difference data is less than 11 . . . 1 (255 decimal), the processing of writing the note data for effecting a KEY OFF operation to the record buffer 48 is not performed.

Thereafter, the difference data is written to the second byte of the note data searched at step 115, and velocity data corresponding to the key event No. stored in the velocity memory area of the working storage area is read from the key switch memory 1, and further is written to the third byte of the note data used at the time of effecting a KEY ON operation at step 122, and the control returns to the main program.

Accordingly, if the gating time data, which represents the gating time between a moment at which a KEY ON operation is effected and another moment at which a KEY OFF operation is effected, is less than 11 . . . 1 (255 decimal), the gating time data is written to the note data used to effect a KEY ON operation. If the gating time data, which represents the gating time between a moment at which a KEY ON operation is effected and another moment at which a KEY OFF operation is effected, is greater than 11 . . . 1 (255 decimal), the note data for effecting a KEY ON operation is separated from that for effecting a KEY OFF operation. Further, the gating time 11 . . . 1 (255 decimal) used to instruct a continuation of a KEY ON operation is written to the note data for effecting a KEY ON operation. On the other hand, the gating time 00 . . . 0 (0) used to instruct to a continuation of a KEY OFF operation is written to the note data for effecting a KEY OFF operation.

13-2. MUSICAL TONE SOUNDING PROCESS TO BE PERFORMED WHEN KEY EVENT OF KEY OF LOWER PART 13*b* OF KEYBOARD OCCURS IN OFA OFF MODE

If it is found at step 102 that the event key is a key of the lower part 13*b* of the keyboard 13, at steps M123 and 124 it is determined from the content of the mode register 73 of the working storage area 46 which of a normal, bass/rhythm, and automatic performance modes is a current mode. If the current mode is the normal performance mode, the above described processing of a recording of musical tone data is effected at steps 105–122.

Further, if the current mode is the bass/rhythm mode, it is determined at step 125 whether or not the event on/off data is 1 (i.e., in an on-state). If the event on/off data is 1, corresponding percussion timbre No. and sounding key No. are read at step 126 from the percussion timbre table 44 of the ROM 19 shown in FIG. 8, according to the event key No. Further, this on/off data, sounding key No. data, gating time data (=1), key-on-velocity data, and timbre No. data are written to the ring buffer 49 of the working storage area 46, and then the ring top address is increased by 4 at steps 127 and 128. Note, the writting address of the ring buffer 49, to which the event on/off data, the sounding key No. data, and so on are written, is determined on the basis of the content of the ring top address register 92.

Thereafter, at step 129, the CPU 12 determines from the data stored in the mode register 73 whether or not the current mode is the recording mode. If the current mode is the recording mode, it is further determined at step 130 whether or not a key No. (hereunder sometimes referred to as a rhythm key No.) of a key, which corresponds to a KEY EVENT, has occurred prior to this KEY EVENT, and is stored in the rhythm key No. register 88 of the working storage area 46, of the lower part of the keyboard is in agreement with an event key No. of a key, which corresponds to this new KEY EVENT, of the lower part of the keyboard.

If the rhythm key No. is not in agreement with the event key No., it is determined that a key indicating that a tone has a different percussion timbre is depressed at this time, and the event key No. (hereunder sometimes referred to as the event lower part key No.) of the lower part of the keyboard is written at step 131 to the rhythm key No. register 88. Subsequently, data representing the event key No. having an MSB to which 1 is added, as well as step time data (=0), is written to the record buffer 48, and the content of the recording address register 87 is increased by 2 (steps 132 and 133), and thus data corresponding to a key indicating a new percussion timbre is written thereto.

Next, velocity data stored in the velocity memory area 94 and data indicated by the step time counter 86 are written to the record buffer 48 at step 134, and further, the content of the recording address register 87 is increased by 2 at step 135. Thereafter, the step time counter 86 is cleared at step 136, and the control then returns to the main program.

Note, if the rhythm key No. is in agreement with the event key No., the percussion timbre is unchanged, and thus the percussion timbre data writing processing to be performed at steps 131–133 is not carried out. Further, if the current mode is not the recording mode at step 129, the recording processing to be effected at steps 130–136 is unnecessary, and thus the subprogram returns the control to the main program without executing steps 130–136.

Furthermore, if it is determined at steps 123 and 124 that the current mode is the automatic performance mode, the CPU 12 correct or modify on-key data, which represents on-states of keys, stored in the key status register 77 at step 137. Then, a chord or a root thereof is detected from this on-key data and the result of the detection is written to the chord register 76 at step 138. More particularly, the detection of the chord or the root is effected according to the chord table 43 used to read chords or roots thereof, by using the on-key data as addresses.

Further, the CPU 12 determines from the content of the mode register at step 139 whether or not the current mode is the recording mode. If the current mode is the recording mode, the CPU 12 further determines whether a value indicated by the step time counter 86 is equal to or more than 48, and if equal to or more than 48, the chord (or the root) indicated by the chord register 76 and the value indicated by the step time counter 86 are written to the record buffer 48 at step 141. Further, a value indicated by the recording address register 87 is increased by 2 at step 142, and the step time counter 86 is cleared at step 143.

If it is found at step 140 that the value indicated by the step time counter 86 does not exceed 48, the elasped time has not reached time corresponding to one beat, and thus the write process (or recording process) comprising steps 141–143 is not effected. Moreover, if it is found at step 139 that the current mode is not the recording mode, the recording process comprising steps 140–143 is unnecessary, and thus the subprogram returns the control to the main program without executing steps 140–143. In addition, in such a case, no data is written to the ring buffer 49, and thus, no sound corresponding to an operation of a key is radiated. (Note, in such a case the apparatus may be adapted to write data to the ring buffer and sound musical tones).

The chord data set in the chord register at step 138 is not cleared even when a KEY OFF operation is effected, but is maintained until a next KEY ON operation is effected. Based on this chord data, pitches used for playing the ad-lib motifs of the arpeggio and the bass are modified at step 224 of a macro MACRO5 and at step 230 (see FIG. 18B). Note, this processing of modifying the pitches may be omitted.

Namely the musical tone sounding process illustrated in FIG. 12A when a KEY EVENT occurs in an OFA off mode and in the record/assignment mode is performed in the above described manner.

13-3. MUSICAL TONE SOUNDING PROCESS TO BE PERFORMED WHEN KEY EVENT OF KEY OF UPPER PART 13*a* OF KEYBOARD OCCURS IN OFA MODE

Where it is determined at step 101 that the OFA flag is 1 (corresponding to an OFA on mode), the CPU 12 further determines from the key No. of the event key at step 144 whether the event key is of the upper part **13*a* or of the lower part 13*b* of the keyboard 13. If the event key is of the upper part 13*a*, it is determined from the content of mode register 73 of the working storage area 46 at steps 145 and 146 which of the normal, bass/rhythm, and automatic performance modes is the current mode. If the current mode is the automatic performance mode, it is determined at step 147 whether or not the event on/off data held at the event on/off register 89** is 1 (i.e., in an on-state).

If the event on/off data is 1 (i.e., in an on-state), the subprogram performs a processing of a melody 1 sequence comprising steps 148–160, which further constitute a macro MACRO1. This macro MACRO1 can be executed in another process.

In this process, first the USE flag (=1) and the event key No. are written to the A register of the group 82 of sequence registers "MELODY 1" (hereunder referred to as a MELODY 1 sequence register group 82), and a start address data representing a start address of a storage area, in which an ad-lib motif assigned to the event key is stored, is written to the HL register at step 148. This start address is determined in the following manner. Namely, first a series of addresses (e.g., 0000H-03FFH) of the ad-lib motif pattern area 47 corresponding to a selected kind of rhythm (e.g., "16 BEAT") employed to play the ad-lib motif of the first melody is selected, and then an ad-lib motif pattern No. corresponding to the selected series of addresses and the event key No. is selected from the ad-lib motif assignment list 42*b* (or 47*b*) of FIG. 1C. Further, a start address of FIG. 1B corresponding to the selected ad-lib motif pattern No. is selected.

Next, a timbre No. is read from a leading address, which is indicated by the HL register, of the ad-lib motif pattern area 47 of the RAM 20 and is written to the B register at step 149. Then, at step 150 the content of the HL register are increased by 2. Subsequently, it is determined at step 151 whether or not the MSB of data stored at an address, which is indicated by the HL register, of the ad-lib motif pattern area 47, is 1, i.e., whether or not the stored data indicates a timbre No. as illustrated in FIG. 2A.

If the stored data is timbre data, the subprogram enters step 152, at which step time data stored at the next address is read and then written to the D register. Further, it is determined at step 153 whether or not this step time data is 0. If the step time data is 0, there is no waiting time, and therefore, the timbre should be set immediately, and thus the timbre No. is set in the B register at step 154. Further, the content of the HL register are increased by 2 at step 155, and then the subprogram returns to step 151.

Next, at step 151, it is determined whether the data stored at this time is timbre data or first note data, and thus the subprogram advances to step 156, at which step time data stored at an address greater than the current address indicated by the HL register by 3 (i.e., time data stored at an address beyond the current address indicated by the HL register by 3) is read and then written to the D register. Thereafter, it is determined at step 157 whether or not this step time data is 0. If equal to 0, there is no waiting time, and therefore, musical notes should be immediately sounded. Accordingly, a value obtained by modifying the key No. of the note data by using a value indicated by the chord register 76, gating time, velocity, and the timbre No. writter to the B register is written to the ring buffer 49 at step 158.

Note, the modification of the key No. on the basis of the content of the chord register 76 is performed by increasing or decreasing the key No. by an integer (i.e., . . . −2, −1, 0, +1, +2 . . . ) selected according to the kind of chord and the root thereof, whereby the performances of all parts can be harmonized. Thereafter, the content of the ring top address register 92 is increased by 4 at step 159, that of the HL register is increased by 4 at step 160, and the subprogram then returns to step 151.

Further, at step 151, second note data is found, and thus step time data stored at an address greater than the current address by 3 is read and further written to the D register at step 156. Furthermore, it is determined at step 157 whether or not this step time date is 0. Usually step time data corresponding to note data is not 0, and thus the melody 1 sequence processing is terminated and the subprogram enters step 161 at which next sequence processing, i.e., melody 2 sequence processing, is started.

Processing a melody 2 sequence comprises steps which are similar to steps 148-160 constituting the macro MACRO1 for performing the melody 1 sequence processing, but the parameters used in the melody 2 sequence processing are different from the parameters used in the melody 1 sequence processing. Namely, a group of sequence registers used to perform the melody 2 sequence processing is a MELODY 2 sequence register group 83, and an ad-lib motif to be played in the melody 2 sequence processing is the ad-lib motif of the second melody. Similarly, as in case of the melody 1 sequence processing, note data succeeding the first note data is set in the melody 2 sequence processing of FIG. 18, as described below Accordingly, by operating one key, ad-lib motifs of two kinds of melodies, i.e., the first and second melodies, can be simultaneously performed in parallel with one another. Note, as is obvious, by increasing the number of sequence registers used for playing the motifs of the melodies, and the number of substeps composing KEY ON sequence processing to be performed at step 161, the number of ad-lib motifs of melodies to be simultaneously performed by operating one key can be increased. Similarly, a plurality of ad-lib motifs of rhythms, basses, arpeggios or chords other than melodies may be simultaneously played by operating only one key.

Therefore, when a KEY ON operation of a key is effected in an OFA mode, timbre data is set at a leading address of the series of addresses, which corresponds to an address motif assigned to the operated key, of the ad-lib motif pattern area 47*a* at steps 152-155, and thereafter, first note data is set at steps 156-160. Note, the note data succeeding the first note data is set when the interrupt signal INT2 is output in the melody 1 sequence processing of FIG. 18, as be described later. In this case, if the step time data corresponding to the first note data is not 0, and a waiting time exists, the first note data is also set when the interrupt signal INT2 is output.

Further, if the event on/off data is 0 (i.e., in an off-state), the subprogram proceeds to a first melody KEY OFF sequence processing to be performed by executing steps 162 and 163 which compose a macro MACRO2. This macro MACRO2 may be executed in other processes.

In this first melody KEY OFF sequence processing, first it is determined at step 162 whether or not the key No. set in the A register in the KEY ON sequence is in agreement with the key No. of a key for which a KEY OFF operation is effected. If in agreement with the key No. of the key of which a KEY OFF operation is effected, at step 163 the USE flag of the A register is made 0 and an operation of a sequence system for performing the melody 1 KEY OFF sequence processing is stopped, to thereby terminate the performance of the ad-lib motif of the first melody.

Subsequently, a KEY OFF sequence processing of the melody 2 (hereunder sometimes referred to as melody 2 KEY OFF sequence processing) is effected at step 164, and further, an operation of a sequence system for performing the melody 2 KEY OFF sequence processing is stopped, to thereby terminate the performance of the ad-lib motif of the second melody. If it is found at step 145 that the current mode is the normal performance mode, it is further determined at step 165 whether or not the event on/off data stored in the event on/off register 89 is 1 (i.e., in an on-state). If the event on/off data is 1, it is determined at steps 166 and 167 whether or not the USE flag of the A register of the MELODY 1 sequence register group 82 is 0. If the USE flag is 0 the macro MACRO 1 for performing the KEY ON sequence processing of the melody 1 is executed at step 168.

Further, if the USE flag of the A register of the melody 1 sequence register group 82 is 1, and accordingly, the musical tones of the ad-lib motif of the melody have been sounded at step 167, the subprogram advances to step 169, and it is determined whether the Use flag of the A register of the melody 2 sequence register group 83 is 0 (steps 169 and 170). If this USE flag is 0, the macro MACRO 1 for performing the melody 2 KEY ON sequence process is executed at step 171. This macro MACRO 1 comprises the same steps as steps 148–160 described above.

Therefore, when a KEY ON operation of a key is effected while the musical notes of an ad-lib motif of a melody are sounded by using a sequence system for performing a melody 1, the musical notes of an ad-lib motif of another melody are sounded later by using a sequence system for performing a melody 2. As is obvious, by increasing the number of sequence registers used for playing the motifs of the melodies and the number of substeps composing a process of performing a KEY ON sequence processing for playing a melody, comprising steps 169–171, the number of ad-lib motifs of melodies to be simultaneously performed by operating keys can be increased. Similarly, a plurality of ad-lib motifs of rhythms, basses, arpeggios and chords other than melodies may be simultaneously played in parallel with one another by operating a plurality of keys.

Note, the motif performing apparatus may be adapted to simultaneously play a plurality of kinds of ad-lib motifs by operating one key, and moreover, play the plurality of kinds of ad-lib motifs in parallel with and independently of one another by operating a plurality of keys.

Similarly, as when a KEY ON operation of a key is in an OFA mode, in the melody 1 and melody 2 KEY ON sequence processing, timbre data is set at a leading address of the series of addresses, which corresponds to an address motif assigned to the operated key, of the ad-lib motif pattern area 47*a*, at steps 152–155, and then first note data is set at steps 156–160. Note, the note data succeeding the first note data is set when the interrupt signal INT2 is output in the melody 1 and melody 2 sequence processing of FIG. 18, as described later. In this case, if the step time data corresponding to the first note data is not 0, and a waiting time exists, the first note data is also set when the interrupt signal INT2 is output, as in the case of the automatic performance mode.

Further, if the event on/off data is 0 (i.e., in an off-state) the subprogram proceeds to a process of performing KEY OFF sequence processing the melody 1 (hereunder sometimes referred to as melody 1 KEY OFF sequence processing) at step 165. If it is determined in the melody 1 KEY OFF sequence processing that the content of the A register are not in agreement with the event key No., the subprogram further proceeds to a process of performing the melody 2 KEY OFF sequence processing at step 173. This macro MACRO 2 (see FIG. 17F) is comprised of the same steps as steps 162 and 163 of FIG. 17D and 17E.

Moreover, if it is determined at step 146 that the current performance mode is the bass/rhythm performance mode, it is determined at step 174 whether or not the event on/off data stored in the event on/off register 89 is 1 (i.e., in an on-state). If the event on/off data is 1, the macro MACRO 1, which is comprised of the same steps as steps 148–160, for performing a bass KEY ON sequence processing is excuted at step 175. In contrast, if the event on/off data is 0 (i.e., in an off-mode), the macro MACRO 2, which is comprised of the same steps as steps 162–163, for performing bass KEY OFF sequence processing is executed at step 176.

Note, at step 175, the modification of a pitch of a musical tone corresponding to the bass is effected on the basis of the content of the chord register 76, as in case of step 158, but the content of the chord register 76 are not changed in this mode. Accordingly, it follows that the modification of the pitch is effected on the basis of a value which is indicated by the chord register 76 just before the motif performing apparatus enters this performance mode. Note, this modification of the pitch obviously may be omitted.

Namely, the automatic performance can be also effected in the case of a bass ad-lib motif.

In addition, as in the melody 1 and melody 2 KEY ON sequence processings, timbre data is set at a leading address of the series of addresses, which corresponds to an address motif assigned to the operated key, of the ad-lib motif pattern area 47*a*, at steps 152–155, and then first note data is set at steps 156–160. Further, note data succeeding the first note data is set when the interrupt signal INT2 is output in bass sequence processing of FIG. 18, as described later. In this case, if the step time data corresponding to the first note data is not 0 and a waiting time exists, the first note data is also set when the interrupt signal INT2 is output. as in the automatic performance mode and the normal performance mode.

13-4. MUSICAL TONE SOUNDING PROCESS TO BE PERFORMED WHEN KEY EVENT OF KEY OF LOWER PART 13*b* OF KEYBOARD OCCURS IN OFA MODE

If the operated key is of the lower part 13*b* of the keyboard 13, it is determined from the content of a mode register 73 of the working storage area 46, at steps 145 and 146, which of the normal, bass/rhythm, and automatic performance modes is the current mode (steps 177 and 178). If the current mode is the automatic performance mode, it is determined at step 179 whether or. not the event on/off data held at the event on/off register 89 is 1 (i.e., in an on-state).

If the event on/off data is 1 (i.e., in an on-state), the subprogram performs the melody 1 sequence processing to be effected by executing steps 148–160 which further constitutes a macro MACRO 1. This macro MACRO 1 can be executed in another process.

If the event on/off data is 1, the USE flag (=1) and the event key No. are written to the A register of the group 84 of sequence registers "CHORD" (hereunder referred to as a CHORD sequence register group 84), and a start address data representing a start address of a storage area, in which an ad-lib motif assigned to the event key is stored, is written to the HL register at step 180. This start address is determined in the following manner. Namely, first a series of addresses (e.g., OEOOH–OFFFH) of the ad-lib motif pattern area 47 corresponding to a selected kind of rhythm (e.g., "16 BEAT") employed to play the ad-lib motif of the first melody is selected, and then an ad-lib motif pattern No. corresponding to the selected series of addresses and the event key No. is selected from the ad-lib motif assignment list 42*b* (or 47*b*) of FIG. 1C. Further, a start address of FIG. 1B corresponding to the selected ad-lib motif pattern No. is selected.

Next, chord data is read from a leading address, which is indicated by the HL register, of the ad-lib motif pattern area 47 of the RAM 20 and is written to the chord register 76 at step 181, and the content of the HL register are increased by 2 at step 182. Subsequently, step time data of the second chord data is read and then written to the D register at step 183, and thereafter, it is determined at step 184 whether or not this step time data is 0. Usually the step time data between the first chord data and the second chord data is not 0, and thus the subprogram returns control to the main program. Note, the note data succeeding the first note data is set when the interrupt signal INT2 is output in the bass sequence processing of FIG. 18, as described later.

If the step time is 0 at step 184, there is no waiting time, and therefore, musical notes should be immediately sounded. Accordingly, the second chord data is set in the chord register 76 at step 185, and the subprogram returns to step 182.

As above described, the key No. is modified at steps 158 and 224 on the basis of the chord data, which is set in the chord register 76 at steps 181 and 185. In this case, no data is written to the ring buffer 49, and thus no musical notes corresponding to the operated keys are sounded. Note, the motif performing apparatus may be adapted to write data to the ring buffer and sound the musical tones corresponding to the operated keys.

Further, even if a KEY OFF operation is effected, the group 84 of the chord sequence registers are still used after step 179, and thus the reading of the ad-lib motif data of the chord is continued at steps 233–240 until the mode is changed at steps 424–429. Based on this chord data representing the ad-lib motif of the chord, the pitches of the ad-lib motifs of the melody, the arpeggio, and the bass are changed at step 158 (161) of the macro MACRO 1 and step 224 (230) of the macro MACRO 5. Note, this modification of the pitches may be omitted.

If it is determined that the current performance mode is the normal mode, lower-part-key-on data, which denotes that a key of the lower part of the keyboard is in an on-state and is set in the key status register 77, is modified at step 186. Further, a chord or a root thereof is detected from the lower-part-key-on data and the detected chord or root thereof is set in the chord register 76 at step 187. Thereafter, the subprogram proceeds with a data writing process, which is the same as effected by executing steps 105–108 of the subroutine SUB1, of writing data to the ring buffer 49 at step 188.

Here, the key No. is modified at steps 158 and 224 on the basis of the chord data set in the chord register 76. Further, because data is written to the ring buffer 49 as described above, musical tones corresponding to the operated key are sounded. Nevertheless, the chord data set in the chord register 76 is not cleared even when a KEY OFF operation is effected but is preserved until a next KEY ON operation is effected, and based on this chord data, the pitches of the musical tones of the ad-lib motif of the melody are changed at a substep (corresponding to step 158) in steps 168 and 171 (i.e., in the macro MACRO 1). Note, this modification of the pitches may be omitted.

If it is determined at step 178 that the current mode is the bass/rhythm performance mode, the CPU 12 further determines, from the content of the key discriminating data table 45 of FIG. 9, whether the event key is a white or a black key, at step 189. If the event key is a white key, a macro MACRO 3 for performing a sequence processing of the rhythm 1 is executed. This macro MACRO3 may be executed in other processes.

In this process, it is first determined at step 190 whether the event on/off data is 1 (i.e., in an on-state). If the event on/off data is 1, the USE flag (=1) and the event key No. are written to the A register of the group 78 of sequence registers "RHYTHM 1" (hereunder referred to as a RHYTHM 1 sequence register group 78), and a start address data representing a start address of a storage area, in which an ad-lib motif assigned to the event key is stored, is written to the HL register at step 191. This start address is determined in the following manner. Namely, first a series of addresses (e.g., OCOOH–ODFFH) of the ad-lib motif pattern area 47 corresponding to a selected kind of rhythm (e.g., "16 BEAT") employed to play the ad-lib motif of the rhythm is selected, and then an ad-lib motif pattern No. corresponding to the selected series of addresses and the event key No. is selected from the ad-lib motif assignment list 42*b* (or 47*b*) of FIG. 1C. Further, a start address of FIG. 1B corresponding to the selected ad-lib motif pattern No. is selected.

Next, a key No. of a key of the lower part 13*b* (hereunder referred to as a lower part key No.) is read from a leading address, which is indicated by the HL register, of the ad-lib motif pattern area 47 of the RAM 20. Thereafter, a timbre No. and a sounding key No. are obtained from the lower part key No., on the basis of the content of the percussion timbre table 44, and are set in the B register and the register C, respectively, at step 192. Furthermore, the content of the HL register are increased by 2 at step 193.

Subsequently, step time data corresponding to a second beat data is read and then written to the D register at step 194, and further, it is determined at step 195 whether or not this step time data is 0. If the step time data is 0, there is no waiting time and thus the timbre should be set immediately. Accordingly, it is determined at step 196 whether or not the MSB of data stored at an address, which is indicated by the HL register, of the ad-lib motif pattern area 47 is 1, i.e., whether or not the stored data indicates a lower part key No. as illustrated in FIG. 2B.

If the stored data indicates a lower part key No., the subprogram advances to step 197, at which the on/off data (=1), the sounding key No. set in the C register, gating time data (=1), velocity data included in the beat data and the percussion timbre data set in the B register are written to the ring buffer 49. Further, the content of the ring top address register 92 are increased by 4 at step 198, and the subprogram then returns to step 193.

Next, at steps 192–195, it is determined whether step time data corresponding to second beat data is 0, but usually step time data between the first and second beat data is not 0. Therefore, the manual/automatic flag M/A stored of the M register is set as 0 (corresponding to a manual performance of the rhythm), and further, the content of the measure counter of the M register are set as 1 at step 1A1, and the subprogram then returns the control to the main program.

Accordingly, in this rhythm 1 sequence processing, the percussion timbre No. and the sounding key No. are set at a leading address of the series of addresses, which corresponds to an address motif assigned to the operated key, of the ad-lib motif pattern area 47*a* at steps 190–192, and then first beat data is set at steps 193 –198 and 1A2. Further, the performance of the ad-lib motif of the rhythm is stopped in response to a KEY OFF operation, and beat data succeeding the first beat data is set when the interrupt signal INT2 is output in the rhythm 1 sequence processing of FIG. 18, as described later. In this case, if the step time data corresponding to the first beat data is not 0 and a waiting time exists, the first beat data is also set when the interrupt signal INT2 is output, as in the automatic performance mode and the normal performance mode. This also applies to a rhythm 2 sequence processing described later.

This rhythm 1 sequence processing is effected by using the group 82 of the rhythm 1 sequence registers in response to an operation of a white key of the lower part 13*b* of the keyboard 13 to perform an ad-lib motif of the rhythm to be played on a drum type percussion instrument. Nevertheless, even if an automatic motif of the "FIRST AUTOMATIC RHYTHM" to be played on a drum type percussion instrument is performed when the start/stop switch 38 is turned-on, by using the group 82 of the rhythm 1 sequence registers to perform the rhythm 1 sequence processing before the white key is operated, the group 82 of the rhythm 1 sequence registers are used to play the ad-lib motif of the rhythm in response to the operation of white key, and thus the performance of the automatic motif of the "FIRST AUTOMATIC RHYTHM" is terminated. Thereafter, when a KEY OFF operation of the key of the lower part 13*b* is effected, the performance of the automatic motif of the "FIRST AUTOMATIC RHYTHM" is resumed. A waiting time between a moment at which the KEY OFF operation of the key of the lower part 13*b* is effected and another moment at which the performance of this automatic motif is resumed, is represented by the value (=1) set in the measure counter at step 1A1. This also applies to a rhythm 2 sequence processing of performing an ad-lib motif of the rhythm to be played on a cymbal type percussion instrument.

As described above, when a white key of the lower part 13*b* is operated during a performance of an automatic motif of a first rhythm to be played on a drum type percussion instrument, and thus a performance of an ad-lib motif of the rhythm to be played on a drum type percussion instrument is effected, the performance of the automatic motif of the first rhythm to be played on a drum type percussion instrument is terminated. This also applies to the rhythm 2 sequence processing of performing an ad-lib motif of the rhythm to be played on a cymbal type percussion instrument. As a result of the above described process, an automatic performance of an automatic motif does not overlap a performance of an ad-lib motif, and a simple method of performing a piece of music can be realized.

If it is determined at step 189 that an operated key is a black key, the subprogram proceeds with the rhythm 2 sequence processing at step 1A3, and immediately upon completion of the rhythm 2 sequence processing, the subprogram returns the control the main program. As seen from FIG. 17H, the same macro MACRO 3 comprising steps 190–1A2 is executed or used in both the rhythm 1 and rhythm 2 sequence processing. Note, the group of sequence registers used in the rhythm 2 sequence processing is not the same as the group of rhythm 1 sequence registers (corresponding to rhythm to be played on a drum type percussion instrument) but is a group of rhythm 2 sequence registers (corresponding to a rhythm to be played on a cymbal type percussion instrument).

Therefore, when a KEY ON operation of a key is effected while an ad-lib motif of a rhythm is being performed by using, e.g., a system including the rhythm 1 sequence registers (corresponding to a rhythm to be played on a drum type percussion instrument), an ad-lib motif of a rhythm can be performed by using another system including the rhythm 2 sequence registers (corresponding to a rhythm to be played on a cymbal type percussion instrument), following the performance effected by using the system including the rhythm 1 sequence registers. As is obvious, by increasing the number of sequence registers used for playing an ad-lib motif of a rhythm and the number of substeps composing a process of performing a KEY ON sequence processing of playing a rhythm comprising step 190–1A2, the number of ad-lib motifs of rhythms to be simultaneously performed by operating keys can be increased.

Note that in this embodiment, only two types (i.e., a drum type and a cymbal type) of percussion instruments are employed, but obviously other types of percussion instruments may be employed. Further, a finer classification of percussion instruments may be employed in this embodiment. Moreover, string instruments, woodwind instruments and brass instruments (e.g., trumpets and horns) may be employed as musical instruments for playing rhythms in this embodiment. Furthermore, rhythmic motifs may be classified according to the pitches and durations of musical tones used to play the motifs. In addition, when a key is operated, an automatic performance may be stopped even when playing automatic motifs of a melody, a bass, an arpeggio, and a chord other than a motif of a rhythm. Further, when a key is operated to play an ad-lib motif of a rhythm by using a certain kind of percussion instrument, an automatic performance of an automatic motif of a rhythm by using another kind of percussion instrument may be stopped. For example, if a key is operated to start a performance of an ad-lib motif of a rhythm by using a drum during an automatic performance of a motif of a rhythm played by using cymbals, the automatic performance of the motif of the rhythm is stopped. Moreover, when an ad-lib motif of a part (e.g., a rhythmic part) is played on a certain kind of percussion instrument, an automatic performance of an automatic motif of another part (e.g., a melodic part) may be stopped. Furthermore, the motif performing apparatus can operate without a waiting time between a moment at which a KEY OFF operation is effected and another moment at which an automatic performance of an automatic motif is resumed, and in such a case, steps 1A1, 1A2, and 246–248 can be omitted. Note, a waiting time between a moment at which a KEY OFF operation is effected, and another moment at which an automatic performance of an automatic motif is resumed, may be a time other than a time corresponding to a measure. In this case, a value other than 1 is set in the measure counter at step 1A1.

14. MUSICAL TONE SOUNDING PROCESS TO BE PERFORMED WHEN INTERRUPT SIGNAL INT2 IS OUTPUT

FIGS. 18A–18D are flowcharts of a musical tone sounding process to be performed when a periodic interrupt signal, i.e., an interrupt signal INT2, is output from the programmable timer 11 to the CPU 12. In this process, a sequence processing of performing ad-lib motifs of a rhythm 1, a rhythm 2, a bass, an arpeggio, a melody 1, a melody 2, and a chord can be effected.

14-1. RHYTHMIC SEQUENCE PROCESSING

In the rhythm 1 sequence processing, it is first determined at step 200 whether or not the USE flag of the A register of the group 78 of the rhythm 1 sequence registers is 1 (i.e., the A register is used). If the USE flag is 1 step time data stored in the D register is decremented by 1 at step 201 and next, at step 202, it is determined whether or not the step time data becomes 0. This processing of decrementing the step time data by 1 is effected each time the interrupt signal INT2 is output, and accordingly, the step time data becomes 0 when a time corresponding to a one step time has elapsed.

When the step time data becomes 0, it is determined at step 203 whether or not the MSB of data stored at an indicated address in the ad-lib motif pattern area 47 of the RAM 20 indicated by the HL register is 1, i.e., whether or not data stored at the indicated address is timbre data. If the stored data is not timbre data but beat data, the subprogram advances to step 209, at which the on/off data (=1), sounding key No. set in the C register, gating time data (=1), velocity data included in the beat data, and percussion timbre No. set in the B register are written to the ring buffer 49. Subsequently, the content of the ring top address register 92 are increased by 4 at step 210, and further, the content of the Hl register are increased by 2 at step 211. Thereafter, the step time data of a next beat data is set in the D register at step 212, and the subprogram then returns to step 202.

If it is determined at step 203 that the MSB of the stored data is 1, and thus the stored data is timbre data, the subprogram advances to step 204 at which it is determined whether or not data stored at an address, which is indicated by the HL register, of the ad-lib motif pattern area 47 of the RAM 20 is 11 . . . 1 (255 decimal), i.e., whether or not the data stored at the address indicated by the HL register is repeat data.

If this data is not repeat data, the subprogram advances to step 207, at which a lower part key No. is read from an address, which is indicated by the HL register, of the ad-lib motif pattern area 47 of the RAM 20, and further, a percussion timbre No. and a sounding key No. are obtained from the read lower key No., on the basis of the percussion timbre table 44 of FIG. 8, and are set in the B register and the C register, respectively. Further, the content of the HL register are increased by 2 at step 208, the beat data is set at steps 209–212, and the subprogram then returns to step 202.

If it is determined at step 204 that the stored data is repeat data 11 . . . 1 (255 decimal), the step time of this repeat data is set in the D register at step 205, the start address data is once again written to the HL register at step 206, and the subprogram then returns to step 202. Note, this start address data is determined as in case of step 191.

In this way, at each elapse a step time (steps 200–202), beat data of an ad-lib motif of a rhythm is set at steps 209–212 and timbre data is set at steps 207 and 208, and further, these setting processes are repeated according to the repeat data (steps 204–206).

It is found at step 200 that the USE flag is 0, or if it is found at step 202 that a step time indicated by the D register is not 0 yet, the subprogram proceeds with rhythm 2 sequence processing at step 213. This rhythm 2 sequence processing is similar to the rhythm 1 sequence processing (i.e., steps 200–212 and the macro MACRO 4). Note, the group of rhythm 2 sequence registers is used in the rhythm 2 sequence processing.

14-2. BASS SEQUENCE PROCESSING

In the bass sequence processing, it is first determined at step 214 whether or not the USE flag of the A register of the group 80 of bass sequence registers is b 1 (i.e., this group of the bass sequence registers are being used). If the USE flag is 1, step time data stored in the D register is decremented by 1 at step 215. Then, it is determined at step 216 whether or not the step time data has become 0. This decrementing of the step time data is effected each time the interrupt signal INT2 is output, and therefore, when a time corresponding to a step time has elapsed, the step time data becomes If the step time data becomes 0 it is determined at step 217 whether the MSB of data stored at an indicated address in the ad-lib motif pattern area 47 of the RAM 20, (i.e., the data stored at the indicated address is timbre data). If the data stored at the indicated address is not timbre data but tone data, the subprogram advances to step 224 at which the on/off data (=1), the key No. data representing a key No., which is modified in accordance with the content of the chord register 76, of a key corresponding to a tone represented by the tone data, gating time data, the timbre No. data stored in the B register, is written to the ring buffer 49. Subsequently, the content of the ring top address register 92 are increased by 4 at step 225, and the content of the HL register are increased by 4 at step 226. If it is determined at step 227 that the MSB of the next data is 1 (i.e., the next data is timbre data), step time data stored at an address greater than the address indicated by the HL register by 1 is set in the D register at step 228. In contrast, if it is determined at step 227 that the MSB of the next data is 0 (i.e., the next data is note data), step time data stored at an address greater than the address indicated by the HL register by 3 is set in the D register at step 229, and the subprogram then returns to step 216.

Further, if it is determined at step 217 that the MSP of data stored at an address indicated by the HL register is 1 (i.e., the stored data is timbre data), the subprogram advances to step 218, at which it is determined whether or not data held at an address, which is indicated by the HL register, of the ad-lib motif pattern area 47 of the RAM 20 is 11 . . . 1 (255 decimal) i.e., whether or not the held data is repeat data).

If this data not repeat data, the subprogram advances to step 221 at which timbre No. data is read from the address, which is indicated by the HL register, of the ad-lib motif pattern area 47 of the RAM 20 and then is set in the B register. Subsequently, the content of the HL register are increased by 2 at step 222, the step time data of the note data is set in the D register at step 223, and the subprogram then returns to step 216.

Furthermore, it it is determined at step 218 that the stored data is repeat data 11 . . . 1 (255 decimal), the step time of this repeat data is set in the D register at step 219, the start address data is once again written to the HL register at step 220, and the subprogram then returns to step 216. Note, this start address data is determined as in step 191.

In this way, at each elapse of a step time (steps 214–216), note data of a bass ad-lib motif is set at steps 224–229 and timbre data is set at steps 221–223, and further, these setting processes are repeated according to the repeat data (steps 218–220).

If it is found at step 214 that the USE flag is 0 or if it is found at step 216 that a step time indicated by the D register is not yet 0, the subprogram proceeds with the arpeggio sequence processing, melody 1 sequence processing, and melody 2 sequence processing, in this order (steps 230, 231 and 232). The arpeggio sequence processing, melody 1 sequence processing, and melody 2 sequence processing are similar to the bass sequence processing (i.e., steps 214–229 and the MACRO 5). Note, in the arpeggio sequence processing, melody 1 sequence processing and melody 2 sequence processing, the group of arpeggio sequence registers, the group of melody 1 sequence registers, and the group of melody 2 sequence registers are used, respectively.

14-3. CHORD SEQUENCE PROCESSING

In the bass sequence processing, it is first determined at step 233 whether or not the USE flag of the A register of the group 84 of the bass sequence registers is 1 (i.e., this group of the bass sequence registers is being used). If the USE flag is 1, step time data stored in the D register is decremented by 1 at step 234. Further, it is determined at step 235 whether or not the step time data has become 0. This decrementing of the step time data is effected each time the interrupt signal INT2 is output, and therefore, when a time corresponding to a step time has elapsed, the step time data becomes 0. If the step time data becomes 0, the chord data stored at an address, which is indicated by the HL register, of the ad-lib motif pattern area 47 of the RAM 20 is set in the chord register 76 at step 236. Further, the content of the HL register is increased by 2 at step 237, and step time stored at the next address is set in the D register at step 238. Thereafter, it is determined at step 239 whether or not data stored at the address, which is indicated by the HL register, of the ad-lib motif pattern area of the RAM 20 is 11 . . . 1 (255 decimal) (i.e., whether or not the stored data is repeat data).

If this data is not repeat data, the subprogram returns to step 235. In contrast, if the stored data is repeat data, the start address data is once again written to the HL register at step 240, and the subprogram then returns to step 235. Note, this start address data is determined as in step 191.

In this way, at each elapse of a step time (steps 233–235), chord data of an ad-lib motif of a chord is set at steps 236–238, and further, these setting processes are repeated according to the repeat data (steps 239 and 240).

If it is found at step 233 that the USE flag is 0, or if it is found at step 235 that a step time indicated by the D register is not yet 0, the subprogram advances to step 241.

14-4. COUNTING PROCESS

In the counting process comprising steps 242–245 and 251–256, the low-byte of the measure clock counter 85 is first increased by 1 at step 241, and then, if it is found at step 242 that the content of the measure clock counter 85 is in agreement with meter data stored in the measure clock register 71, a value indicated by the high-byte of the measure clock counter 85 is increased by 1 at step 244. Further, if it is found at step 245 that the content of the mode register 73 is 00100101B (i.e., the motif performing apparatus is in the OFA mode and in the bass/rhythm performance mode, and the start/stop switch 38 is not turned on), or if it is also found at step 251 that the content of the mode register 73 is 0001*1B (i.e., the motif performing apparatus is in the recording/assignment mode, and the start/stop switch 38 is turned on), the content of the counter 86 is increased by 1 at step 252**. Note, the character B added to a number indicates that the number is a binary number, and further, the character * indicates an arbitrary number.

Further, if it is found at step 253 that the content of the step time counter 86 has reached 11 . . . 1 (255 decimal), a dummy event data is written to the record buffer 48 at step 254, that of the recording address register 87 is increased by 2 at step 255, and subsequently, the step time counter 86 is cleared at step 256, and the subprogram then returns control to the main program. Note, the dummy event data is used when an overflow occurs in an area of a byte storing the step time data (i.e., the step time data becomes greater 255). When playing an ad-lib motif of a melody or a bass ad-lib motif, 1-byte timbre data is set as the dummy event data, and when playing an ad-lib motif of a chord, 2-byte chord data is set as the dummy event data.

14-5. PROCESSING OF RESUMING AUTOMATIC RHYTHMIC PERFORMANCE

If the motif performing apparatus is in the OFA mode and in the bass/rhythm performance mode, and the start/stop switch 38 is turned on at step 245, the processing of resuming the performance of the automatic motif data stored at the locations "FIRST AUTOMATIC RHYTHM" and "SECOND AUTOMATIC RHYTHM" is effected, and thereafter the subprogram returns to step 251.

In the processing of resuming the performance of the automatic motif data stored at the location "FIRST AUTOMATIC RHYTHM", it is first determined at step 246 whether or not a value indicated by the M register is within the range of from OOH to 80H (i.e., whether or not the motif performing apparatus is in a mode of a manual performance of a rhythmic motif and should wait for the resumption of the automatic rhythmic performance. If YES, the content of the M register is decremented by 1 at step 247. Further, if it is found at step 248 that the content of the M register is 0, the group 78 of the rhythm 1 sequence registers is set at step 249. The processing of setting the group 78 of the rhythm 1 sequence registers is as illustrated in FIG. 20.

Subsequently, the subprogram proceeds with the processing (hereunder referred to as the second automatic rhythm performance processing) of resuming the performance of the automatic motif data stored at the location "SECOND AUTOMATIC RHYTHM" at step 250. Note, the processing of resuming the performance of the automatic motif data stored at the location "FIRST AUTOMATIC RHYTHM" is the same as that of resuming the performance of the automatic motif data stored at the location "SECOND AUTOMATIC RHYTHM", with the exception that the group of rhythm 2 sequence registers are used in the second automatic rhythm performance processing.

Thus, when a waiting time has elapsed after a KEY OFF operation is effected, the performance of the automatic motif data stored at the location "FIRST AUTOMATIC RHYTHM", and that of the automatic motif data stored at the location "SECOND AUTOMATIC RHYTHM", can be resumed independently of each other.

15. PROCESSING TO BE PERFORMED WHEN SWITCH OF PANEL SWITCHBOARD IS OPERATED

Figure 19A:
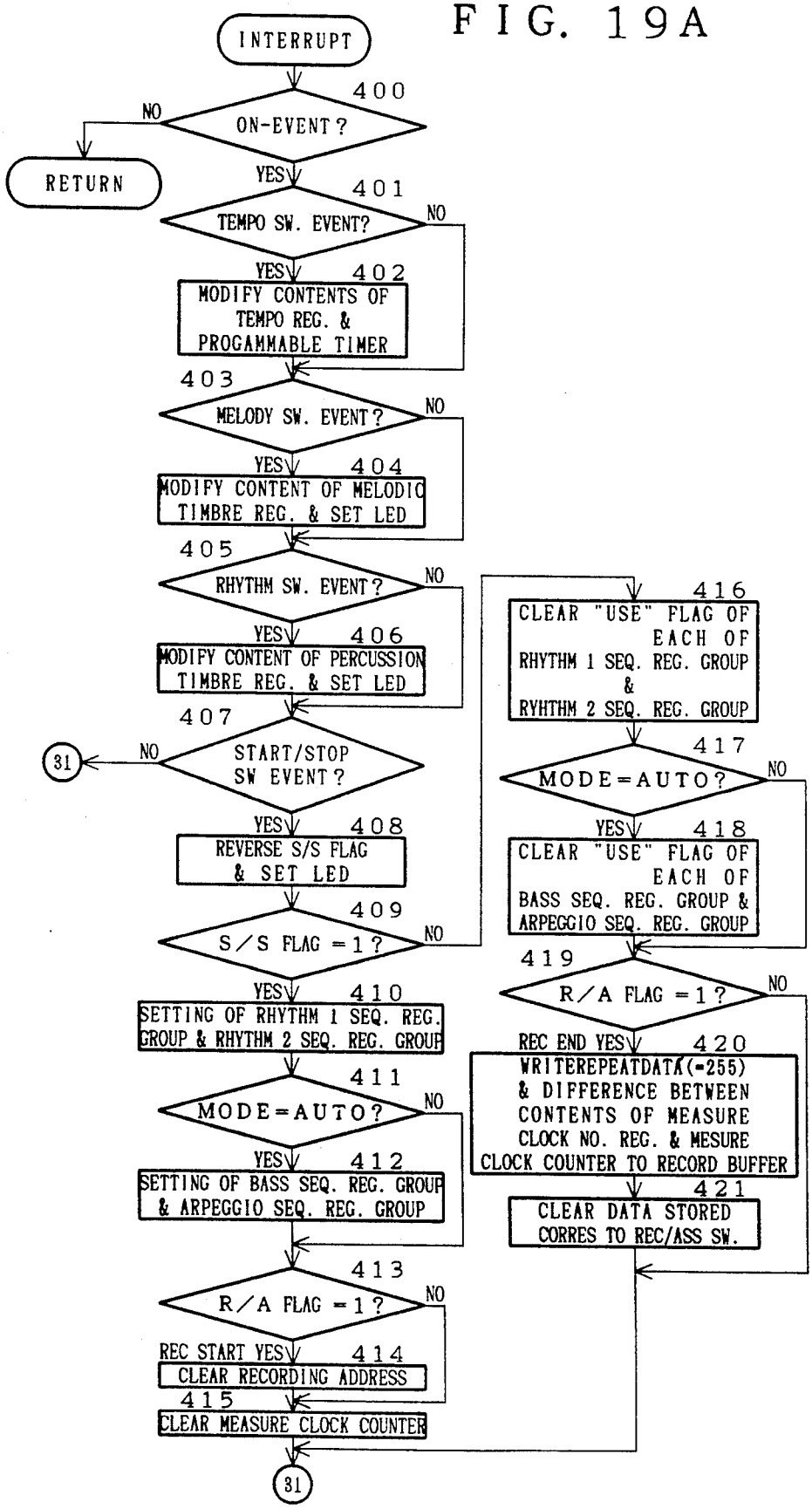
FIGS. 19A and 19B are flowcharts of a program to be executed when a panel switch of the panel switchboard is operated in this embodiment of the present invention.
Figure 19B:
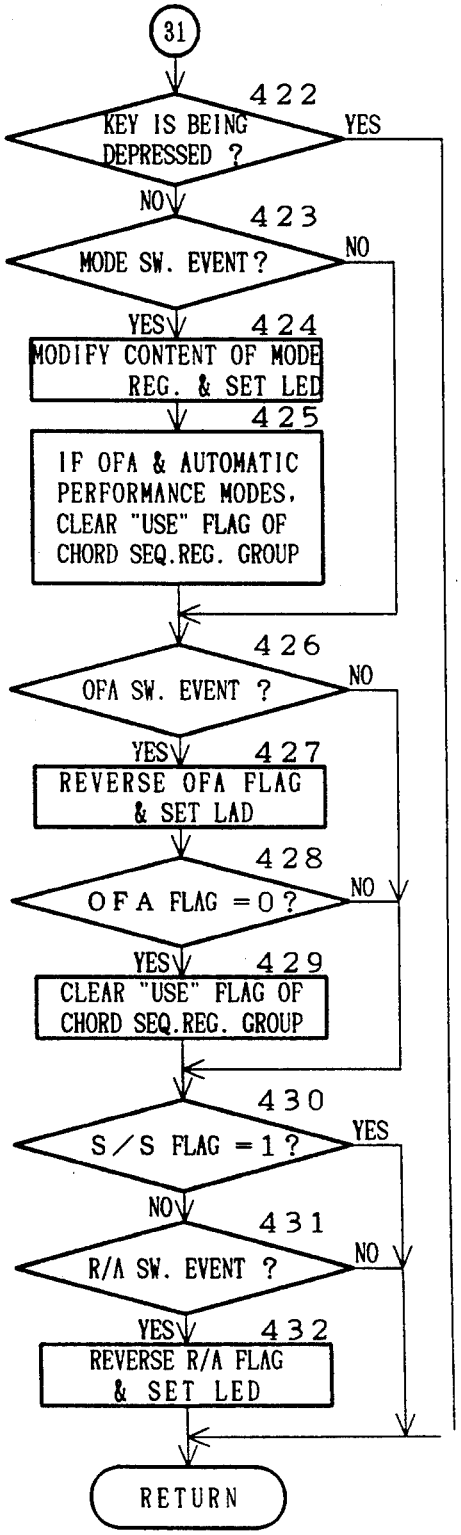

FIGS. 19A and 19B are flowcharts of a subprogram for effecting a processing to be performed when a panel switch of the panel switchboard 15 is operated and the interrupt signal INT4 is output from the panel scan circuit 16 to the CPU 12.

In this processing, if it is determined at step 400 that an event (i.e., a KEY EVENT) which has occurred is an on-event (i.e., a KEY ON operation has been effected), the content of the tempo register 72 and the value preset in the programmable timer 11 are modified at steps 401 and 402 where a switch corresponding to this event (i.e., an operated switch) is the tempo switch 37. Further, where the operated switch is a timbre switch 33, the content of the melodic timbre register 74 and those of the panel display memory 3 are modified at steps 403 and 404. Moreover, where the operated switch is the rhythm switch 34, the content of the rhythm No. register 75, and the panel display memory 3 are modified at steps 405 and 406. Furthermore, where the start/stop switch 38 is operated, the S/S flag is reversed and part of the content of the panel display memory 3 corresponding to the start/stop switch 38 is modified at steps 407 and 408.

Figure 20:
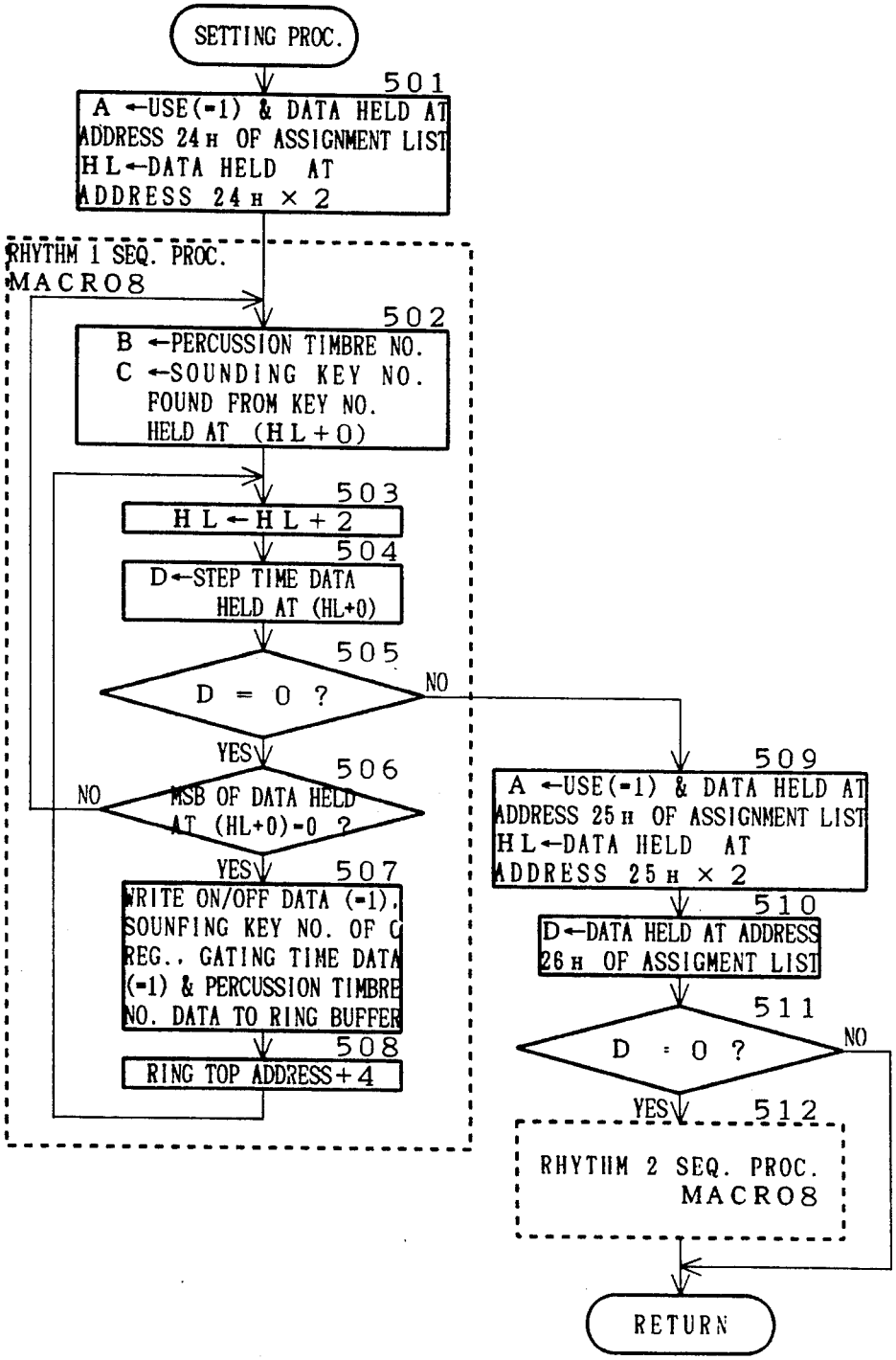

If it is found at step 409 that the S/S flag is 1 (i.e., the start/stop switch 38 is turned on), the setting processing of the group 78 of rhythm 1 sequence registers and the group 79 of rhythm 2 sequence registers is effected as illustrated in FIG. 20, and the automatic performance of rhythmic automatic motifs is started at step 410. At that time, if the AUT flag of the mode register 73 is 1 and the current mode is the automatic performance mode, the setting processing of the group 80 of bass sequence registers and that of the group 81 of arpeggio sequence registers are effected at steps 411 and 412 to start the automatic performances of the bass automatic motifs and the automatic motifs of the arpeggio. In addition, if the R/A flag of the mode register 73 is 1 and the current mode is the recording/assignment mode, the recording address register 87 and the measure clock counter 85 are cleared at steps 413 and 415.

Further, if it is found at step 409 that the S/S flag is 0 (i.e., the start/stop switch 38 is turned off), the USE flag of the group 78 of rhythm 1 sequence registers and that of the group 79 of rhythm 2 sequence registers are cleared, whereby these sequence registers are released, and thus the automatic performances of the automatic motifs are stopped at step 416. At that time, if the AUT flag of the mode register 73 is 0 and the current mode is the automatic performance mode, the USE flag of the group 80 of bass sequence registers and that of the group 81 of arpeggio sequence registers are cleared, whereby these sequence registers are released, and thus the automatic performances of the bass automatic motifs and the automatic motifs of the arpeggio are stopped at steps 417 and 418. Further, if the R/A flag of the mode register 73 is 1 and the current mode is the recording/assignment mode, the repeat data (=11 . . . 1 (255 decimal)) and data representing the difference between a value indicated by the measure clock register 71 and a value indicated by the measure clock counter 85 are written to the record buffer 48, and thereafter, the R/A flag of the mode register and part of the content of the panel display memory 3 corresponding to the recording/assignment switch 39 are cleared at steps 419–421.

Subsequently, it is determined at step 422 whether any of the keys of the keyboard 13 are depressed. If no keys are depressed, the content of the mode register 73 and that of the panel display memory 3 are modified when the mode switch 31 is operated, at steps 423 and 424. In this case, if the motif performing apparatus is in the OFA mode and the automatic performance mode, the USE flag of the group 84 of chord sequence registers is cleared, whereby these sequence registers are released, and thus the detection of the chord is stopped at step 425. Thereafter, when the OFA switch 32 is operated, a value indicated by the mode register 73 and the content of the panel display memory 3 are modified at steps 426 and 427. In this case, when the OFA flag becomes 0, and the USE flag of the group 84 of the chord sequence registers is cleared, whereby these sequence registers are released, and thus the detection of the chord is stopped at steps 428 and 429.

If the mode is changed at step 425 or 429, the reading and the outputting of the ad-lib motif of the chord are stopped. As is obvious, the reading and the outputting of the ad-lib motif of the chord may be stopped by, for example, turning off the start/stop switch 38.

Next, if it is found at step 430 that the S/S flag of the mode register is 0 (i.e., the start/stop switch 38 is turned off), the R/A flag of the mode register 73 is reversed and the content of the panel display memory 3 is modified when the recording/assignment switch 39 is operated, at steps 431 and 432. Thereafter, the subprogram returns the control to the main program.

Note, if it is determined at step 422 that at least one key is depressed, the above described mode changing processing to be performed at steps 423–432 is not effected, and thus the content of the performance is not changed.

16. PROCESSING OF SETTING GROUPS 78 AND 79 OF RHYTHM SEQUENCE REGISTERS

The processing of setting the groups 78 and 79 of rhythm sequence registers to be performed at steps 249 and 410 is effected in accordance with the flowchart of a subprogram of FIG. 20.

First, at step 501, the pattern No. of the automatic motifs of the "FIRST AUTOMATIC RHYTHM" stored at an address 024H of the ad-lib motif assignment list 42*b* (or 47*b*) of FIG. 1C and the USE flag (=1) are set in the A register, and further, a start address of FIG. 1B corresponding to this pattern No. (i.e., data stored at an address, which is obtained by doubling the pattern No., of the ad-lib motif assignment list 42*b* (or 47*b*)) is set in the HL register. This data to be set in the A register is usually event key No. data, but there is no key No. corresponding to an automatic motif, and thus in this case, the pattern No. of an automatic motif is set in the A register.

Subsequently, a lower part key No. is read from a leading address, which is indicated by the HL register, of the ad-lib motif pattern area 47 of the RAM 20, and thereafter, a percussion timbre No. and a sounding key No. are obtained from the lower part key No. on the basis of the percussion timbre table 44 of FIG. 8 and are written to the B register and the C register, respectively, at step 502. Then, the content of the HL register is incremented by 2 at step 503.

Further, step time data of second beat data is read and written to the D register at step 504, and it is determined at step 505 whether or not this step time data is 0. If this step time data is 0, no waiting time exists, and thus musical notes corresponding to the ad-lib motif should be immediately sounded. Accordingly, it is determined at step 506 whether or not the MSB of data stored at an address, which is indicated by the HL register, of the ad-lib motif pattern area 47 of the RAM 20 is 1 (i.e., whether or not the stored data is a lower part key No., as illustrated in FIG. 2B).

If the stored data is a lower part key No., the subprogram advances to step 507, at which on/off data (=1), the sounding key No. set in the C register, the gating time (=1), velocity data included in this beat data, and the timbre data set in the B register are written to the ring buffer 49 at step 507, the ring top address register 92 is then incremented by 4 at step 508, and the subprogram returns to step 503.

Further, at steps 503–505, it is determined whether or not the step time data of the second beat data is 0. Usually, step time data between the first beat data and the second beat data is not 0, and thus the subprogram returns the control to the main program.

Accordingly, the percussion timbre No. and the sounding key No. stored at a leading location of the automatic motif of the "FIRST AUTOMATIC RHYTHM" are set at step 502, and the first beat data is set at steps 503–508. Further, beat data succeeding the first beat data is set when the interrupt signal INT2 is output in the rhythm 1 sequence processing of FIG. 18. This is the same as when the automatic motif of the "FIRST AUTOMATIC RHYTHM" is performed.

Subsequently, at step 509, the pattern No. of the automatic motif of the "FIRST AUTOMATIC RHYTHM" stored at an address 025H of the ad-lib motif assignment list 42*b* (or 47*b*) of FIG. 1C is set in the A register, and further, a start address of FIG. 1B corresponding to this pattern No. (i.e., data stored at an address, which is obtained by doubling the pattern No., of the ad-lib motif assignment list 42*b* (or 47*b*)) is set in the HL register.

Thereafter, a delay time between the performance of the "FIRST AUTOMATIC RHYTHM" and that of the "SECOND AUTOMATIC RHYTHM" is set in the D register at step 510, and it is determined at step 511 whether or not this delay time is 0. If the delay time is 0, the delay time has already elapsed or data representing a delay time is initially set as 0, and thus the subprogram proceeds with the rhythm 2 sequence processing at step 512, and then returns the control to the main program. This rhythm 2 sequence processing is the same as the rhythm 1 sequence processing (i.e., steps 501–50 and the macro MACRO 1), with the exception that the group of rhythm 2 sequence registers are used in the rhythm 2 sequence processing.

Note, in the processing of setting the group 78 of rhythm 1 sequence registers to be performed at step 249, the processing to be effected at steps 501–508 is performed. Further, in the processing of setting the group 79 of rhythm 2 sequence registers to be performed at step 250, the processing to be effected at steps 509 and 512 is performed.

In addition, in the processing of setting the group 80 of bass sequence registers and the group 81 of arpeggio sequence registers to be performed at step 412, a processing which is the same as effected at steps 501–508 is performed. Note, the groups of sequence registers are the group of bass sequence registers and the group of arpeggio sequence registers. Further, the pattern Nos. of the automatic motif to be set are those of the automatic motifs stored at the locations "AUTOMATIC ARPEGGIO" and "AUTOMATIC BASS", and furthermore, step 402, step 504, and step 507 are replaced by step 221, step 229, and step 507, respectively.

Although a preferred embodiment of the present invention is described in this specification, it should be understood that the present invention is not limited thereto and that other modifications will be apparent to those skilled in the art without departing from the spirit of the invention. For example, the information on the motifs shown in FIGS. 2A, 2B, and 2C may be modified by adding additional information thereto or deleting a part thereof. Further, instead of a keyboard type instrument, a string type instrument or a wind type instrument may be employed as the means for indicating the radiating of a sound. The scope of the present invention, therefore, should be determined solely by the appended claims.

What is claimed is:

1. A motif performing apparatus comprising:

storage means for storing information representing a motif to be performed;

instruction means for instructing radiation of a musical tone representing the motif;

reading means for reading the stored information from said storage means according to an operation of said instruction means;

output means for outputting the stored information read by said reading means;

first detecting means for detecting a beginning of operation of said instruction means;

first reading control means for controlling a beginning of reading of said reading means according to the detection of said first detection means;

second detection means for detecting a termination of operation of said instruction means; and second reading control means for controlling a termination of reading of said reading means according to the detection of said second detection means.

2. The motif performing apparatus of claim 1, wherein said instruction means includes a plurality of instructing elements, said reading means reading information corresponding to each of the plurality of instructing elements, separately, in response to an operation of each of the plurality of instructing elements.

3. The motif performing apparatus of claim 1, wherein said storage means stores plural types of motifs, and said reading means reads information on each type of motif in response to an instruction from said instruction means.

4. The motif performing apparatus of claim 2, wherein said storage means stores plural types of motifs, and said reading means reads information on each type of motif in response to an instruction from the corresponding one of said plurality of instructing elements.

5. The motif performing apparatus of claim 1, wherein said storage means stores plural types of motifs, and said reading means reads information on the plural types of motifs, in parallel, in response to an instruction from said instruction means.

6. The motif performing apparatus of claim 2, wherein said storage means stores plural types of motifs, and said reading means reads information on the plural types of motifs, in parallel, in response to an instruction from corresponding one of said plurality of instructing elements.

7. The motif performing apparatus of claim 1, wherein said reading means repeatedly reads identical information from said storage means while said instruction means is operating.

8. The motif performing of claim 2, wherein said reading means repeatedly reads identical information from said storage means while the corresponding one of said plurality of instructing elements is operating.

9. The motif performing apparatus of claim 1, wherein the motif to be performed is a melody motif.

10. The motif performing apparatus of claim 1, wherein the motif to be performed is a chord motif.

11. The motif performing apparatus of claim 1, wherein the motif to be performed is a rhythm motif.

12. The motif performing apparatus of claim 1, wherein said output means outputs stored information of another musical tone, which represents another motif, according to another instruction from said instruction means.

13. The motif performing apparatus of claim 1, wherein said instruction means is connected to an external circuit.

14. The motif performing apparatus of claim 1, wherein said instruction means instructs radiation of the musical tone for at least one portion of the information representing a motif stored in said storage means.

15. The motif performing apparatus of claim 2, wherein said plurality of instructing elements instruct radiation of the musical sound for plural types of information representing motifs stored in said storage means.

16. The motif performing apparatus of claim 14, wherein said at least one portion of the information representing a motif is selected from the plural types of information representing motifs stored in said storage means.

17. The motif performing apparatus of claim 15, wherein said plural types of information representing motifs are selected from said storage means.

18. The motif performing apparatus of claim 16, wherein said selected at least one portion of the information representing a motif is modified to another portion of information representing a motif stored in said storage means according to an automatic rhythm performance.

19. The motif performing apparatus of claim 17, wherein said selected plural types of information representing motifs are modified to other types of information representing motifs stored in said storage means according to an automatic rhythm performance.

20. A motif performing apparatus comprising:

storage means for storing information representing a motif to be performed;

instruction means for instructing radiation of a musical tone representing the motif;

reading means for reading the information from said storage means according to an operation of said instruction means;

output means for outputting the information read by said reading means;

first detection means for detecting a beginning of operation of said instruction means;

first reading control means for controlling a beginning of reading of said reading means according to the detection of said first detection means;

second detection means for detecting a termination of operation of said instruction means;

second reading controls means for controlling a termination of reading of said reading means according to the detection of said second detection means;

automatic performance means for effecting an automatic performance; and stop means for stopping the automatic performance if said instruction means is operating while the automatic performance is effected by the automatic performance means.

21. The motif performing apparatus of claim 20, wherein said stop means causes said automatic performance means to begin the automatic performance when operation of said instruction means is terminated.

22. The motif performing apparatus of claim 21, wherein the beginning of the automatic performance caused by said stop means is effected when a predetermined time has elapsed after operation of said instruction means is terminated.

23. A motif performing apparatus comprising:

storage means for storing a series of pieces of information, representing a motif to be performed;

a plurality of instruction means, each of which instructs radiation of a musical tone representing a portion of the motif;

reading means for reading each classified piece of information in the series of pieces of information from said storage means according to an operation of said instruction means;

output means for outputting each piece of information read by said reading means;

first detection means for detecting a beginning of operation of said instruction means;

first reading control means for controlling a beginning of reading of said reading means according to the detection of said first detection means;

second detection means for detecting a termination of operation of said instruction means;

second reading control means for controlling a determination of reading of said reading means according to the detection of said second detection means;

automatic performance means for effecting an automatic performance in accordance with each piece of information; and stop means for stopping the automatic performance effected in accordance with each piece of information if said instruction means corresponding to each piece of information is operating while the automatic performance is effected in accordance with each of the pieces of information effected by said automatic performance means.

24. The motif performing apparatus of claim 23, wherein the series of pieces of information classified on the basis of the specific concept, includes pieces of information representing motifs having the same tone color or timbre.

25. The motif performing apparatus of claim 23, wherein said output means and said automatic performance means utilize the pieces of information representing motifs to output and effect a rhythm, by using common waveform data read from said storage means at various reading speeds.

26. A motif performing apparatus comprising:

storage means for storing information representing a motif of an accompanimental chord to be performed;

instruction means for instructing radiation of a musical tone representing the motif;

reading means for reading the stored information from said storage means according to an operation of said instruction means;

output means for outputting the stored information read by said reading means;

first detecting means for detecting a beginning of operation of said instruction means;

first reading control means for controlling a beginning of reading of said reading means according to the detecting of said first detection means;

second detection means for detecting a termination of operation of said instruction means; and second reading control means for controlling a termination of reading of said reading means according to the detection of said second detection means.

27. The motif performing apparatus of claim 26, wherein said reading means continues reading after operation of said instruction means is terminated.

28. The motif performing apparatus of claim 26, wherein said reading means and said output means are terminated by effecting a predetermined operation of a switch.

29. The motif performing apparatus of claims 1, 2, 20, 23 or 26, wherein said second reading control means terminates a reading of said reading means after said reading means reads a portion of the information representing a motif and after a detection of said second detection means.

30. A motif performing apparatus comprising:

storage means for storing melody, accompaniment, and rhythm information to be performed;

instructing means for instructing radiation of a musical tone from at least one of the melody, accompaniment, and rhythm information;

automatic accompaniment means for generating an automatic accompaniment from the accompaniment and rhythm information stored in said storage means, independent of the radiation of the musical tone by said instructing means; and automatic melody performance means for modifying a melody portion of the radiated musical tone utilizing other melody information stored in said storage means, during radiation of the musical tone by said instructing means.

31. The motif performing apparatus of claim 30, wherein the automatic accompaniment is automatic rhythm backing, including a first chord, wherein a second chord can be assigned to modify the automatic rhythm backing by said automatic accompaniment means.

32. The motif performing apparatus of claim 31, wherein the automatic rhythm backing is keyboard rhythm backing associated with a key of a keyboard, which is repeated for a predetermined number of periods upon activation of the key.

* * * * *